US007942571B2

(12) United States Patent
Midas et al.

(10) Patent No.: US 7,942,571 B2
(45) Date of Patent: May 17, 2011

(54) MIXER WITH SHAKING AND TUMBLING MOTION

(75) Inventors: Thomas J. Midas, Oak Park Heights, MN (US); Benjamin M. Johnson, Zimmerman, MN (US)

(73) Assignee: Red Devil Equipment Company, Plymouth, MN (US)

( * ) Notice: Subject to any disclaimer, the term of this patent is extended or adjusted under 35 U.S.C. 154(b) by 819 days.

(21) Appl. No.: 11/856,548

(22) Filed: Sep. 17, 2007

(65) Prior Publication Data

US 2008/0068924 A1 Mar. 20, 2008

Related U.S. Application Data

(60) Provisional application No. 60/888,896, filed on Feb. 8, 2007, provisional application No. 60/825,980, filed on Sep. 18, 2006.

(51) Int. Cl.
*B01F 7/02* (2006.01)
*B01F 7/00* (2006.01)

(52) U.S. Cl. ..... 366/217; 366/216

(58) Field of Classification Search ..... 366/217
See application file for complete search history.

(56) References Cited

U.S. PATENT DOCUMENTS

| | | | | |
|---|---|---|---|---|
| 1,144,272 | A | 6/1915 | West | |
| 1,774,257 | A * | 8/1930 | English | 366/217 |
| 2,937,814 | A | 5/1960 | Joisel | |
| 4,148,590 | A | 4/1979 | Sotirianos | |
| 6,086,242 | A * | 7/2000 | Rajamani et al. | 366/217 |
| 6,598,627 | B2 | 7/2003 | Manzari et al. | |
| 2003/0053370 | A1 | 3/2003 | Murakami | |
| 2006/0283521 | A1 | 12/2006 | Bartholomew et al. | |

FOREIGN PATENT DOCUMENTS

| | | |
|---|---|---|
| EP | 0402668 | 12/1990 |
| JP | 61119602 | 6/1986 |
| SU | 1572687 | 6/1990 |
| WO | 0013918 | 3/2000 |

OTHER PUBLICATIONS

International Search Report and Written Opinion of International Application No. PCT/US2007/078724, mailed May 8, 2008, 21 pp.

* cited by examiner

*Primary Examiner* — Walter D Griffin
*Assistant Examiner* — Christopher K VanDeusen
(74) *Attorney, Agent, or Firm* — Faegre & Benson LLP

(57) ABSTRACT

A mixer for combining ingredients using a composite shaking and tumbling motion. The mixer includes a base carrier rotating about a primary axis and supporting a container carrier assembly having a clamp retaining a container to be mixed. The container carrier assembly is coupled to the base carrier to oscillate in an eccentric manner with respect to the rotating base carrier. The container carrier assembly also rotates with the base carrier rotation. The composite resulting motion includes shaking and tumbling components of the motion to mix the ingredients. The clamp has a first housing portion receiving the container, and a second housing portion movable with respect to the first portion to retain the container. A latch selectively retains the first and second housing portions together in a closed condition.

8 Claims, 68 Drawing Sheets

MIXER WITH SHAKING AND TUMBLING MOTION

CROSS REFERENCE TO RELATED APPLICATIONS

This application claims the benefit of U.S. Provisional Application No. 60/825,980 filed Sep. 18, 2006 and U.S. Provisional Application No. 60/888,896 filed Feb. 8, 2007, the entire contents of each of which are hereby expressly incorporated by reference.

BACKGROUND OF THE INVENTION

The present invention is in the field of mixers, particularly mixers to mix ingredients to achieve a desired characteristic, such as, but not limited to homogeneity, as would be desirable to achieve a consistent product characteristic such as, but not limited to, color. Typical applications include cosmetics, paint and similar coatings where tint and hue are important. Other applications are contemplated by the present invention, including, but not limited to inks, dyes, and medicines. In a number of applications, including cosmetic mixing applications, homogeneity of color is most often desired in the final product, but in some situations it may be found desirable to provide only partial mixing of ingredients. In the cosmetics applications, the ingredients are typically one or more base materials with one or more colorants. Ingredients may be liquids, slurries, suspensions, or solids (e.g., in powdered form) for mixing with one or more other ingredients to achieve a desired color or other characteristic (e.g., homogeneity of material viscosity) outcome in the final mixed product.

SUMMARY OF THE INVENTION

The present invention is a mixer to mix ingredients to achieve a desired outcome, which may, for example, be a homogeneous color or other characteristic of the mixture. The embodiments shown are specifically directed to mixing small quantities of ingredients to vend a small quantity of mixed product, for example, a retail sales container of a cosmetic or paint product. However, it is to be understood that the principles of the present invention (and even the embodiments shown for the mixer) may be suitable for mixing ingredients in larger containers, for example (but not by way of limitation), mixing paint in quart or even gallon or larger containers. Nevertheless, one application of the present mixer is to provide an ability to vend a custom blended product at a retail sales location after the ingredients are selected and dispensed into a container which is then mixed in the mixer of the present invention to provide a custom mixed product, such as a cosmetic or paint product.

The present invention achieves the mixing of ingredients by shaking and tumbling a container into which the ingredients have been dispensed, it being understood that the container may initially contain one or more base materials or ingredients into which other ingredients are dispensed, to achieve a desired material property (such as color) once the base ingredients and additive ingredients are mixed together.

The mixer of the present invention achieves its mixing effect by combining at least two motions, one orbital and one eccentric, combined to produce a composite oscillating and rotating (or "shaking" and "tumbling") movement of the container to mix the contents. The mixer of the present invention is illustrated using several embodiments, each of which operate at a fixed, predetermined speed and ratio between the motions, but it is to be understood to be within the scope of the present invention to vary either or both of the speeds of the two motions making up the composite motion of the present invention.

The present invention also includes various approaches to securing a container to the mixer during the mixing operation. The container may be selected from among various sized containers and variously shaped containers. In one aspect, a single clamp (or holder) may be used to secure one of the various sized or shaped containers, while in another aspect, more than one clamp (or holder) may be attached to the mixer to accept the selected container for mixing.

In yet another aspect the present invention includes a resilient mounting arrangement for accommodating various misalignments in the mixing assembly.

DETAILED DESCRIPTION

Figure 1:
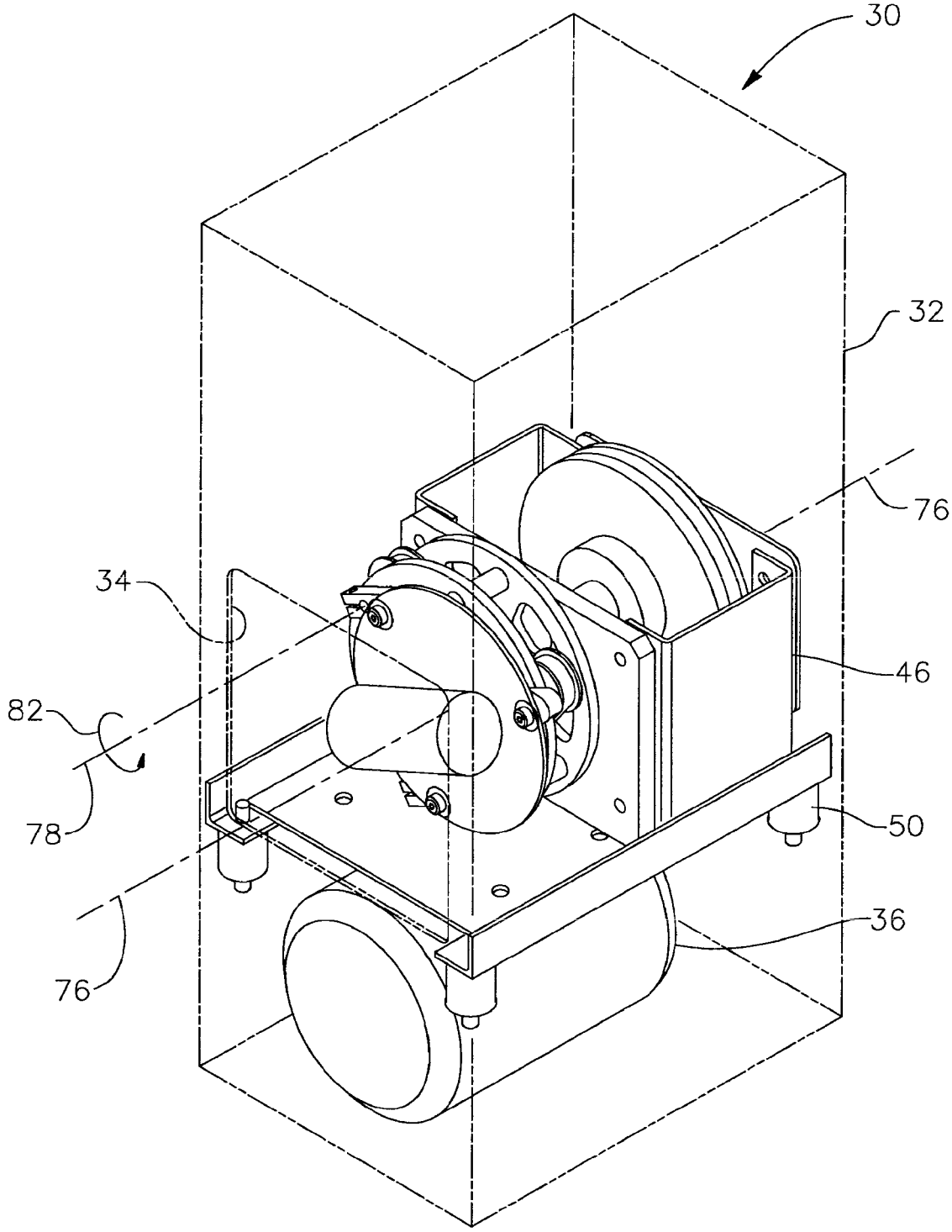
FIG. 1 is a perspective view of a simplified mechanical drawing of a mixer illustrating a first embodiment of the present invention, and with a container with ingredients to be mixed shown positioned relative to the mixer.

Referring now to the Figures, and most particularly to FIG. 1, a mixer 30 according to the present invention may be seen. The mixer 30 may be contained within an enclosure 32, as is conventional for appearance and safety. Enclosure 32 may have an access aperture 34 with a door (not shown) which may have a conventional interlock (not shown) to prevent operation of the mixer 30 when the door is open. Mixer 30 is preferably driven by an electric motor 36, which may be a DC, AC, Universal, or other type.

Figure 2:
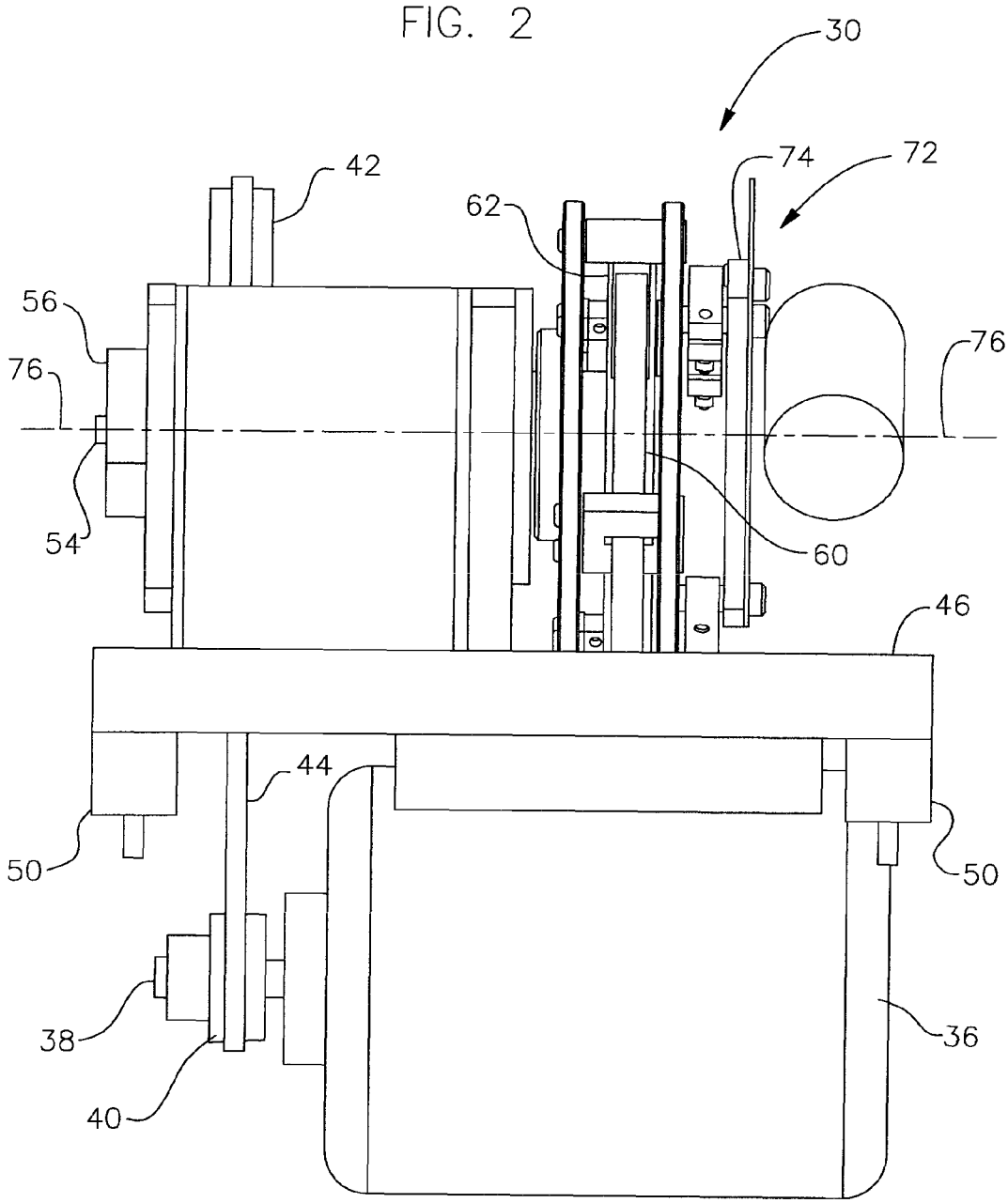
FIG. 2 is a side elevation view of the mixer of FIG. 1 without an enclosure.
Figure 3:
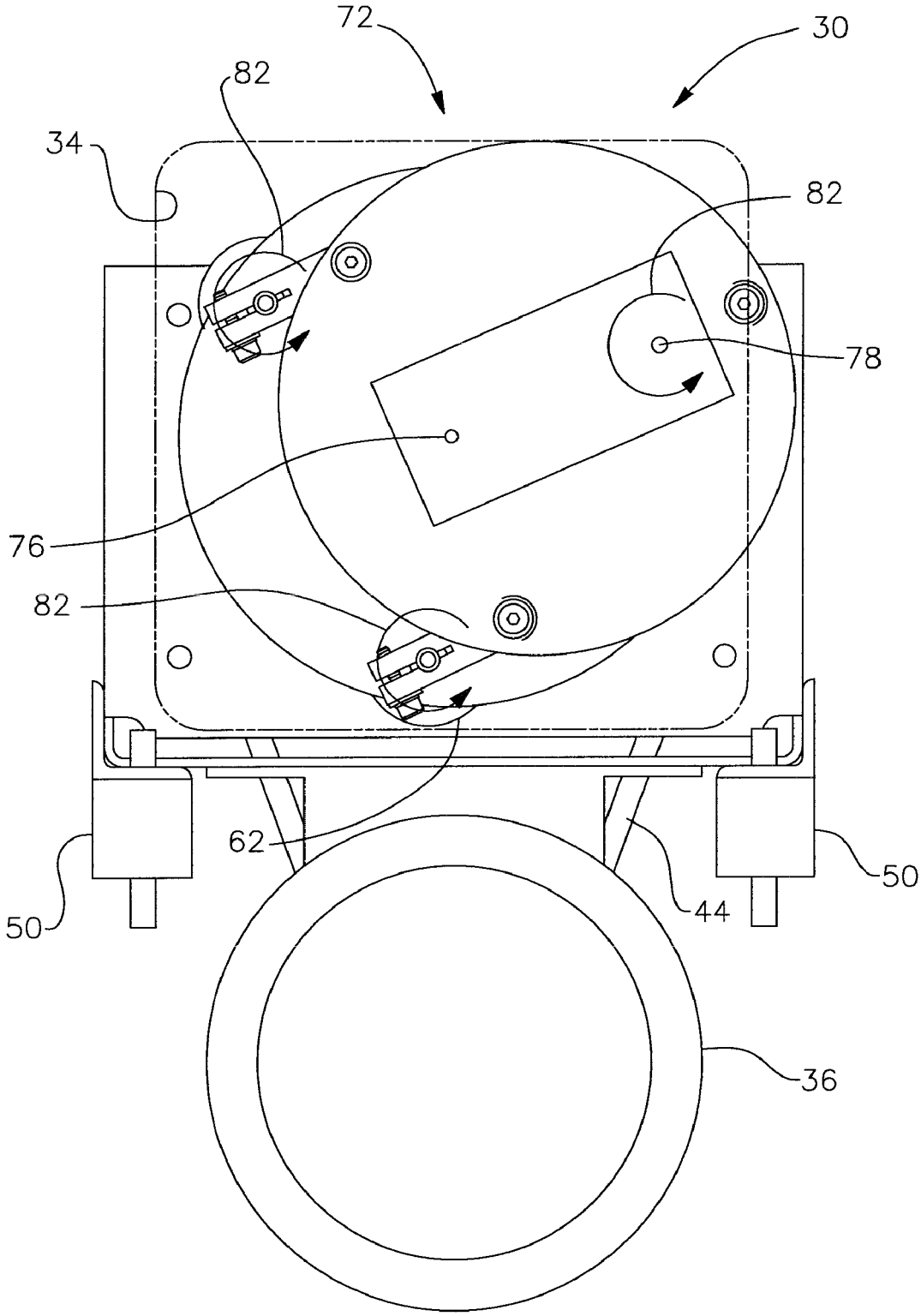
FIG. 3 is a front elevation view of the mixer of FIG. 1 with the enclosure aperture for operator access shown in outline.
Figure 4:
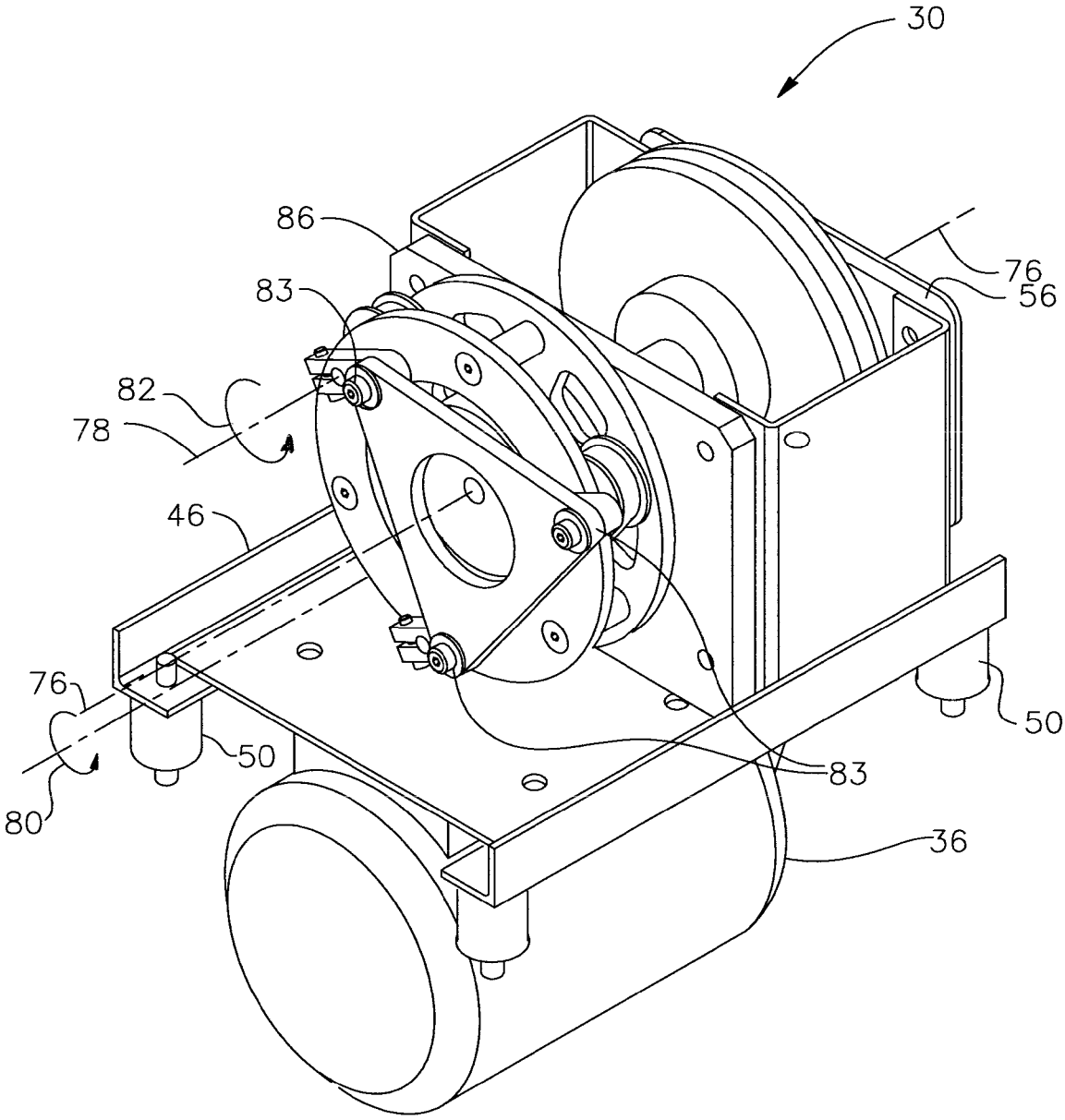
FIG. 4 is a perspective view of the mixer of FIG. 1, except with a clamp plate assembly removed to show more details of this embodiment of the present invention.
Figure 5:
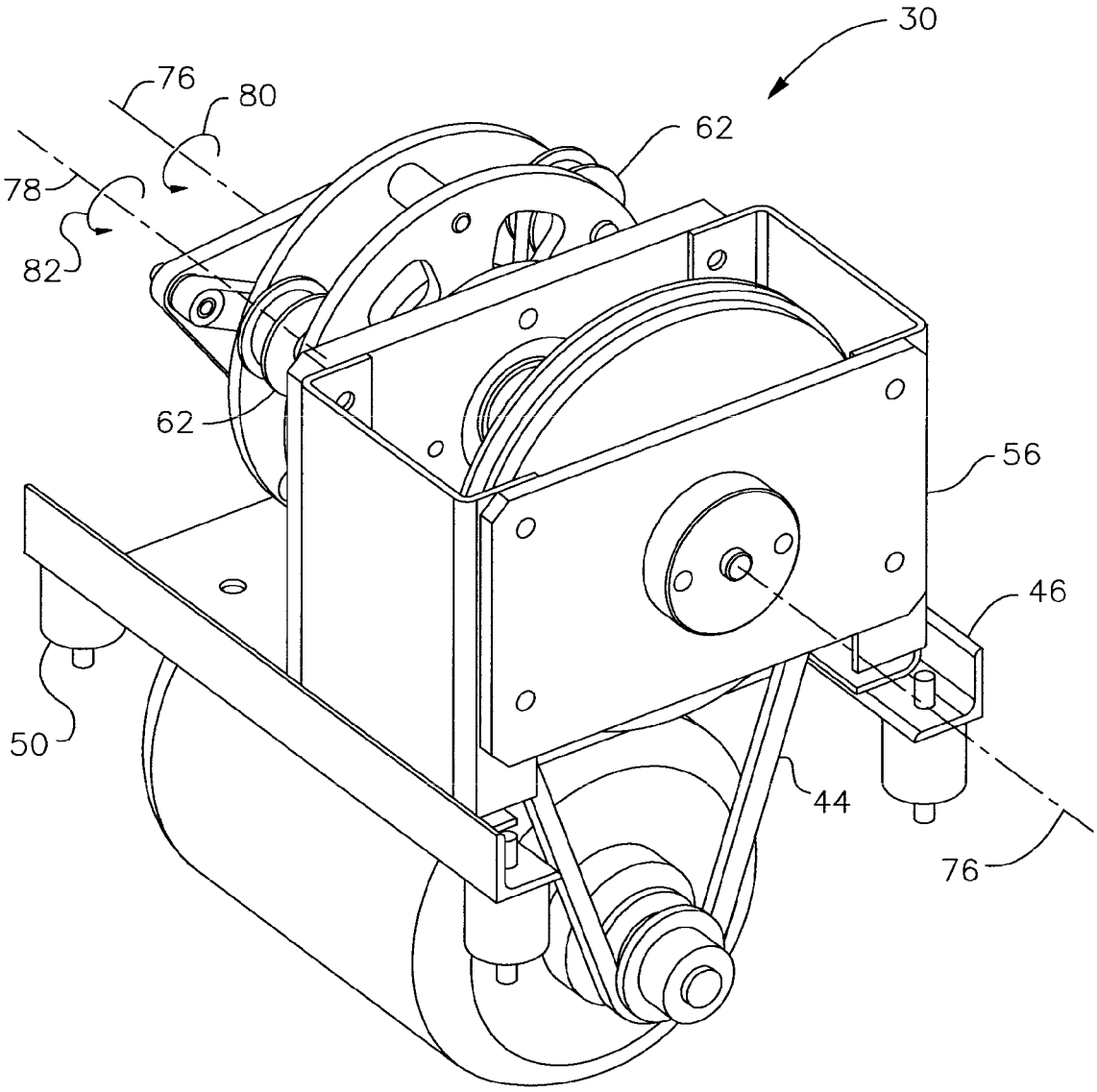
FIG. 5 is a rear perspective view of the mixer of FIG. 4.

Referring now also to FIG. 2, motor 36 has an output shaft 38 and pulley 40 driving a driven pulley 42 via a conventional drive belt 44. It is to be understood that the arrangement of belt and pulleys may be altered to accommodate differing frequencies of electrical mains using the same motor, if desired. Alternatively, other drive means may be used in place of pulleys 40 and 42 and belt 44. For example, and not by way of limitation, gears may be used. Operation of the motor 36 and mixer 30 may be operated by electrical and/or electronic control circuits, as desired, which may be conventional control circuits for mixers, and may include one or more timers, if desired, to control the length of time the mixer 30 performs the mixing motion in response to an operator startup command. It is within the scope of the present invention to provide an alternative mounting for the motor, where the motor extends out from under the mixer.

Referring now also to FIGS. 3-9, in the embodiment shown therein, mixer 30 preferably includes a frame 46 carrying drive shaft 48 on which driven pulley 42 is mounted. A plurality of isolation mounts 50 may secure frame 46 to an outer housing (not shown) or the enclosure 32. It is to be understood that other forms of vibration isolation may be utilized with the present invention. Drive shaft 48 is rigidly secured to a base carrier 52, both of which are mounted for rotation with respect to frame 46. A core shaft 54 is secured to frame 46 by a plate 56, and more specifically a collar 57 secured to plate 56, which prevents rotation of core shaft 54 with drive shaft 48. Stationary core shaft 54 extends through drive shaft 48 and carries a stationary sun pulley 58. An endless belt 60 extends around at least one and preferably a plurality of planet pulleys 62 and is in contact with sun pulley 58. In the embodiment shown, three planet pulleys are shown, but the present invention contemplates that other numbers of pulleys may be used. Each planet pulley 62 is secured to a crank arm drive shaft 64, which may be seen most clearly in FIG. 8. Each crank arm drive shaft is secured to a crank arm 66, shown most clearly in FIG. 7. The shaft 64 and arm 66 together form at least a part of a drive member connecting the base carrier 52 to a container carrier assembly 72. Each crank arm will rotate with its respective planet pulley in response to relative movement between the endless belt and pulleys 62. A pair of plates 68, 70 support the planet pulleys 62. Alternatively, only one plate may be used to support the planetating members. Plates 68, 70 are secured to drive shaft 48 and rotate therewith. The container carrier assembly 72 may include a carrier support plate 74 (rotatably) secured to at least one, and preferably three crank arms 66 by pivots 83 such that the crank arms 66 will move the plate 74 and assembly 72 in a path orbiting a secondary axis 78 when pulley or pulleys 62 rotate. The plates 68, 70 and drive shaft 48 may form part of the base carrier 52. The base carrier 52 rotates about a primary axis 76. Each crank arm drive shaft 64 rotates about its own secondary axis 78 parallel to and offset from the primary axis 76. Rotation about the primary axis is indicated by arrow 80, and rotation about the secondary axis 78 is indicated by arrow 82. The orbit of the container carrier assembly 72 with respect to the base carrier is indicated by arrow 82, it being understood that each secondary axis 78 will also orbit around the primary axis 76 as the base carrier 52 rotates.

Figure 6:
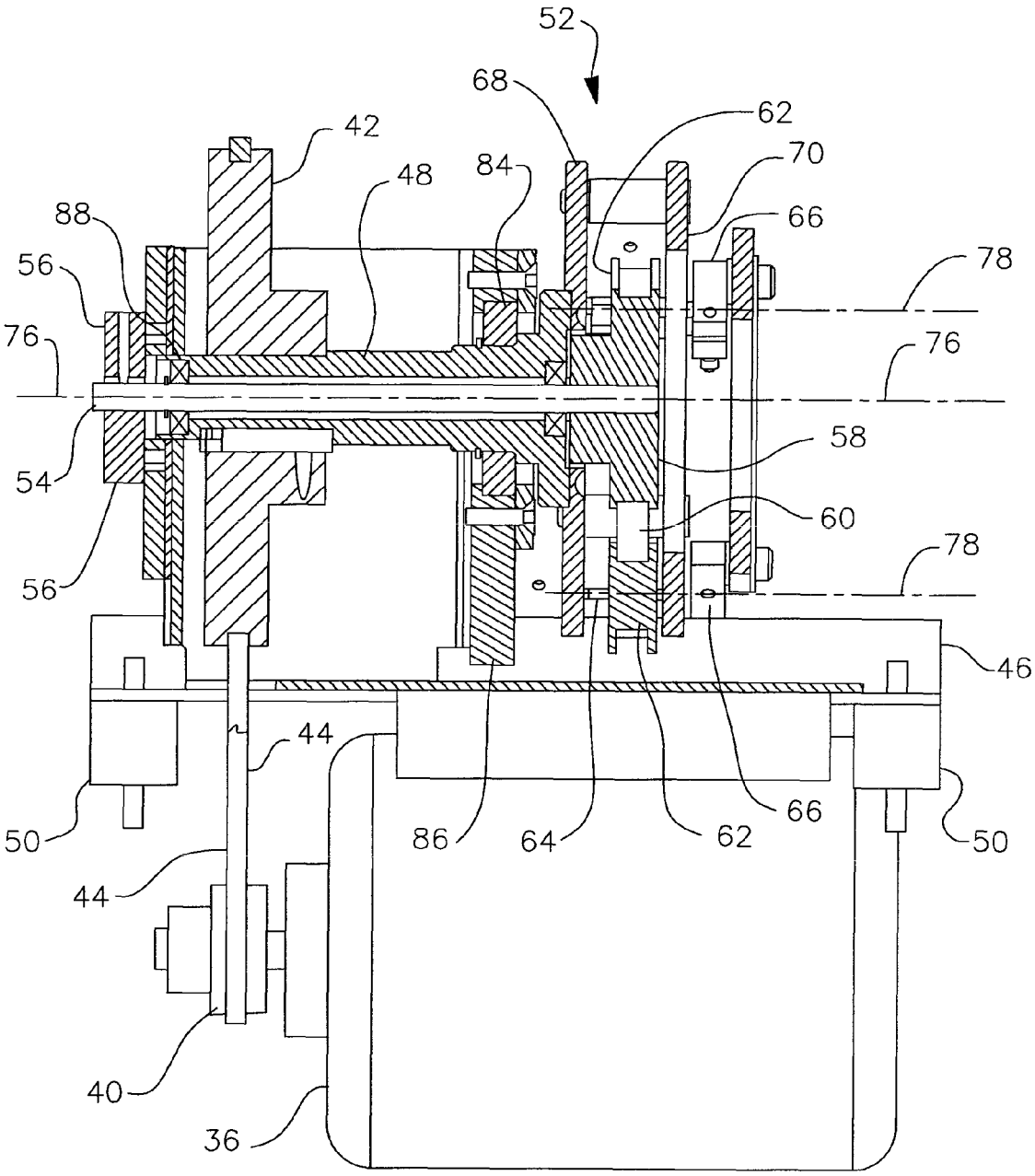
FIG. 6 is a side section view of the mixer of FIG. 4.
Figure 7:
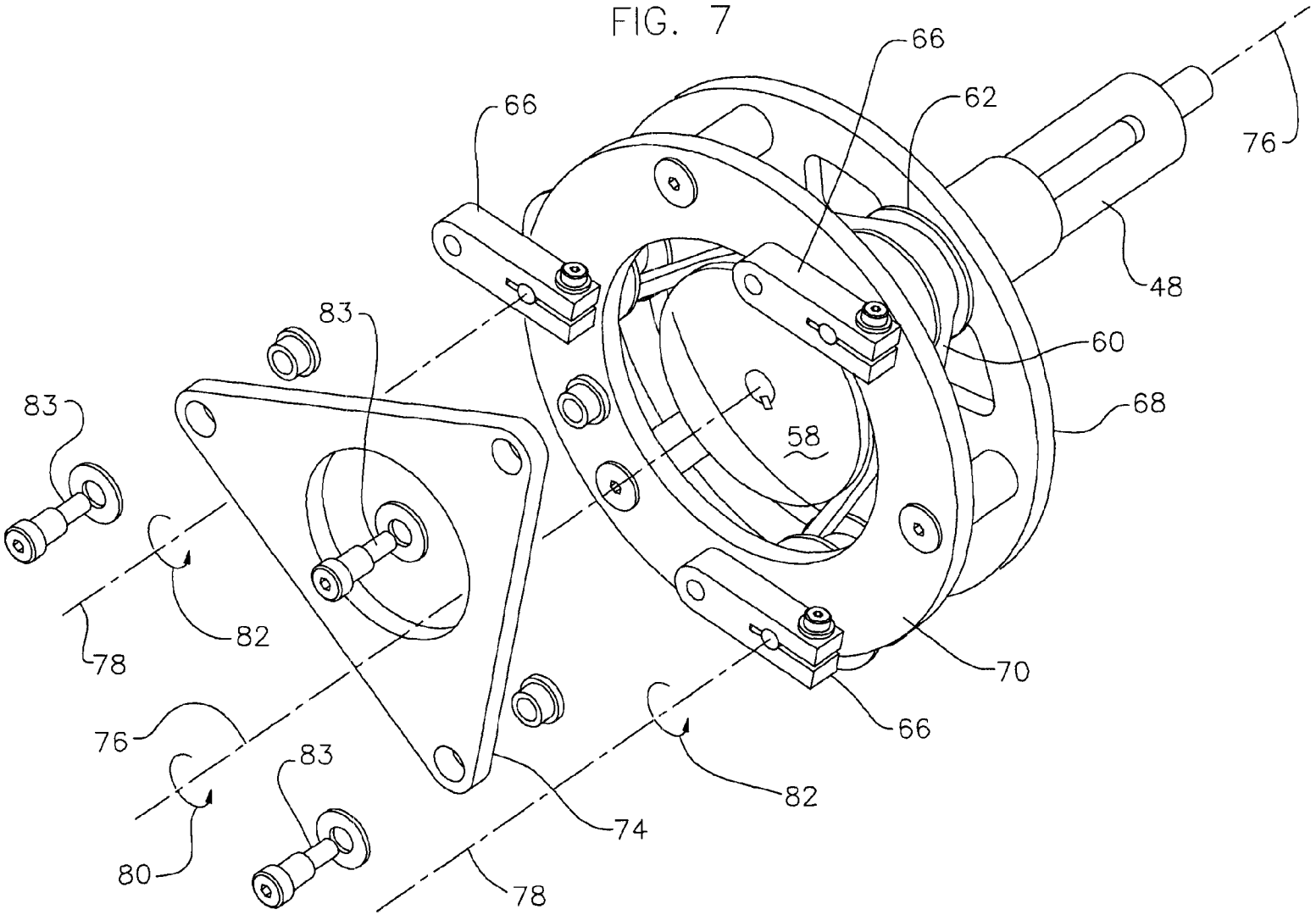
FIG. 7 is a partially exploded view of a subassembly of the mixer of FIG. 4 to illustrate certain details of the present invention.
Figure 8:
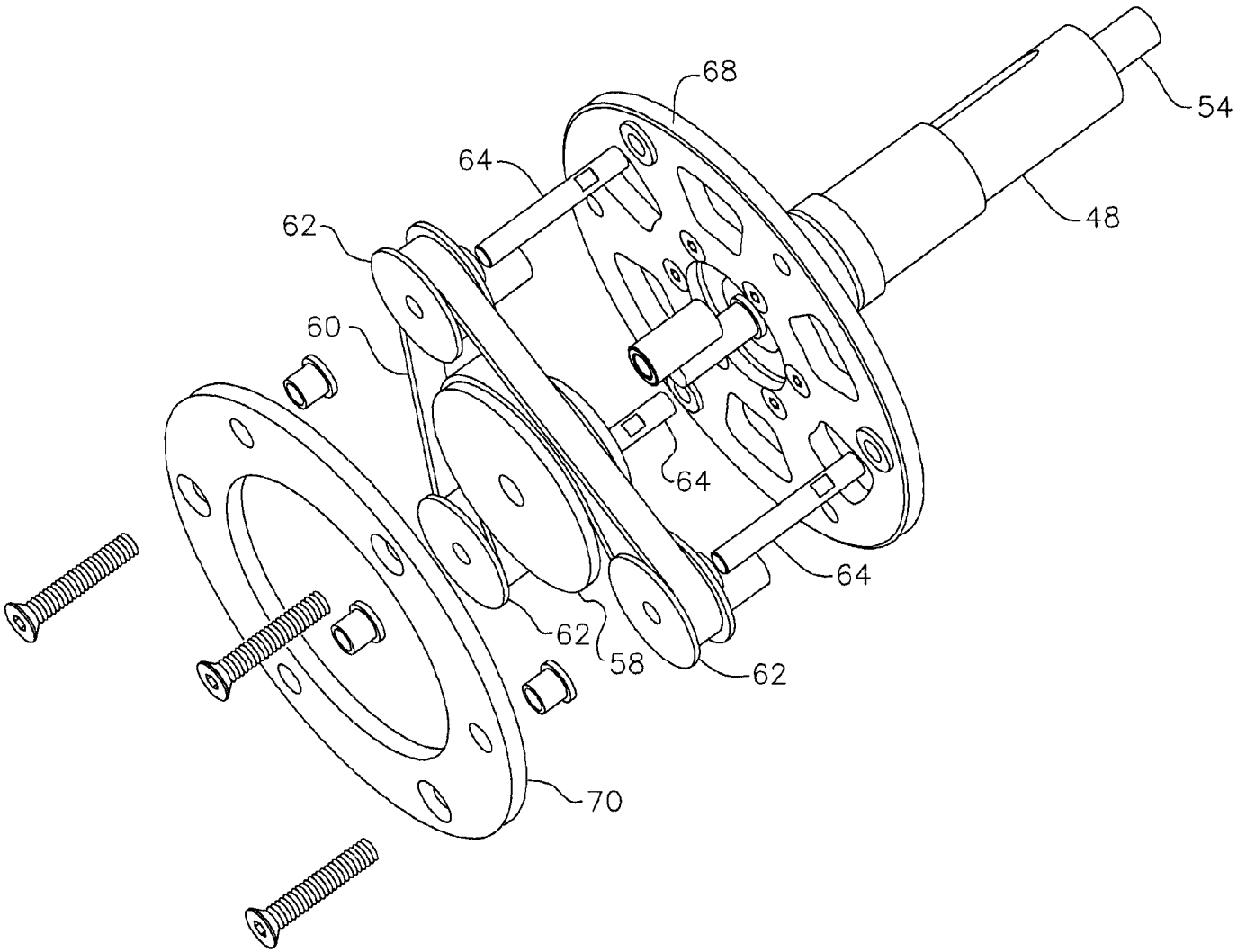
FIG. 8 is a further exploded view of parts from the subassembly of FIG. 7 to illustrate further details of the present invention.
Figure 9:
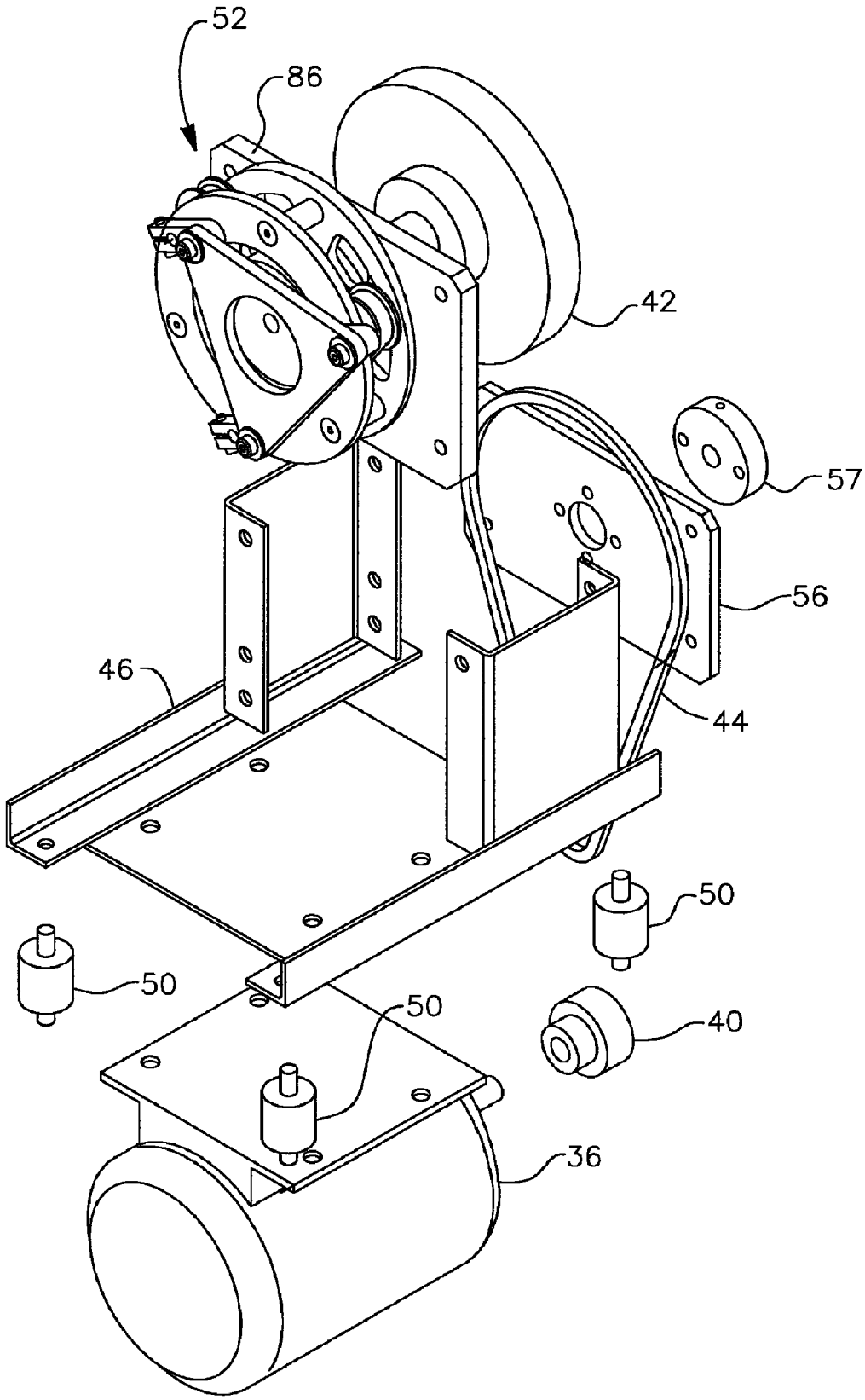
FIG. 9 is another partially exploded view of the mixer of the present invention to illustrate further details thereof.

Referring now most particularly to FIGS. 6 and 9, the base carrier 52 may be supported by a main bearing 84 in a base carrier support plate 86. An auxiliary bearing 88 may be used to support drive shaft 48 in plate 56.

Figure 10:
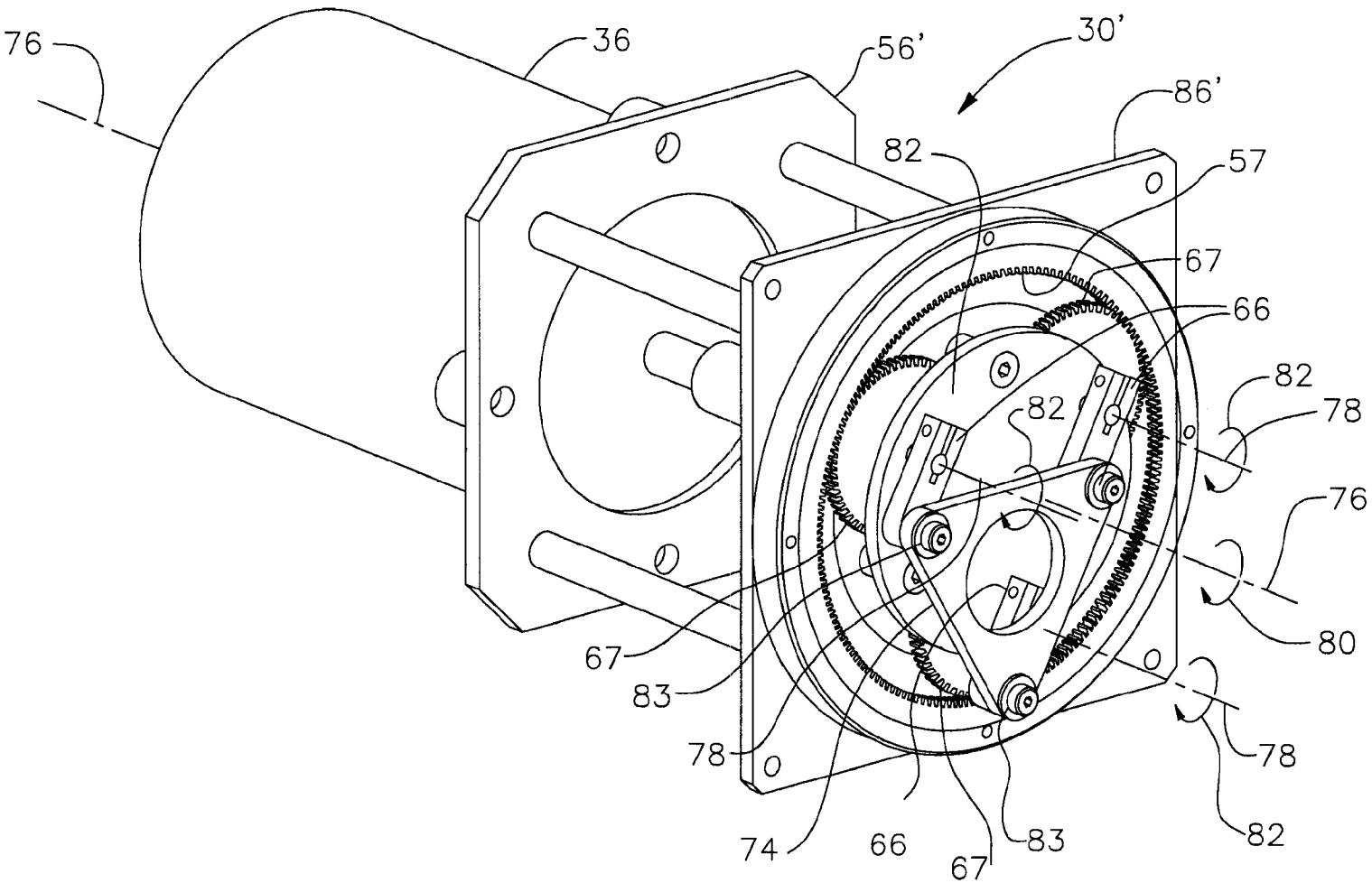
FIG. 10 is a perspective view of another embodiment of the present invention using gearing instead of belts and pulleys to obtain the composite motion.
Figure 11:
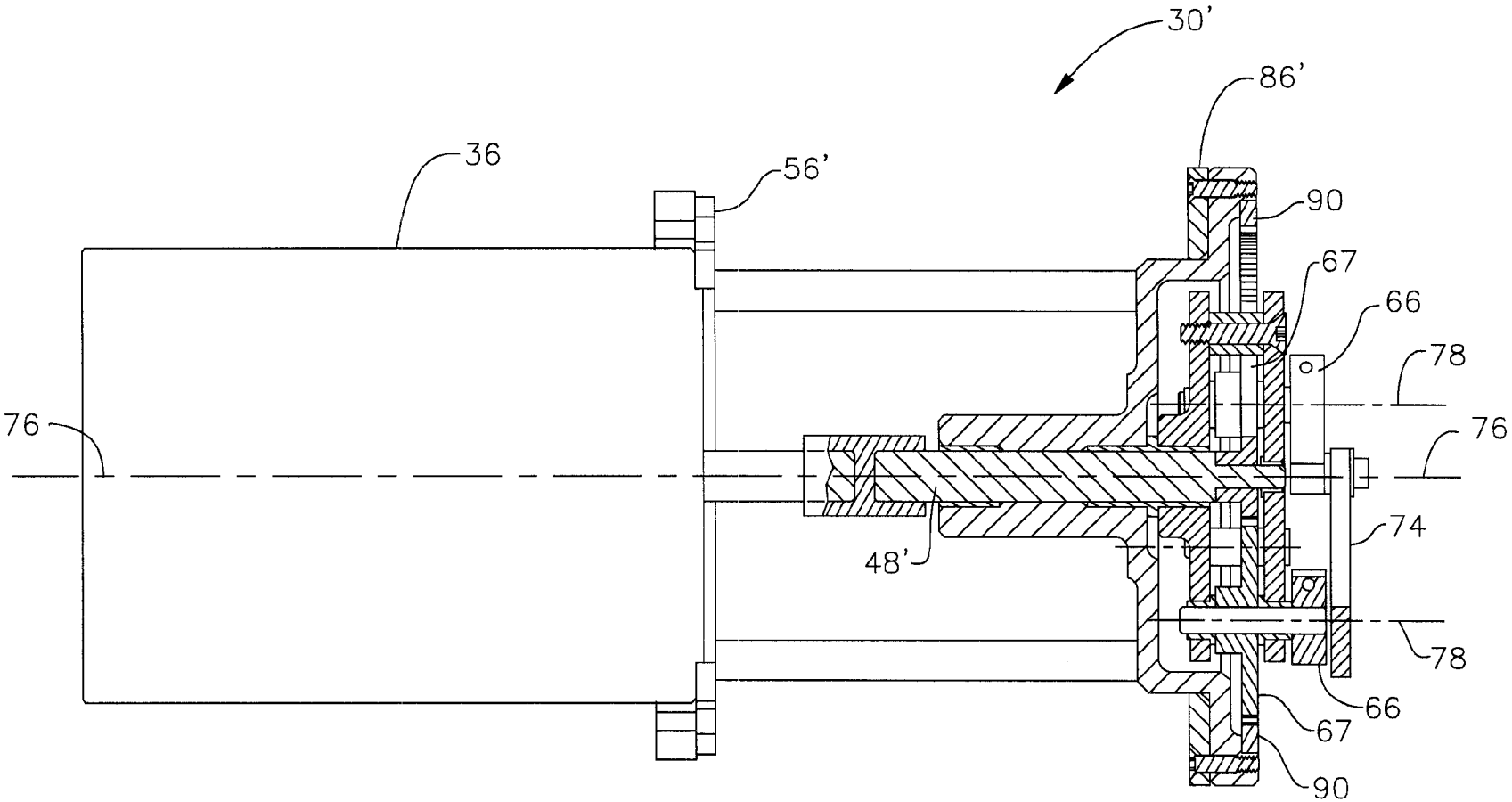
FIG. 11 is a side elevation view partly in section of the embodiment shown in FIG. 10.
Figure 12:
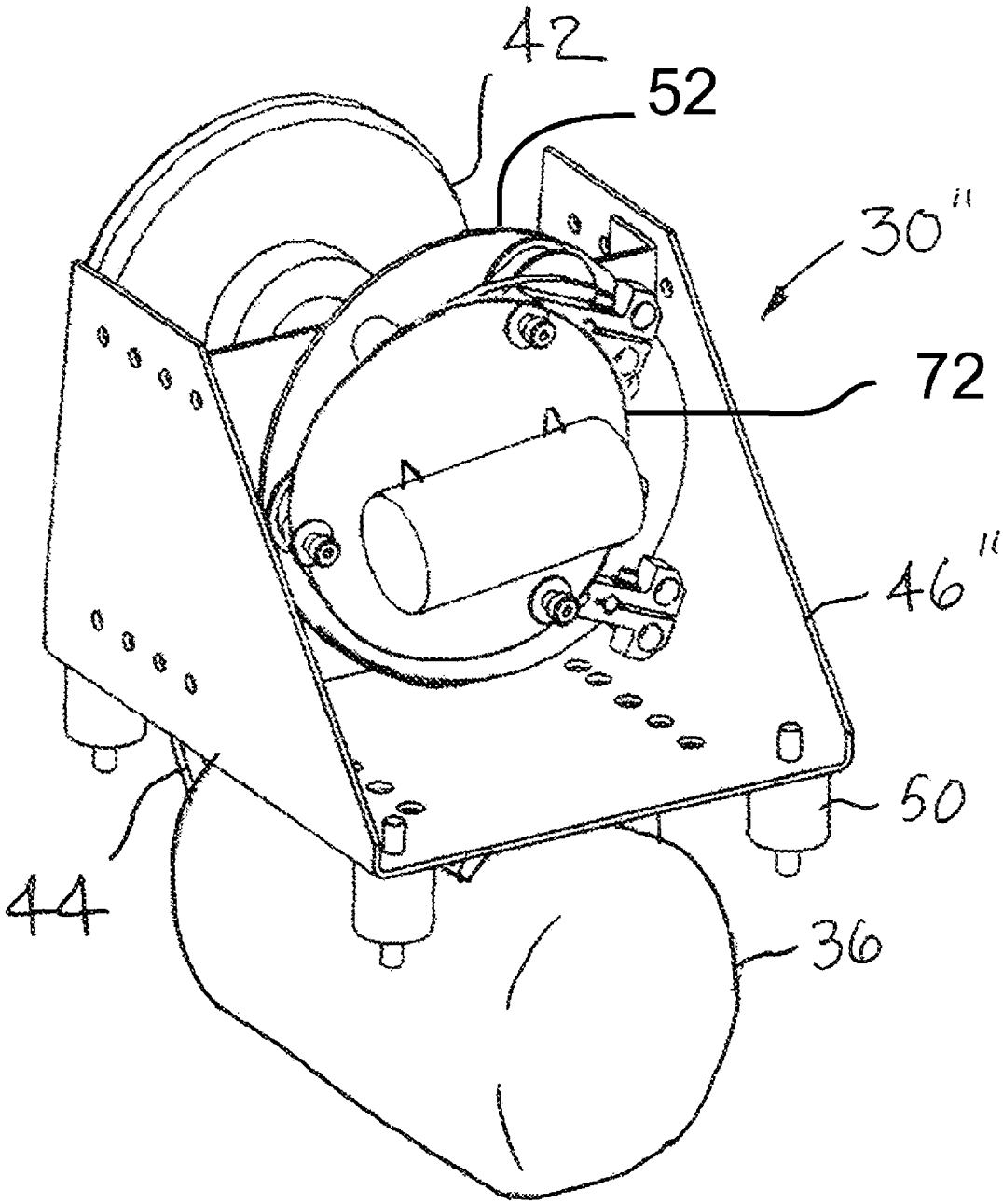
FIG. 12 is a perspective view from the front and above of another embodiment of the mixer of the present invention.
Figure 13:
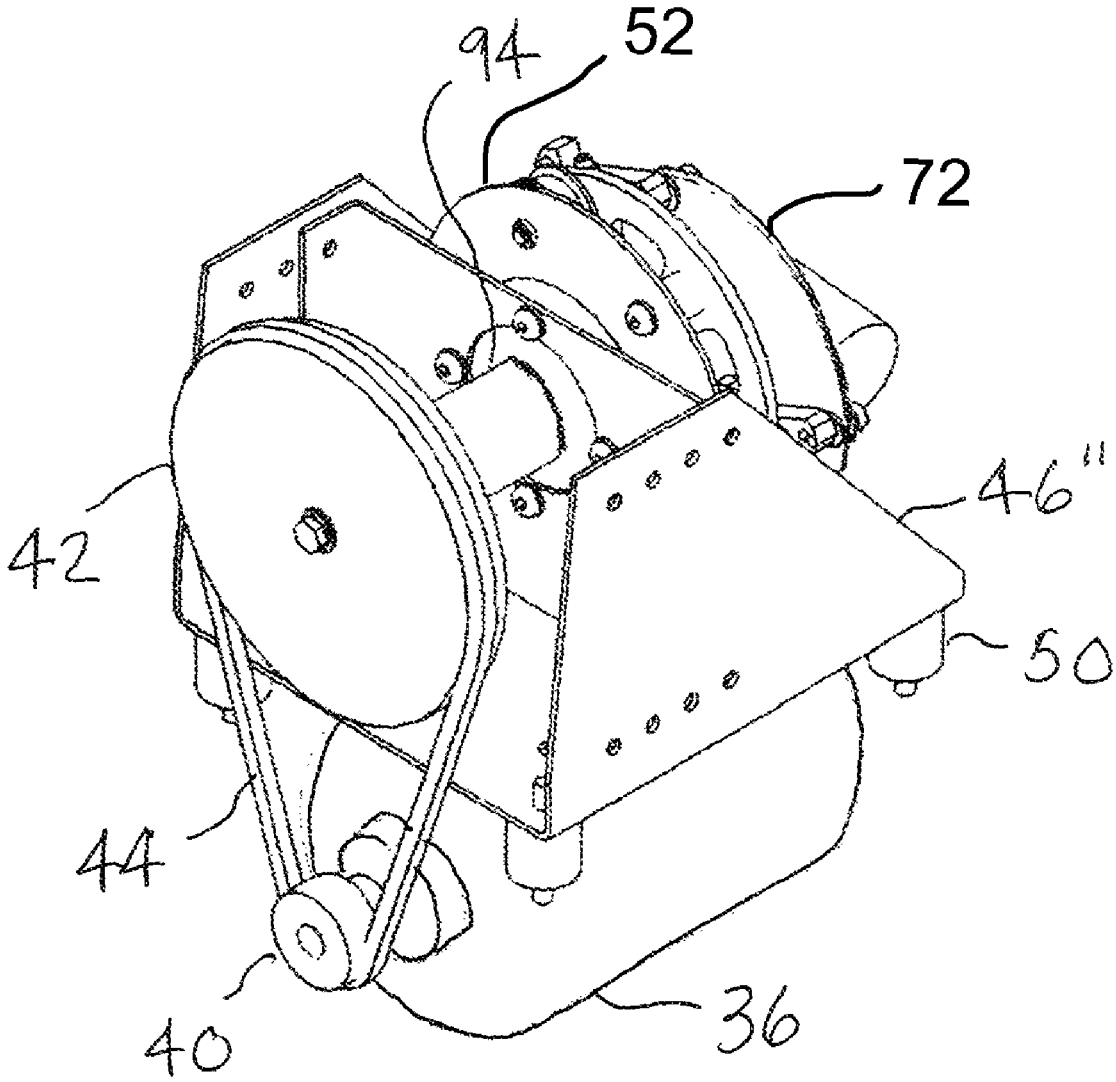
FIG. 13 is a perspective view from the rear and above of the mixer of FIG. 12.
Figure 14:
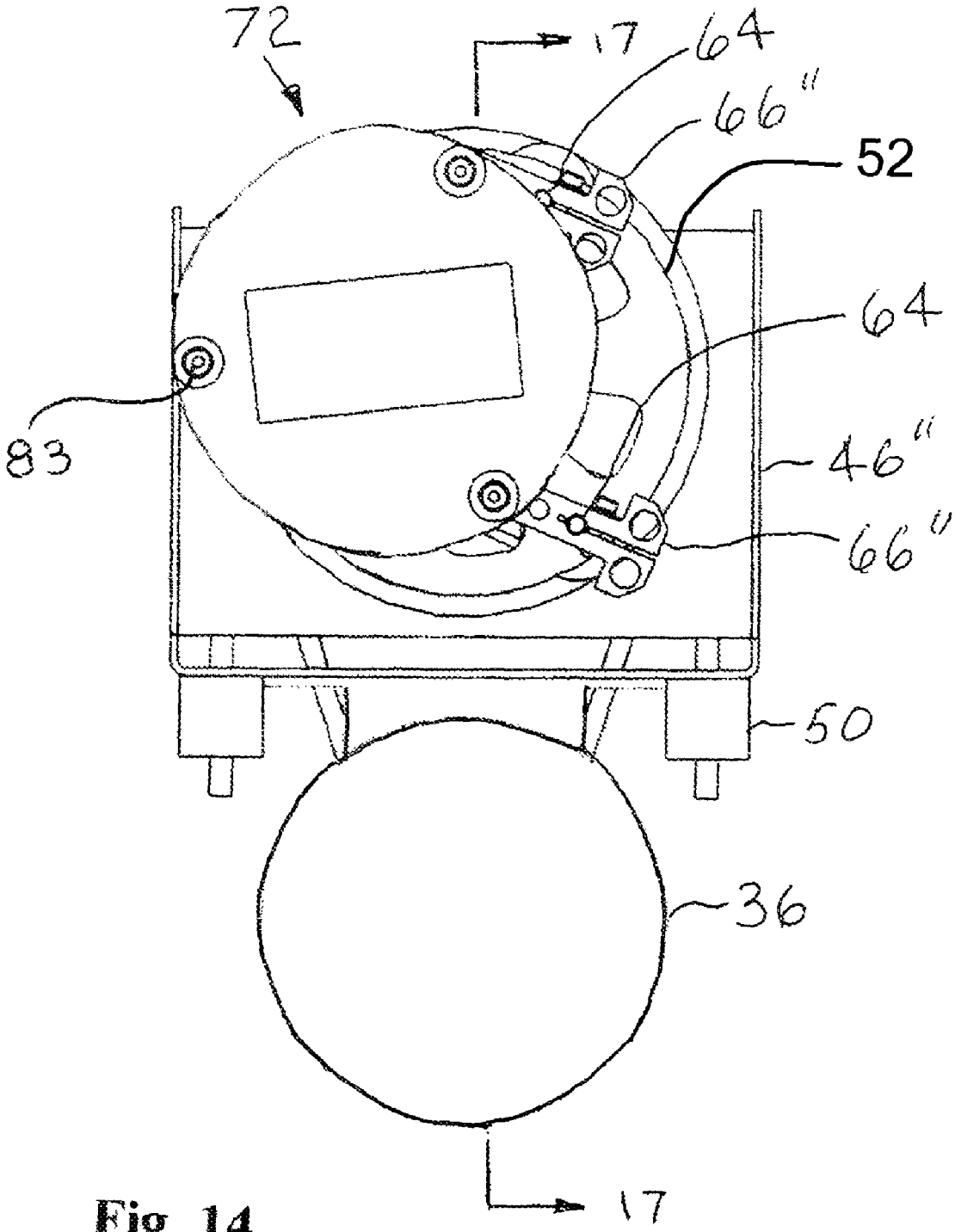
FIG. 14 is a front elevation view of the mixer of FIG. 12.
Figure 15:
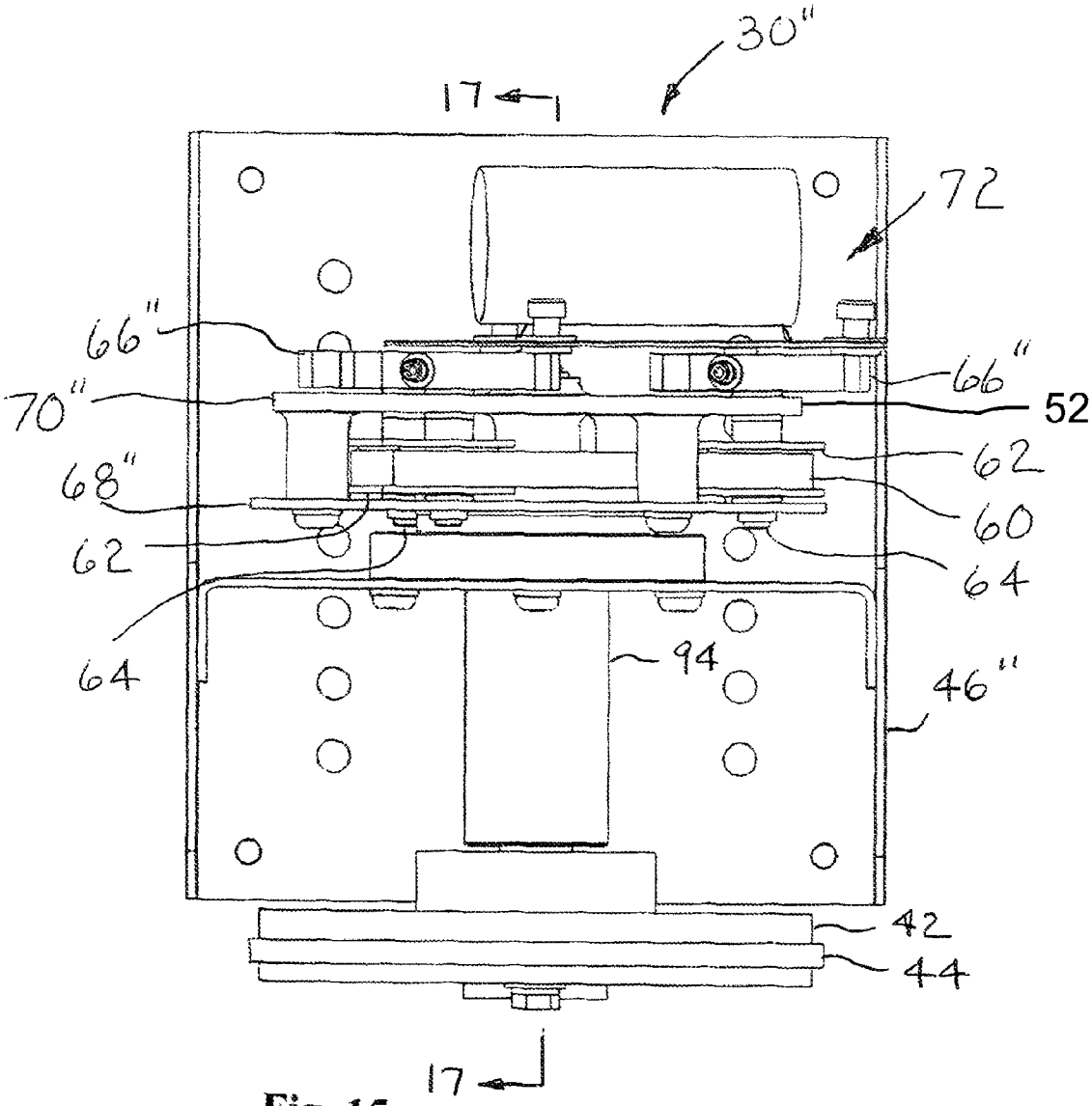
FIG. 15 is a top plan view of the mixer of FIG. 12.
Figure 16:
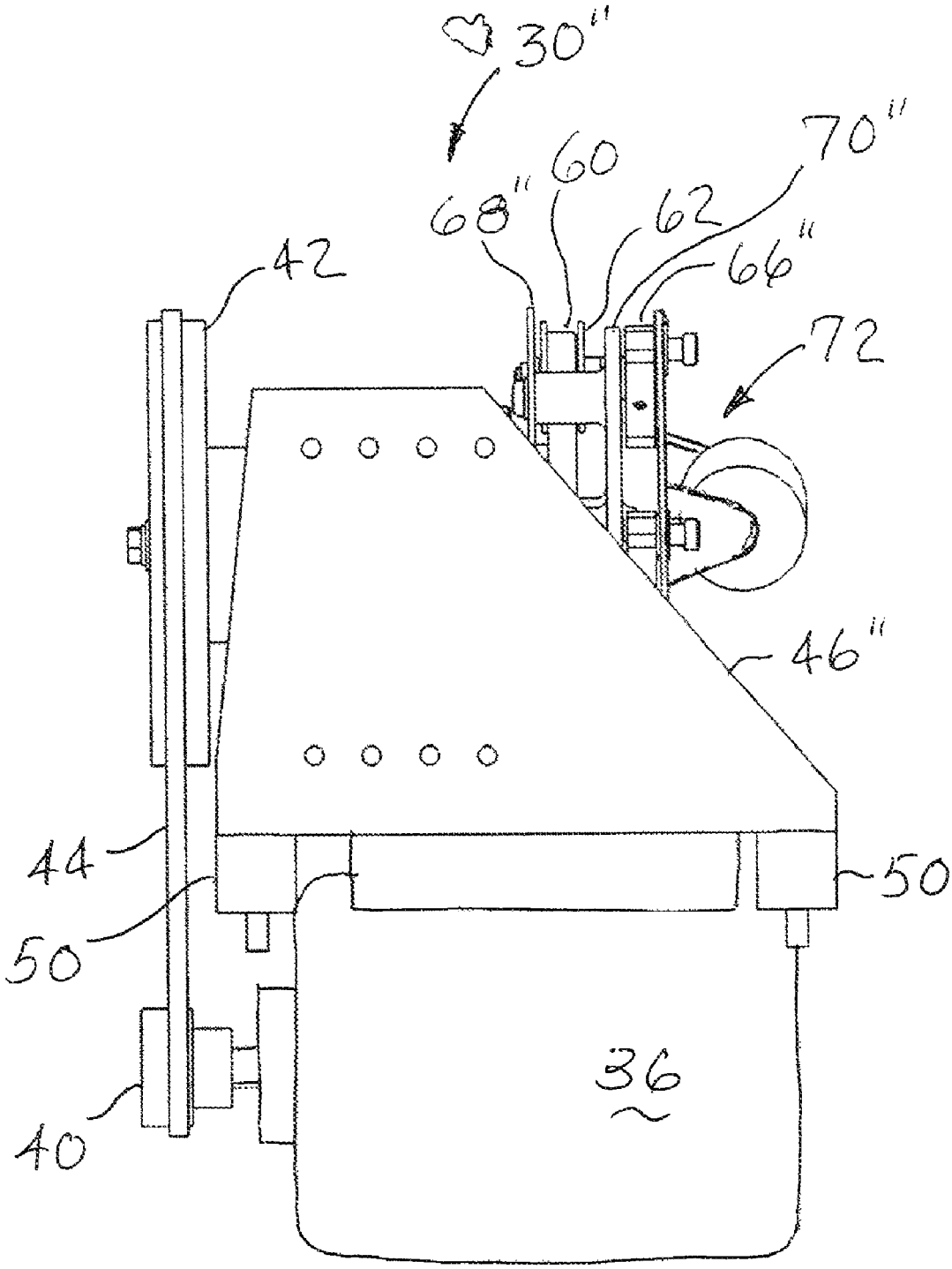
FIG. 16 is a side elevation view of the mixer of FIG. 12.
Figure 17:
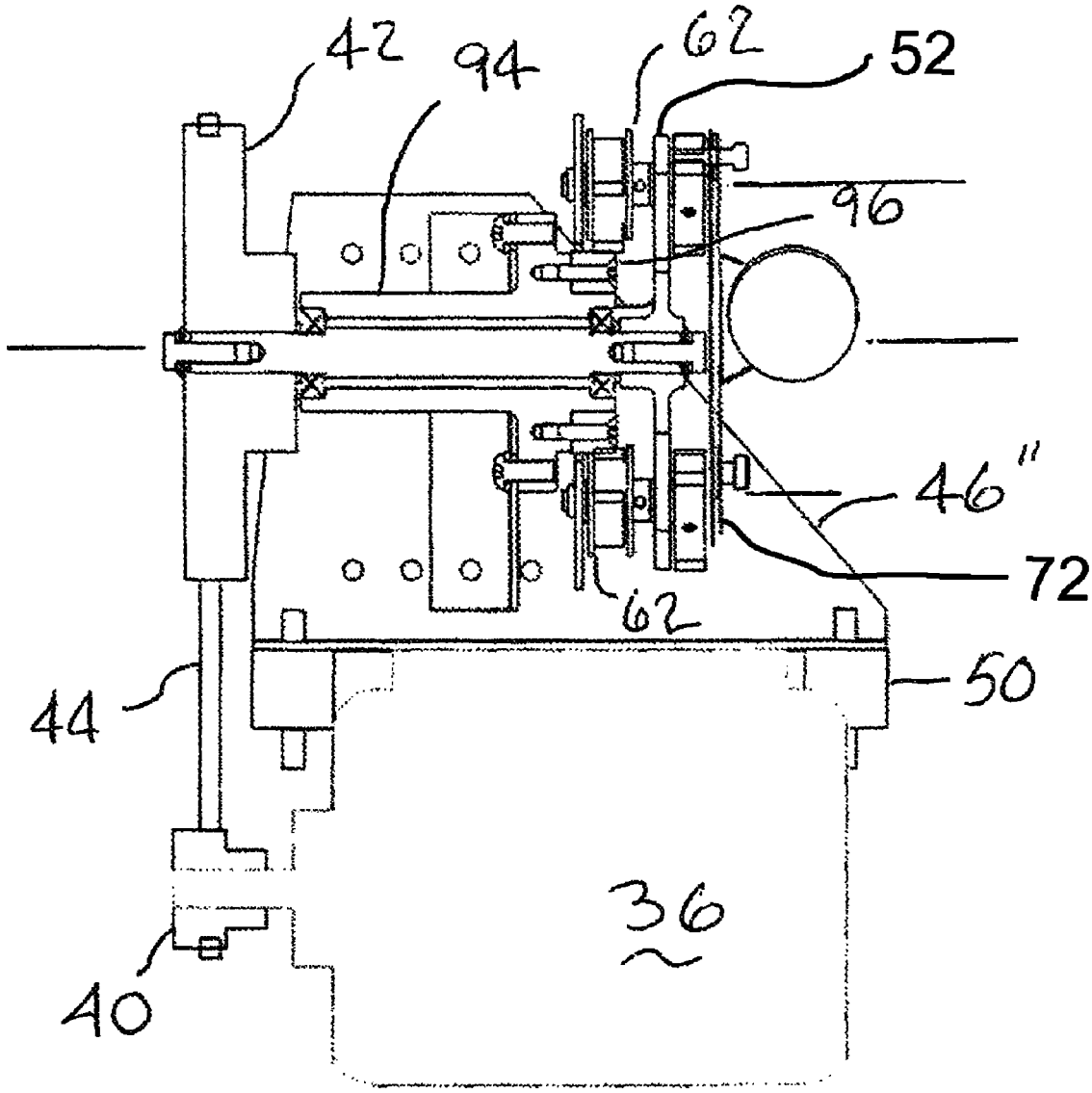
FIG. 17 is view similar to that shown in FIG. 16, except with certain parts of the mixer shown in section taken along line 17-17 in FIG. 15.

Referring now to FIGS. 10 and 11, a second embodiment of the present invention may be seen. In this embodiment, like parts are identified with the same reference numerals as in the first embodiment described supra, and similar items are identified with "primed" reference numerals. For example the second embodiment illustrates mixer 30'. A stationary ring gear 90 engages at least one and preferably three planet gears 67. Each planet gear 67 is secured to a crank arm drive shaft 64 and will rotate the shaft 64 and crank arm 66 (together making up at least a part of the drive member) to which it is attached. Each crank arm is also (rotatably) coupled to the carrier support plate 74. In this embodiment, each crank arm is shaped to have one or more recesses capable of receiving material plugs of more dense material than the material of the crank arm itself, to aid in counterbalancing the load driven by the crank arms. In the present invention, the load driven by the crank arms is made up of a container carrier assembly 72. The material of the crank arms may be any suitable material, such as aluminum or a molded polymer. The material plugs for the crank arms may be steel, for example. In this embodiment, the ring gear 90 is stationary and causes the planet gears 67 to both rotate about their own (secondary) axes 78 and orbit about the primary axis 76 when the drive shaft 48' is rotated, rotating base carrier 52. Rotation of the planet gears 67 causes oscillating motion of the container carrier assembly 72, since it moves with movement of the carrier support plate 74. It is to be understood that the same mixing motion may be achieved by each of the various embodiments shown herein. As with the belt and pulley version, it is to be understood that the geared planetating version may use one planetating gear, or it may use a plurality of planetating gears, (along with an appropriate number of associated parts) even though the embodiment shown uses three planetating gears 67 and three crank arms 66 and three pivots 83.

An alternative embodiment of the present invention is to replace the ring gear 90 with a sun gear (not shown), with the sun gear engaging the planet gears 67.

Another alternative embodiment of the present invention is to replace the planet gears with planetary members having a friction interface with a ring or sun member.

Referring now to FIGS. 12-17, a further alternative embodiment of the present invention may be seen. In this embodiment mixer 30" has some parts identical to the mixer 30 shown in FIGS. 2-6. Mixer 30" also has some parts altered in form (indicated by double prime designations) but not in function. For example, the frame 46" has been simplified from frame 46. Finally, in mixer 30" some parts have been eliminated, for example, plate 56 has been eliminated, along with core shaft 54 and collar 57. Plate 86 has been replaced by a drive shaft support housing 94. Housing 94 has an enlarged hub 96 in plane with the planet pulleys 62 and performs the function of stationary sun gear 58. In operation, belt 60 is in contact with the enlarged hub 96 to cause planet pulleys 62 to both rotate about their secondary axes 78 and to orbit or planetate about the primary axis 76 via base carrier 52. When the planet pulleys rotate and orbit, the drive members (more specifically, the crank arms) drive the container carrier assembly in a shaking and tumbling mixing motion.

Figure 18:
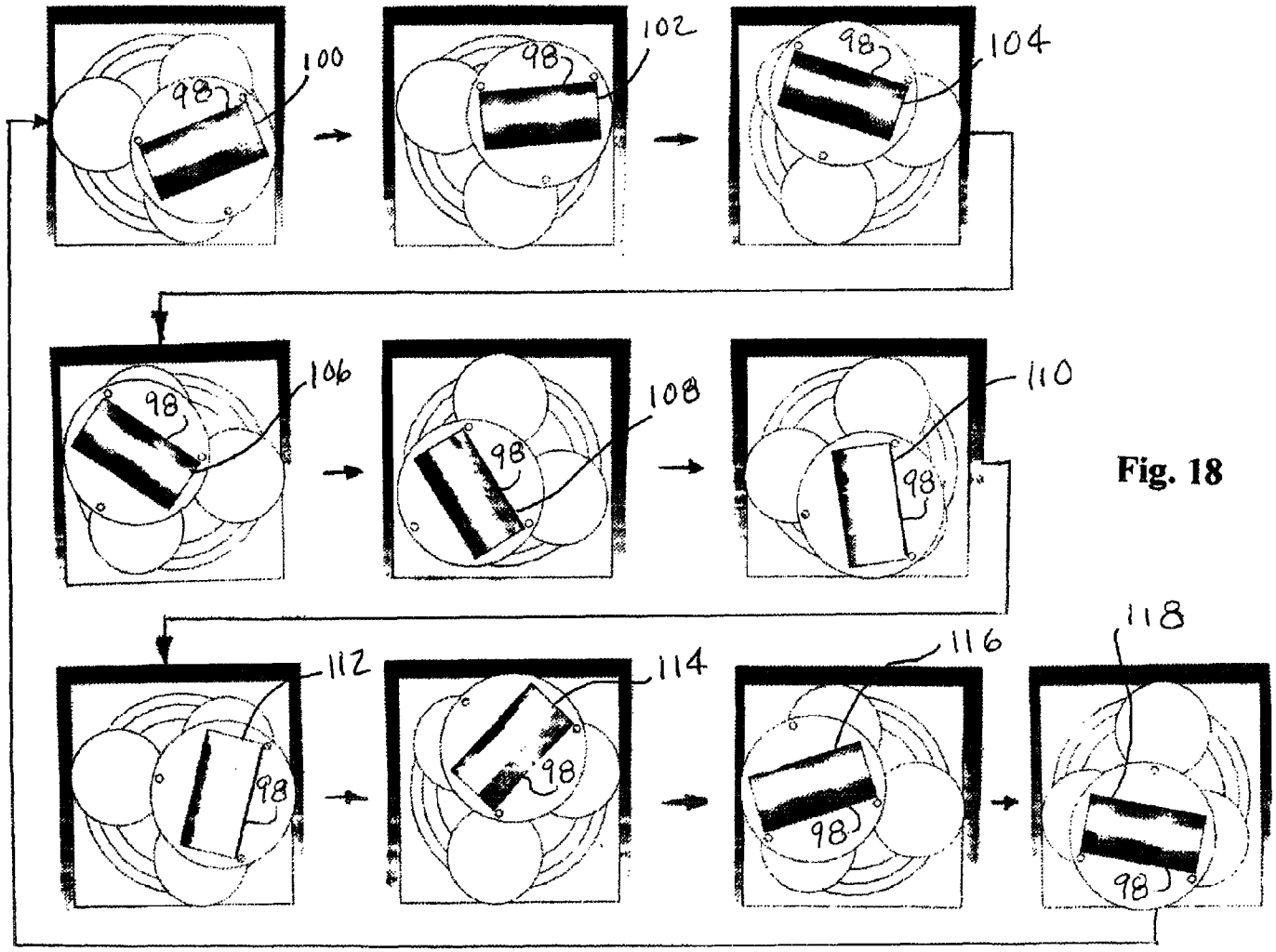
FIG. 18 is a diagrammatic representation of one form of mixing motion of the present invention, shown in a series of images.

Referring now to FIG. 18, a series of images are presented as a diagrammatic representation of one form of mixing motion useful in the practice of the present invention. The representation in FIG. 18 is intended to convey certain aspects of the mixing motion, including the shaking and tumbling aspects of a container holder 98 during the mixing motion illustrated. When the mixer is operating, the container holder 98 will move through the successive positions 100-118 and repeat this motion over and over until the mixer is stopped. This mixing motion includes both shaking and tumbling components.

Figure 19:
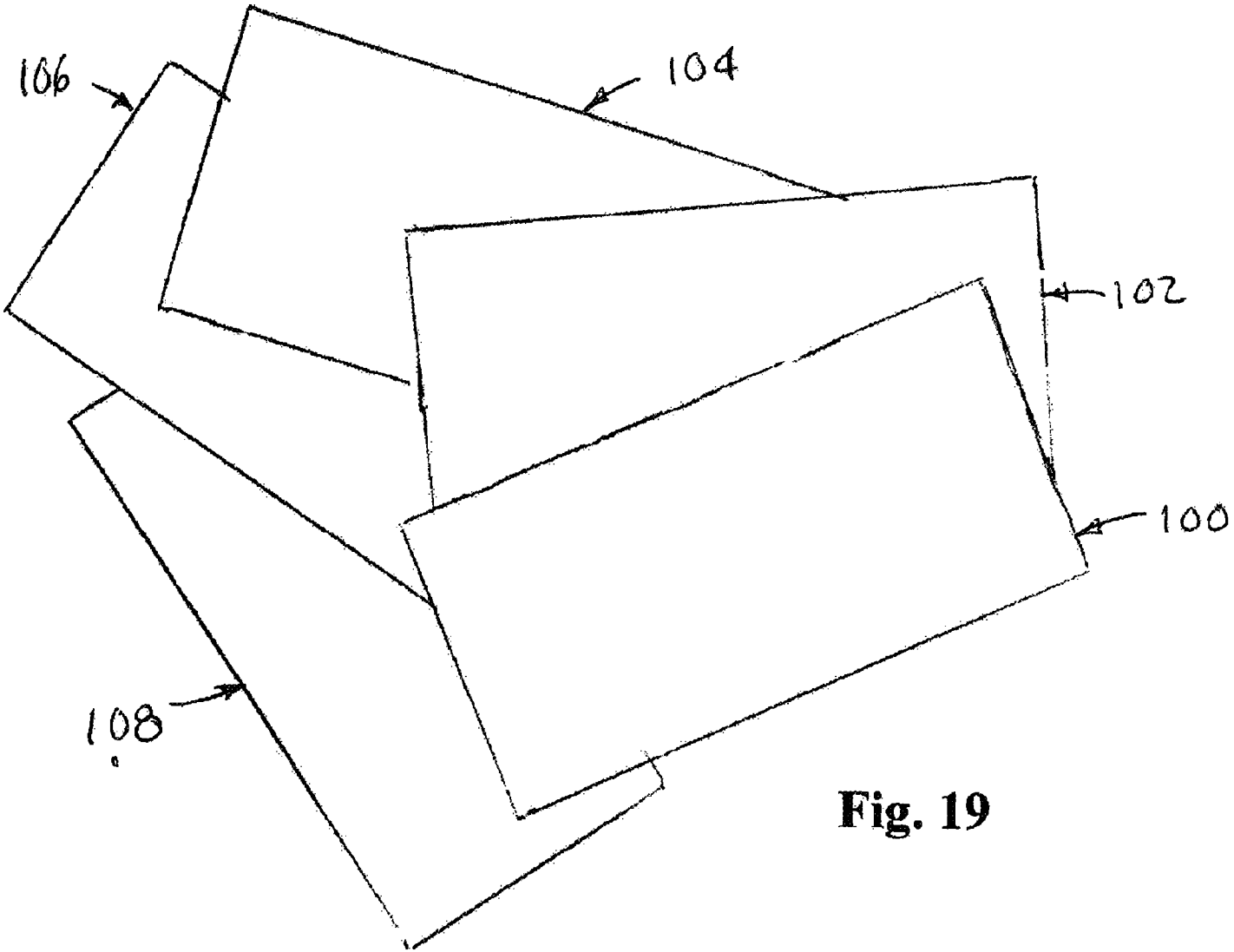
FIG. 19 is a simplified schematic representation of the relative angular orientation of a container holder to illustrate the tumbling aspect of mixing motion shown in the first five images of FIG. 18.
Figure 20:
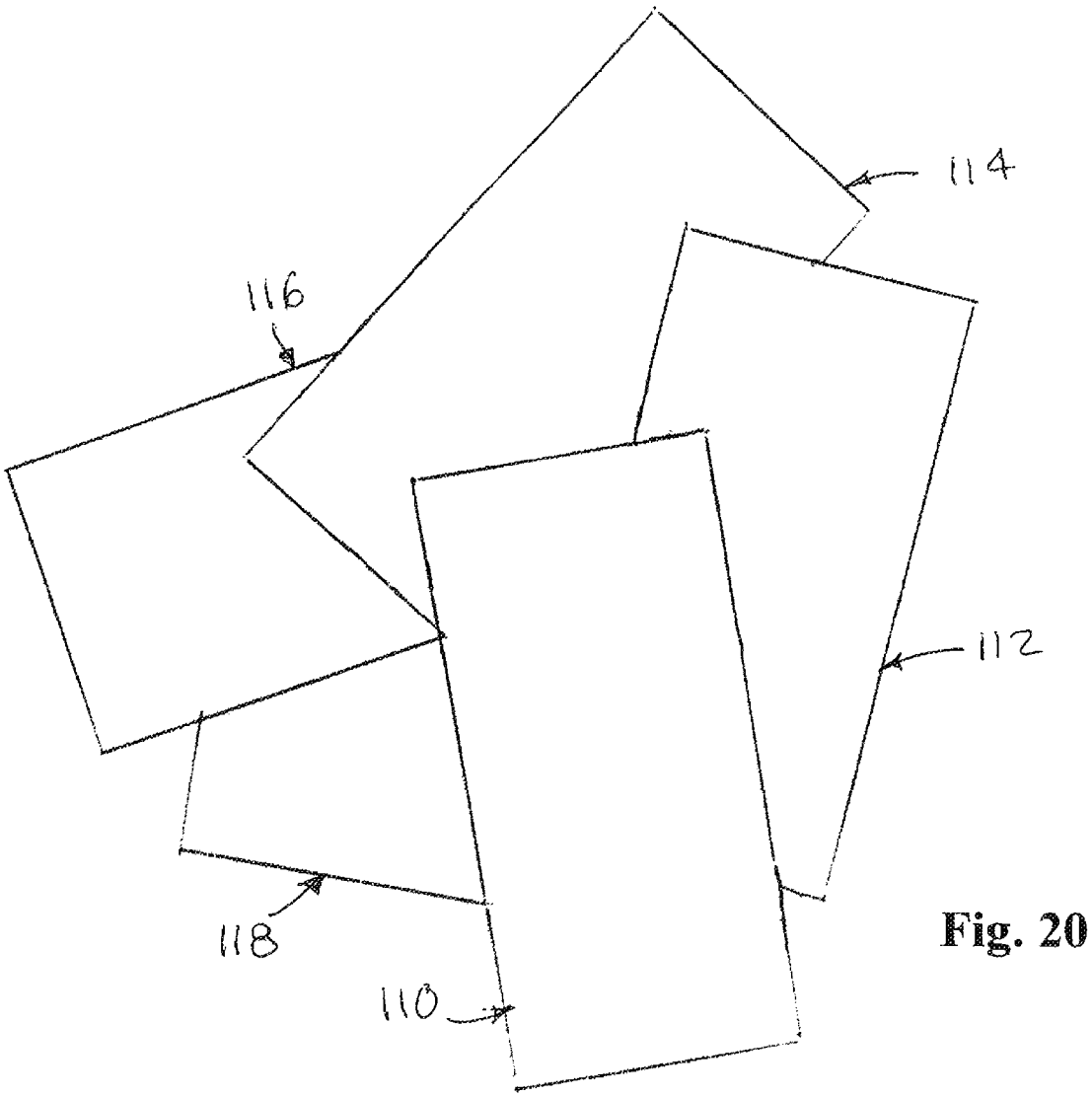
FIG. 20 is a simplified schematic representation similar to that shown in FIG. 19, except showing the last five images of FIG. 18.

Referring now also to FIGS. 19 and 20, the tumbling aspect of the mixing motion shown in FIG. 18 is represented. The container holder 98 moves through successive positions 100-118 and repeats during the mixing operation. It is to be understood that the positions 100 through 118 are arbitrary image representations shown only to illustrate the tumbling aspect, and are not intended to represent any particular starting or stopping position for container holder 98.

Figure 21:
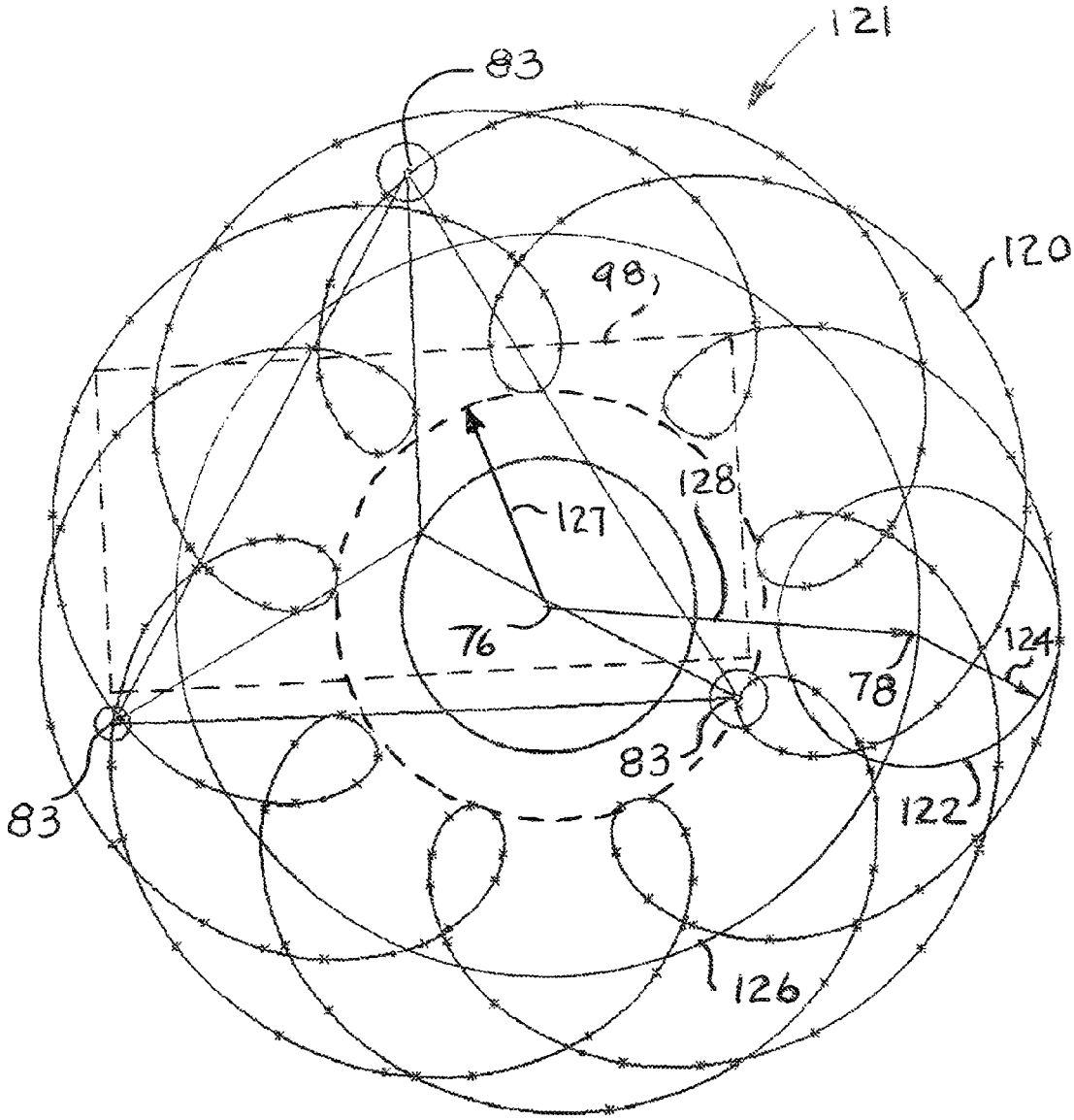
FIG. 21 illustrates one form of path for the mixing motion of the clamp assembly in the practice of the present invention.

Referring now most particularly to FIG. 21, a representation of one mixing motion useful in the practice of the present invention may be seen. Line 120 represents the path the crank arm pivots (as part of the drive members) traverse during this mixing motion. Line 120 is in the form of a cycloid, more particularly, an epitrochoid 121. Other mixing motion paths are within the scope of the present invention, provided that shaking and tumbling of the container ingredients is accomplished. The formula for an epitrochoid is given by Equation (1):

$$f(t)=a\cos(t)-b\cos(ct),a\sin(t)-b\sin(ct),t=0\ldots 2\pi \quad (1)$$

The epitrochoid is generated by a planet circle 122 of radius "b" 124 rotating around an orbit circle 126 of radius "a+b" 128. The line 120 is generated by a point 130 which traces out line 120 in a plane. In the epitrochoid 121 illustrated (which is to be understood as only one mixing motion example of many within the scope of the present invention), a+b=2.3125 and b=0.9375, such that a=1.375. The arrow 127 indicates radius "a." The number of revolutions the planet circle 122 makes in one transit of the orbit circle 126 is "c" and the number of vertices formed in the epitrochoid is given by Equation (2):

$$N=c-1 \quad (2)$$

The shape of the path generated is dependent on N and c. Other path shapes, such as epicycloids, hypocycloids, and hypotrochoids may be found useful in the practice of the present invention, provided that both shaking and tumbling components of a mixing motion are achieved thereby. For example, if a/b=c, an epicycloid will be generated. In the example epitrochoid 121, a/b=1.4666.

The parametric equations for an epitrochoid are as follows:

$$x=(a+b)\cos t-h\cos[(a+b)/b]t \quad (3)$$

$$y=(a+b)\sin t-h\sin[(a+b)/b]t \quad (4)$$

where a and b are the radii of the two circles, as before, and h is the radial distance from a point P which traces the curve to the center of the smaller circle. When h=b, the curve is an epicycloid.

It is to be understood that the spacing of the secondary axis 78 to the primary axis 76 is equal to the "a+b" radius 128 and the length of the crank arm 66 is equal to the "b" radius 124. It may be recognized that certain of the path shapes referred to (including epitrochoid) can be achieved by a geometric drawing toy offered under the name Spirograph, a registered trademark of the Tonka Corporation. It is to be further understood that the shape and proportions of the epitrochoid may be different than a classical epitrochoid such as that shown in FIG. 21, because, in some embodiments of the present invention, the outer circles are spaced apart from the inner circle, even though the ratio of the revolutions of the outer circle with respect to the inner circle may be the same. This is a departure from and in contrast to the classical epitrochoid generator wherein the outer circle is in contact with the inner circle. It may thus be seen that the container carrier assembly is moved in an epitrochoidal path, as illustrated in FIGS. 18-21. Moreover, the path shown in FIG. 21 is preferably, but not necessarily, in a plane.

Figure 22:
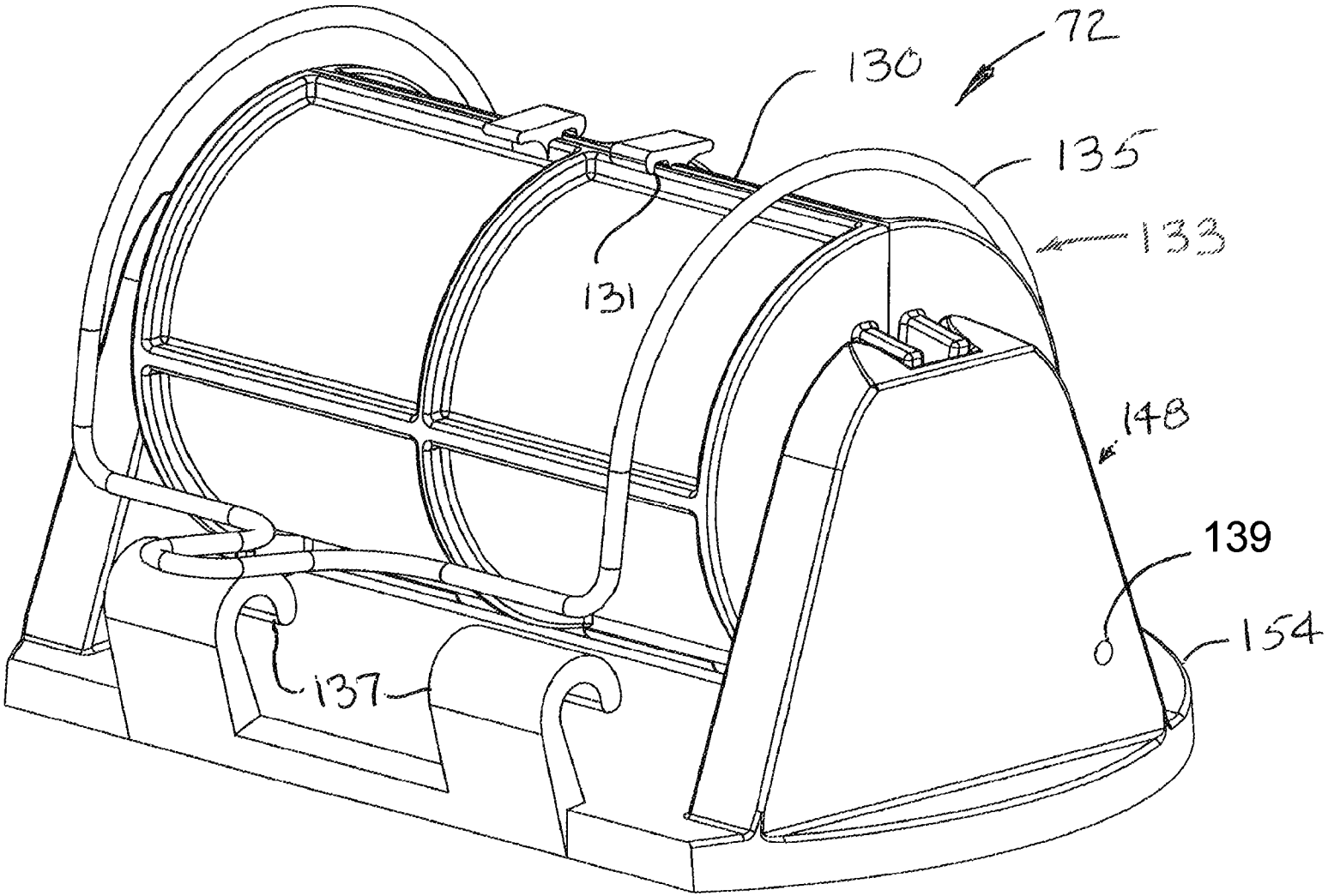
FIG. 22 is a first embodiment of a clamp assembly for retaining a container useful in the practice of the present invention.
Figure 25:
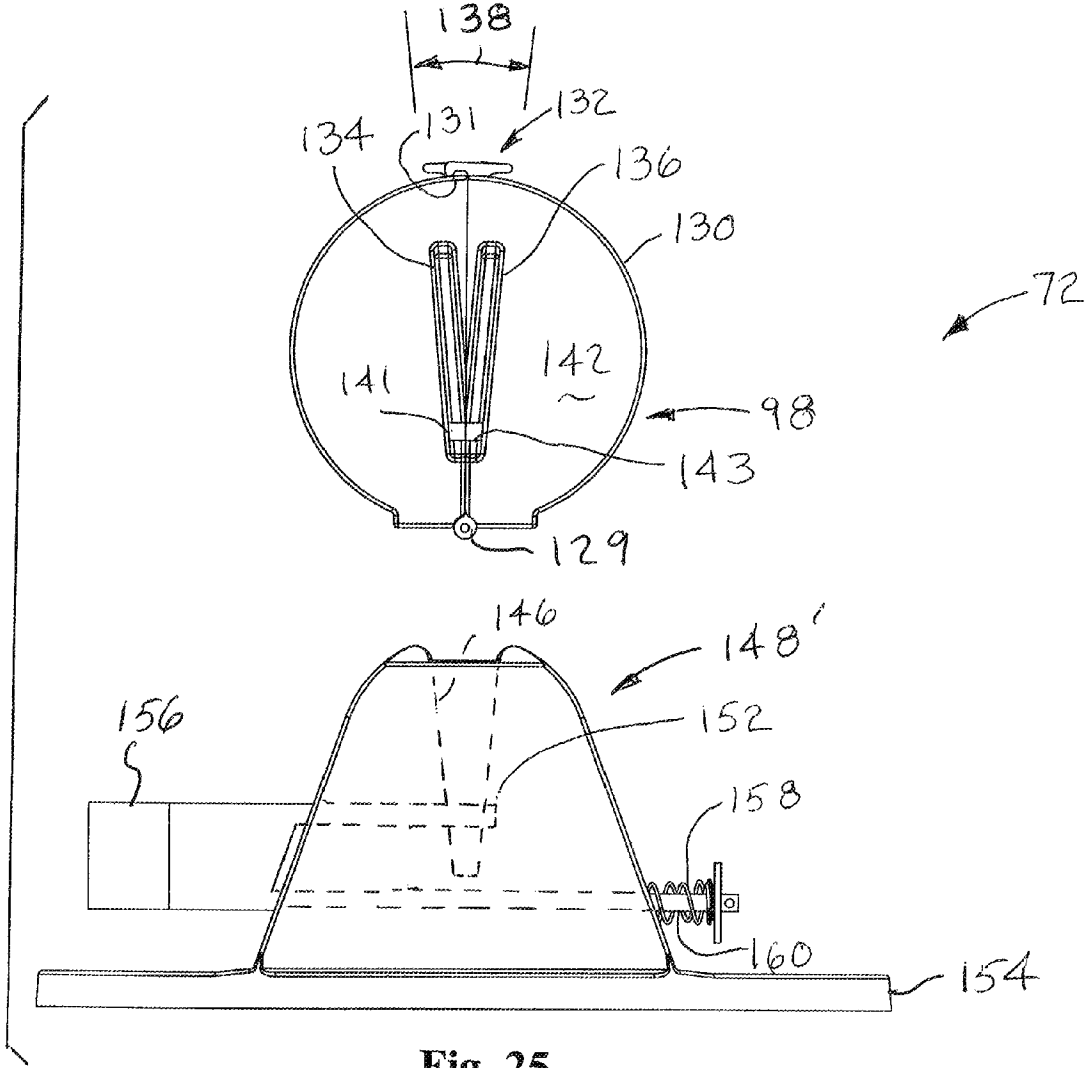
FIG. 25 is a second side view of the apparatus shown in FIG. 23.
Figure 26:
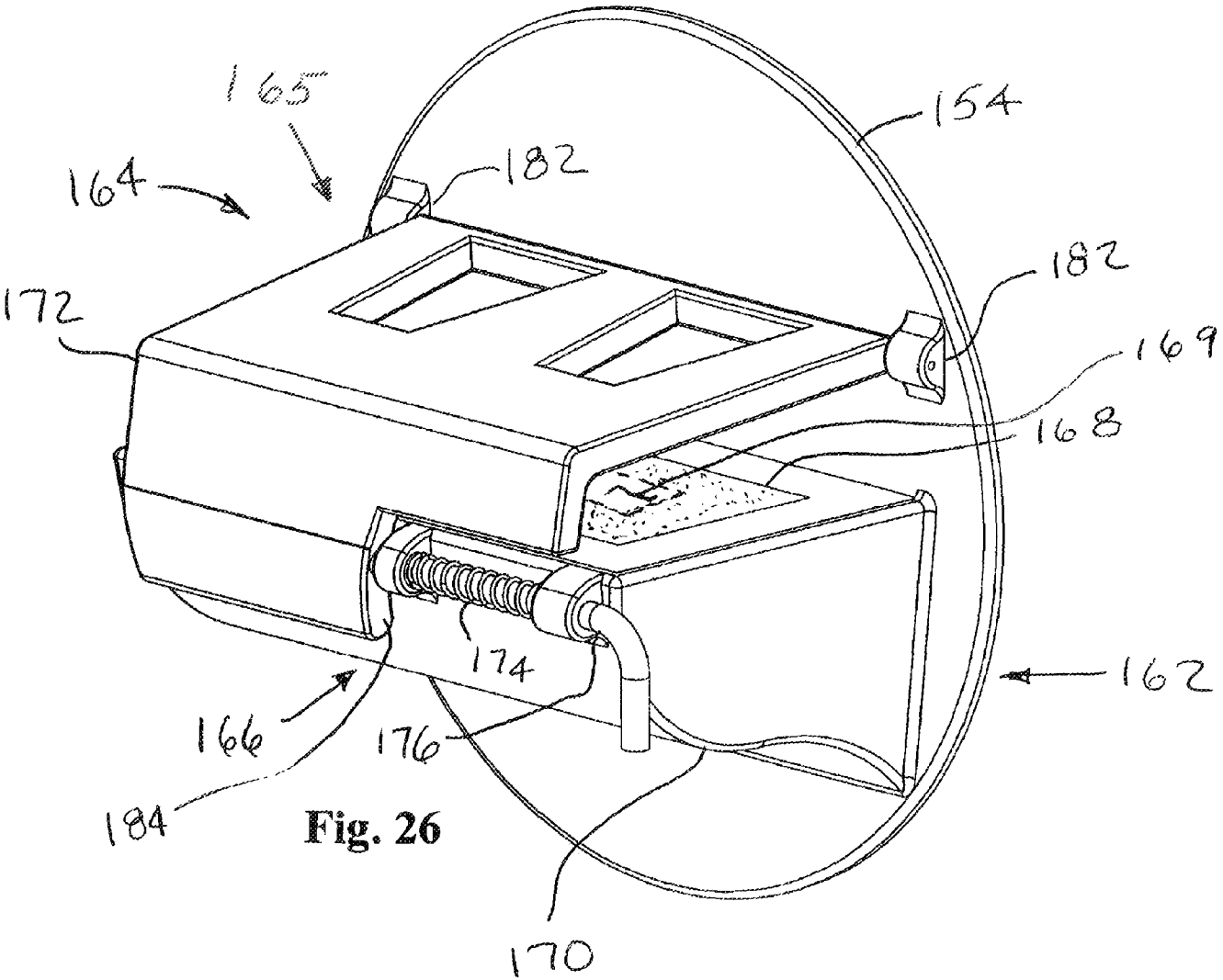
FIG. 26 is a perspective view of a third embodiment of a clamp assembly useful in the practice of the present invention.
Figure 27:
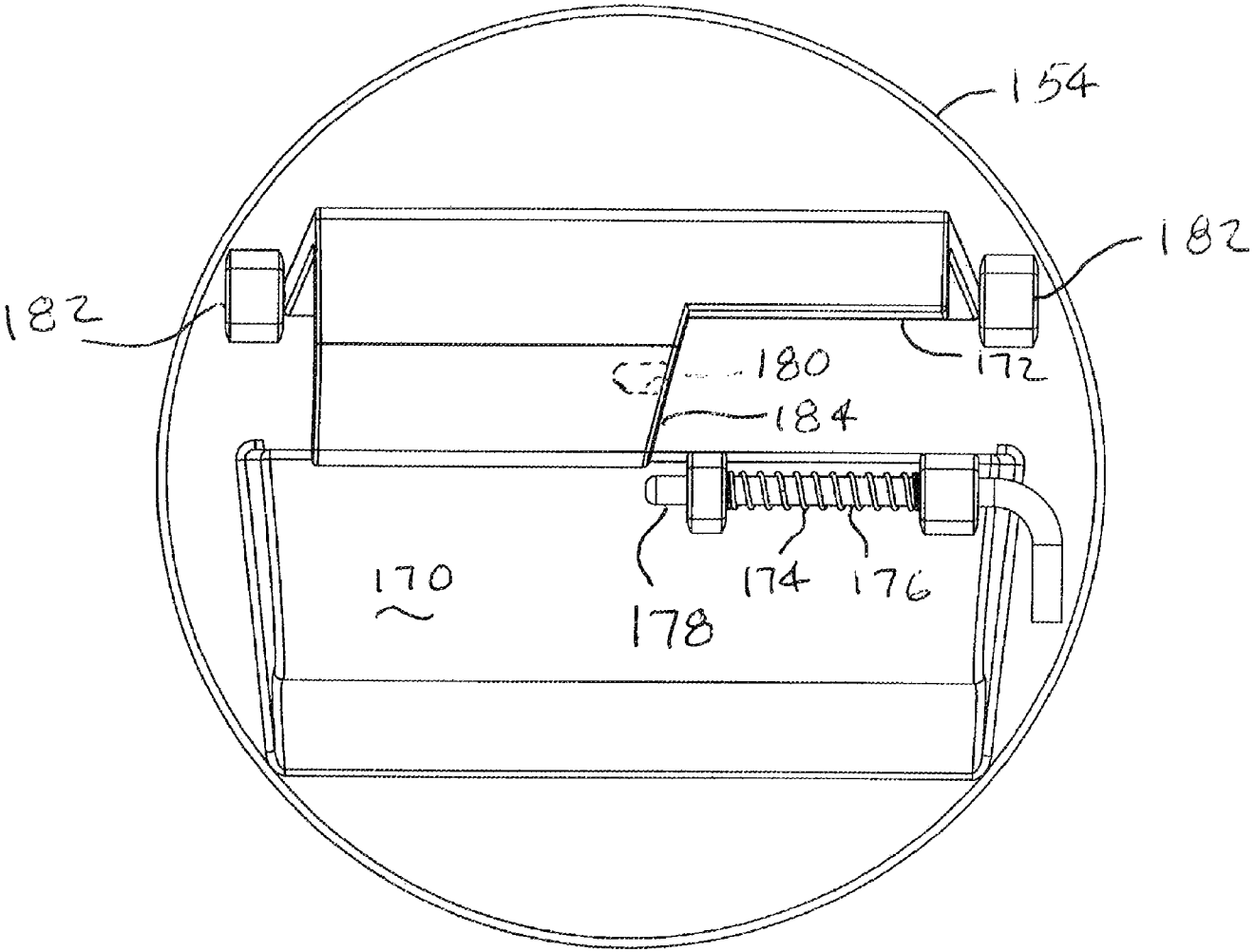
FIG. 27 is a first side view of the clamp assembly of FIG. 26, except shown in a slightly open condition.
Figure 28:
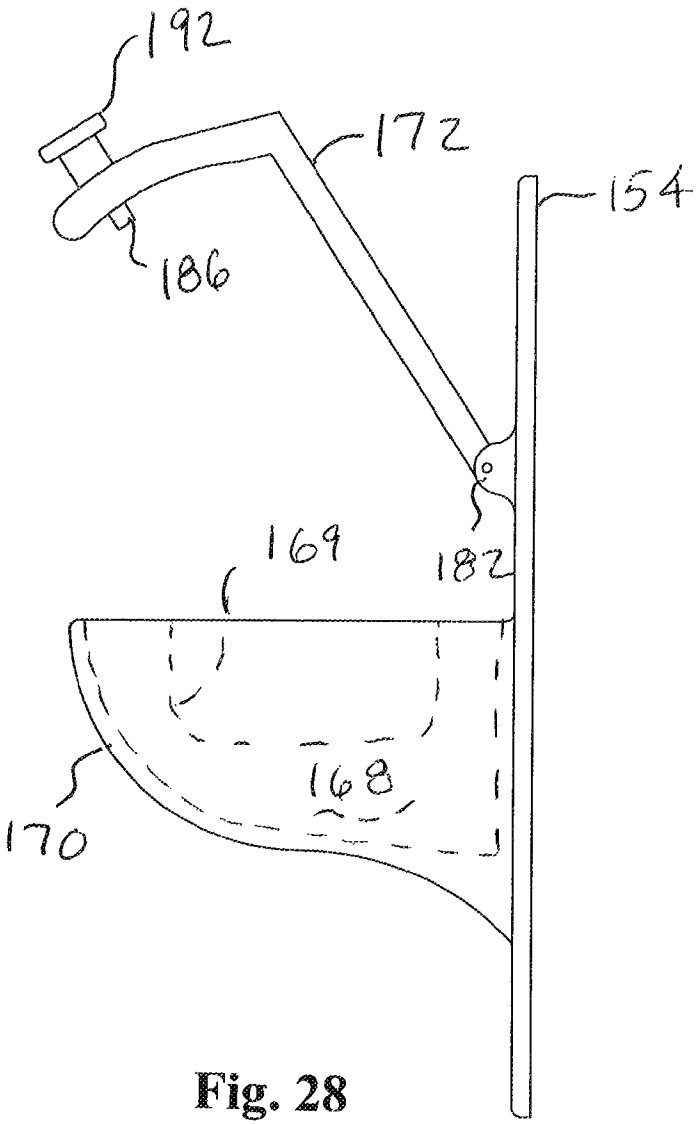
FIG. 28 is a side view of a fourth embodiment of the clamp assembly similar to that of the third embodiment.
Figure 29:
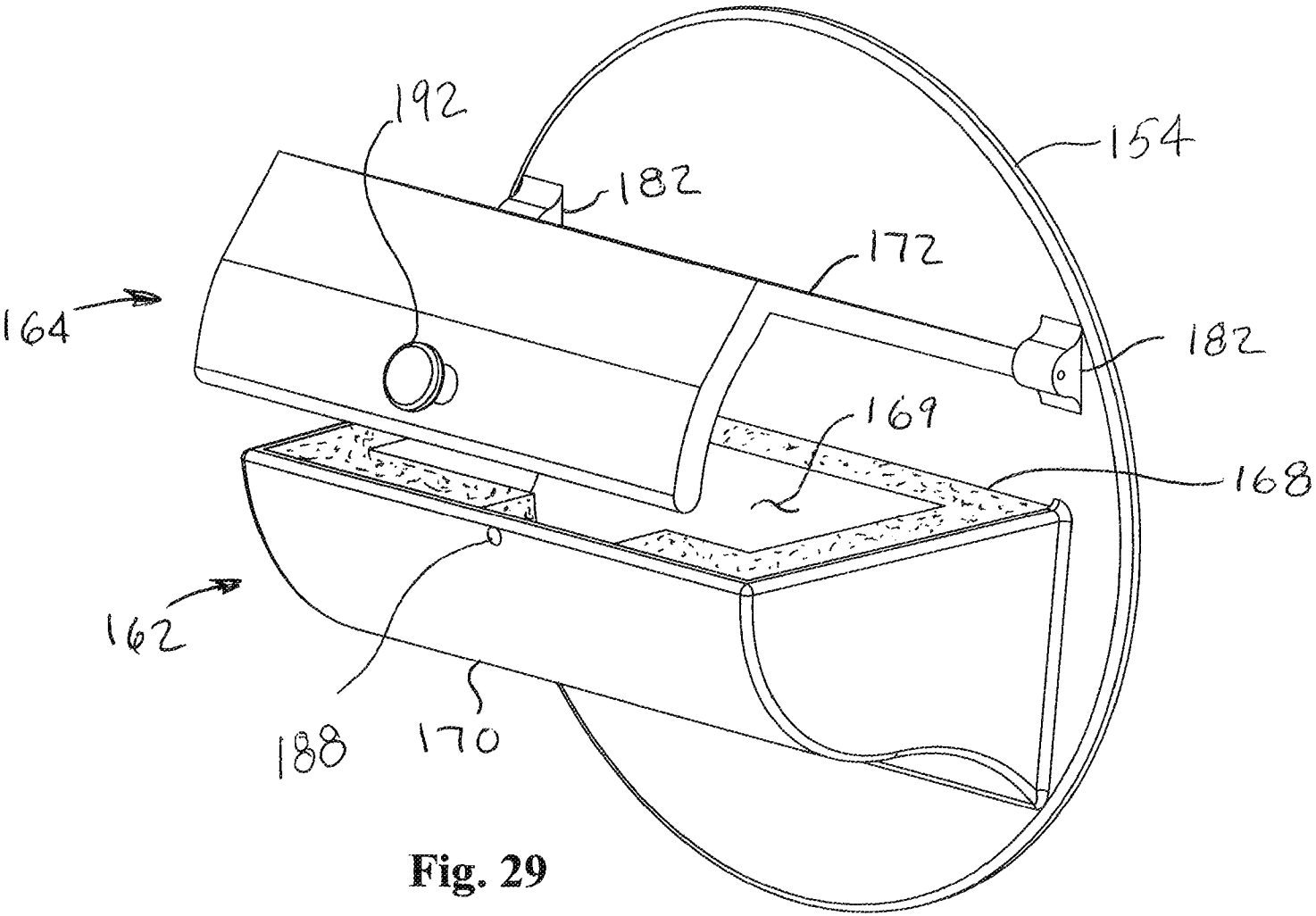
FIG. 29 is a perspective view of the fourth embodiment of the clamp assembly of FIG. 28.
Figure 30:
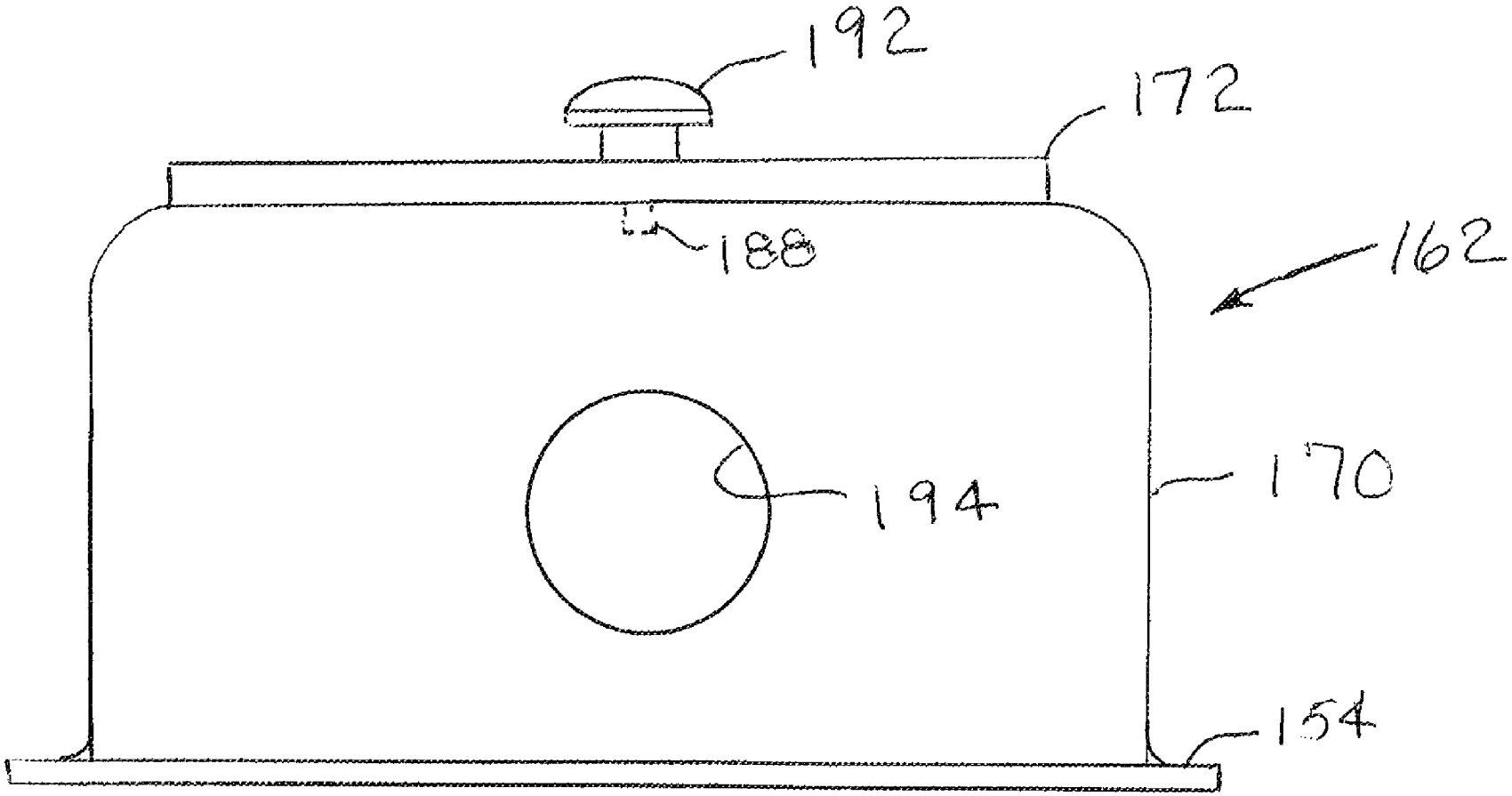
FIG. 30 is a bottom plan view of the fourth embodiment of the clamp assembly of FIG. 28.

Referring now to FIGS. 22-29, various versions of the container holder 98 may be seen. FIG. 22 shows a portion of one embodiment of the container carrier assembly 72 with a first embodiment of the container holder 98. In this version, the holder 98 is a generally cylindrical capsule 130 sized to receive the container with the ingredients to be mixed. Capsule 130 may be bifurcated axially in two half cylinders and have a conventional latching mechanism 132 (such as one or more detents 131) to hold the two halves closed. Capsule 130 may have a conventional hinge 129 (shown in FIG. 25) between the two half cylinders. The interior of capsule 130 may include a foam liner with a cut-out portion shaped to receive the container with the ingredients to be mixed, as is shown in FIGS. 27 and 29.

A capsule latching mechanism 133 is shown in FIG. 22 in the form of a wire bail 135 which extends over capsule 130 and is retained by one or more hooks 137. A pair of ends 139 of the wire bail may extend into or through mating apertures in a wall of a mating receptacle 148 to pivotably mount the wire bail 135 to a support plate 154.

Figure 23:
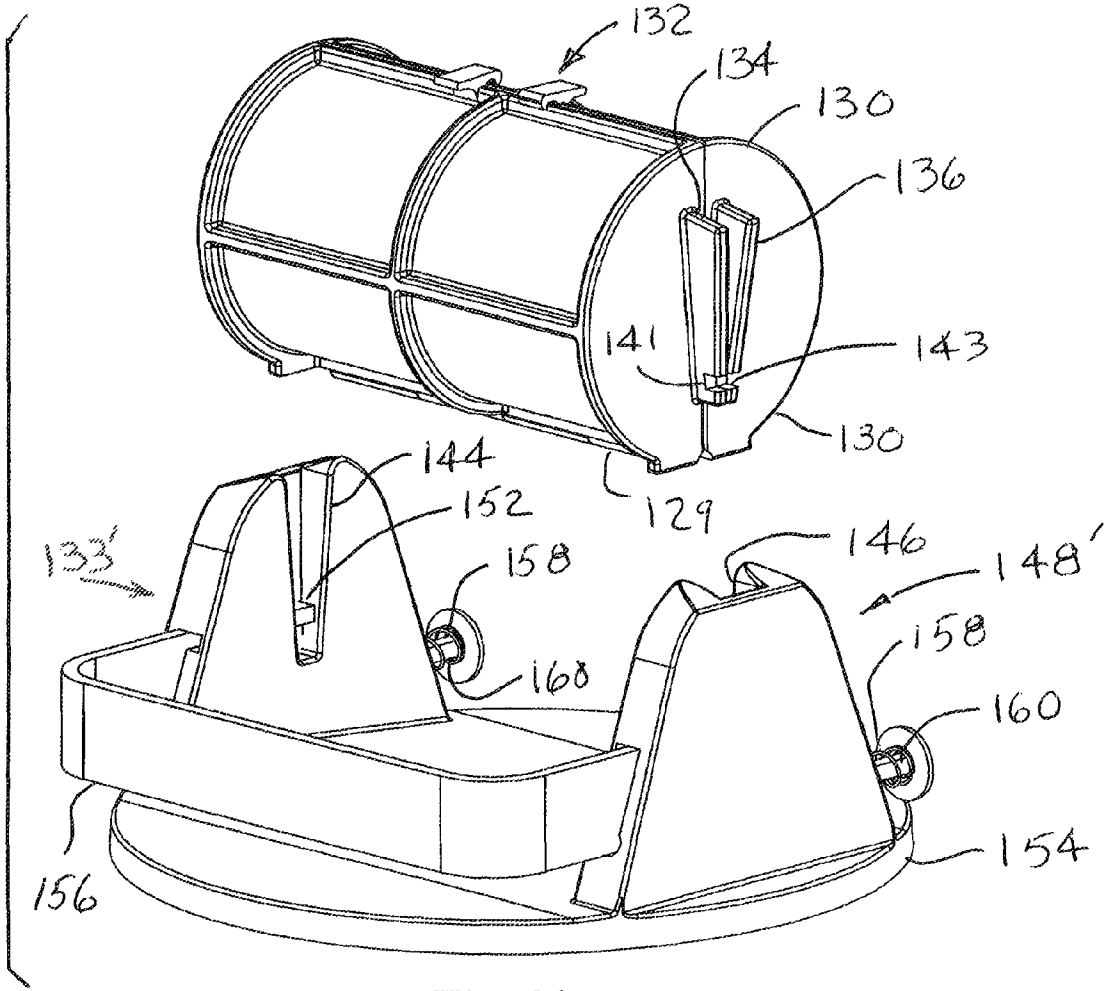
FIG. 23 is a perspective view of a second embodiment of a clamp assembly similar to that of FIG. 22, except with a different latch mechanism, and showing the container holder separated from the clamp.
Figure 24:
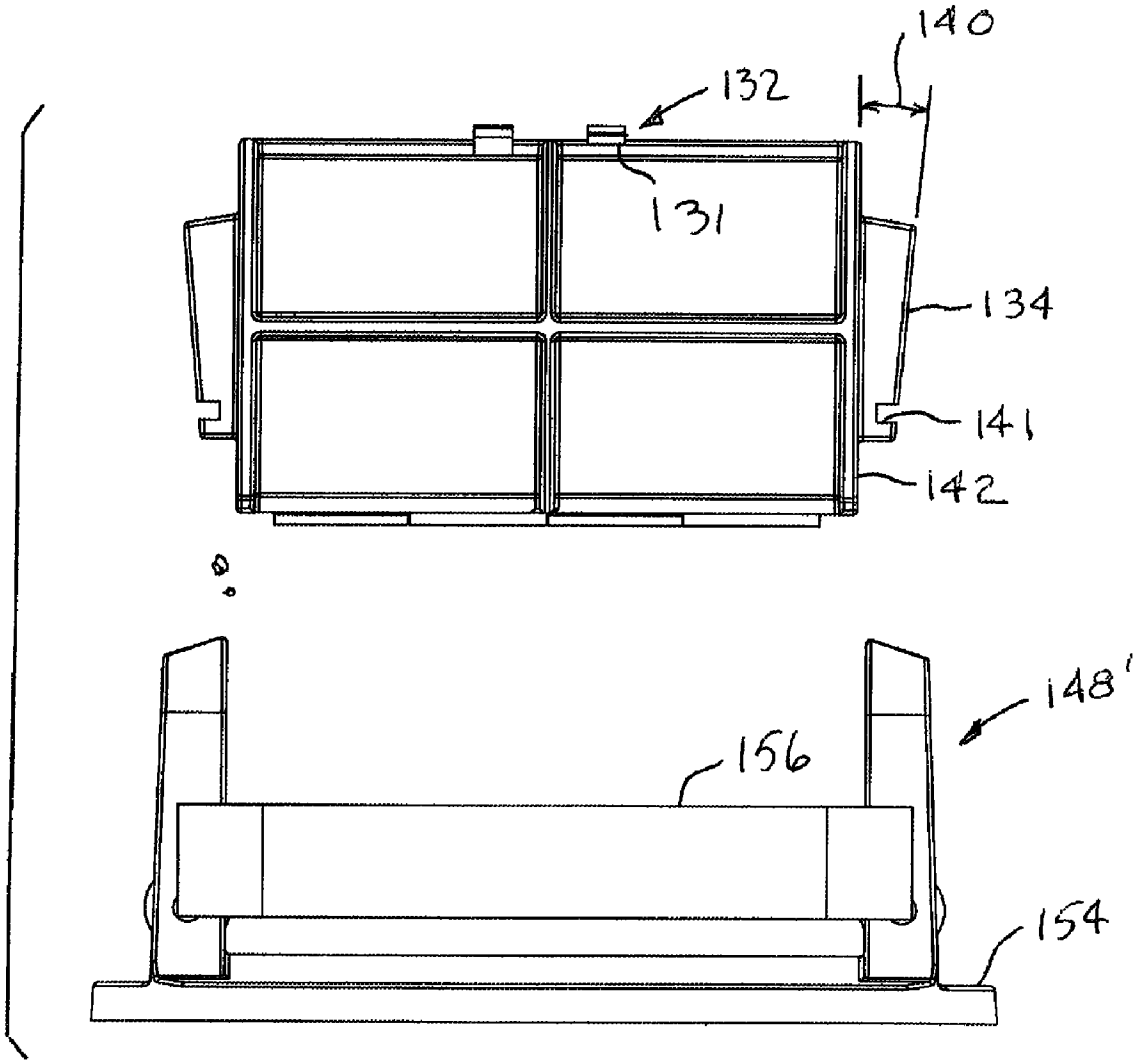
FIG. 24 is a first side view of the apparatus shown in FIG. 23.

Referring now also to FIGS. 23-25, a second capsule latching mechanism 133' may be seen. In this version, each of a pair of teeth 152 engage pair of slots 141, 143 to retain the capsule 130 to the mixer, it being understood that plate 154 is preferably attached to plate 74 of the assembly 72. Teeth 152 are retractable using a handle 156 to move the handle 156 to compress each of a pair of springs 158 received over respective handle extensions 160.

Capsule 130 may also have a pair of ribs 134, 136 on each axial end thereof. Ribs 134 and 136 may be oriented with respect to each other at an angle 138 and each may be tapered at an angle 140 to the end face 142 of capsule 130. Angles 138 and 140 are repeated in congruent slots 144, 146 in a mating receptacle 148 (or 148') mounted to or formed integrally with the container holder support plate 154.

Referring now to FIGS. 26 and 27, a further variation of the container holder may have first and second portions, with the first portion 162 is sized and shaped to receive any one of a set of a predetermined number of sizes and shapes of containers. The holder may also have a second portion 164 sized and shaped and positioned to positively retain the selected container received in the first portion. The first portion 162 may include a foam insert 168 having a cutout 169 to receive any one of the set of containers. A clamp assembly 165 preferably also has a latch mechanism 166 for releasably retaining the first and second portions together. The container may be a conventional cosmetic container, and the container holder and clamp assembly may be sized and shaped to receive any one of the predetermined set of containers of various sizes and shapes. Alternatively, the container may be another type of container, such as a medical bottle, ink bottle, eyedropper bottle, or yet another container in which ingredients are to be mixed. In FIGS. 26 and 27, the first portion 162 is formed as a trough 170, and the second portion 164 is formed as a hinged lid 172. A spring 174 biases a pin 176 mounted on the trough 170 to serve as the latch mechanism 166, with a distal end 178 of the pin 176 received in a mating recess 180 on the lid 172. One or more hinges 182 may be provided to rotatably secure lid 170 to plate 154. Lid 172 may have an inclined surface 184 to allow closure of lid 172 without first retracting pin 176.

FIGS. 28 and 29 have an alternate embodiment for the latch mechanism 166. In this embodiment, a projection 186 extends inward from lid 172 and is arranged to mate with and be received in a recess 188 in the trough 170 to retain the lid to the trough for mixing. To release the projection from the recess, a knob 192 may be grasped and pulled outward. In one form, the projection 186 is coupled to the knob 192 and resiliently biased toward the position shown in FIG. 28 by a spring internal to the knob 192. In alternative, knob 192 and projection 186 may be formed integrally of the same material as the lid 172, and grasping and pulling on knob 192 will deform a region of the lid 172 by an amount sufficient to allow separation of the projection 186 from the recess 188, allowing opening of the lid. An aperture 194 may be formed in the trough 170 (and the foam liner 168, if used) to allow a user to conveniently eject a container from the trough 170 or other portion 162 of the container holder after mixing by urging the container out of the holder using a finger inserted through the aperture 194.

Other forms of container holders or clamp assemblies may be utilized while remaining within the spirit and scope of the present invention, particularly as to the mixing motion aspect of the invention described above.

Referring now to FIGS. 31-37 various aspects of an alternative embodiment of a mixer 200 useful in the practice of the present invention may be seen. In this embodiment, mixer 200 is similar in many respects to the embodiments of mixer 30 described above. Mixer 200 differs from mixer 30 in a different drive connection 202 between drive shaft 248 (corresponding in function to drive shaft 48) and an assembly 204 driven thereby. Mixer 200 also differs from mixer 30 by having a resilient mounting arrangement 206 (shown in FIG. 37) for a follower plate 208, corresponding in overall function to plate 70 in the embodiment shown in FIGS. 7 and 8. Also, it is to be understood that in FIGS. 31, 32, and 34, certain portions of a container carrier assembly 272 are omitted for simplicity, with the omitted portions shown in FIGS. 35 and 36. A schematic representation of a container carrier plate 274 is shown in these Figures.

In reference to FIGS. 31-34, drive connection 202 includes a grooved hub 210 which is secured against rotation, for example, by fasteners 212, to a wall 213, which may be formed, for example, of sheet metal. Alternatively, other forms of fastening may be used. Follower plate 208 is connected to and rotates with drive shaft 248, thus serving as base carrier 52 in this embodiment. A continuous belt 214 is wound around hub 210 and one or more planet or satellite rollers 216 (corresponding in function to planet pulleys 62). As plate 208 is rotated by drive shaft 248, belt 214 causes rollers 216 to rotate, rotating each crank arm 66 via its respective crank arm drive shaft 64. The drive connection 202 provides the tumbling and shaking motion as with the other embodiments described supra.

Figure 35:
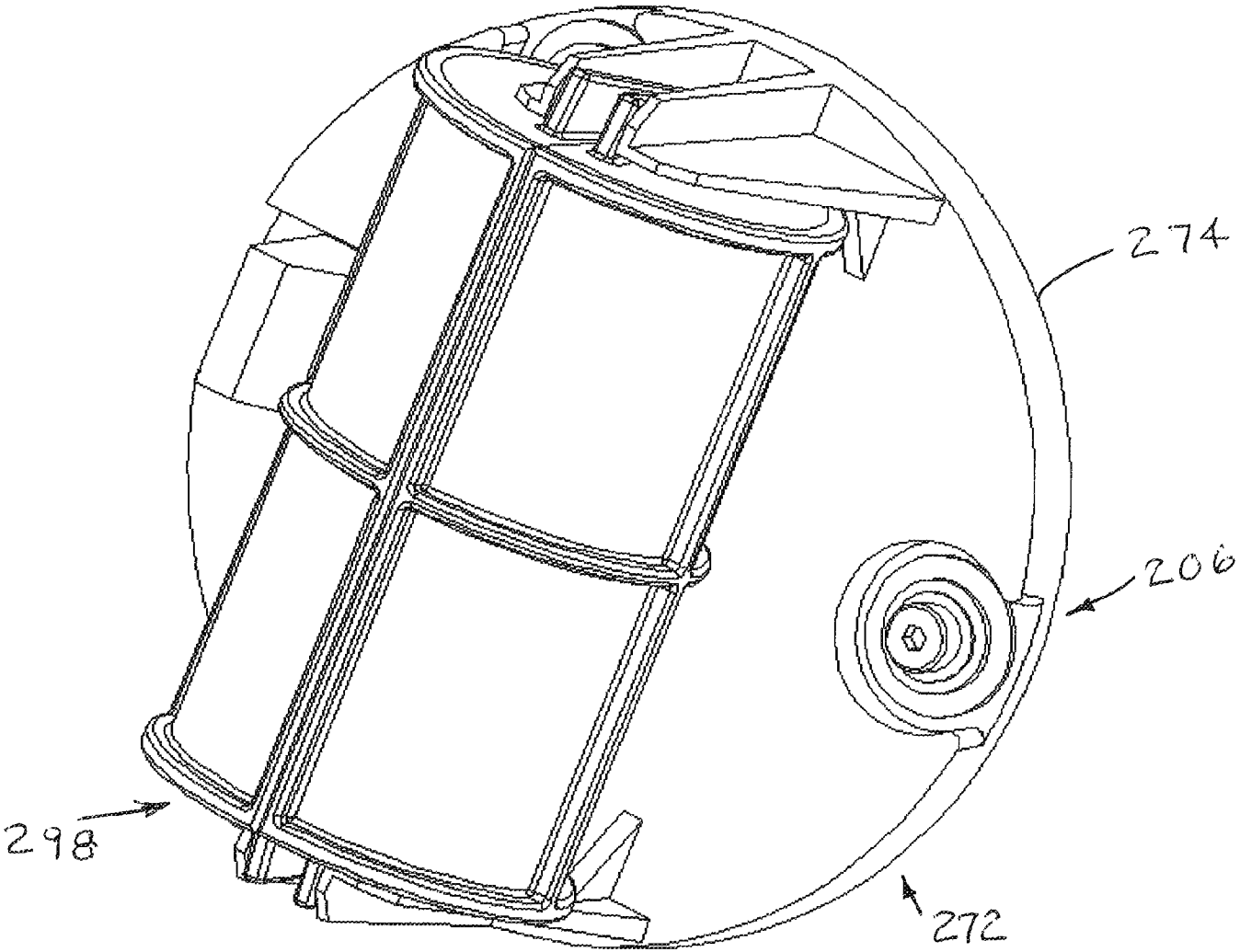
FIG. 35 is a simplified first perspective view of an alternative clamp assembly corresponding to the clamp assembly of FIGS. 22 and 23.
Figure 36:
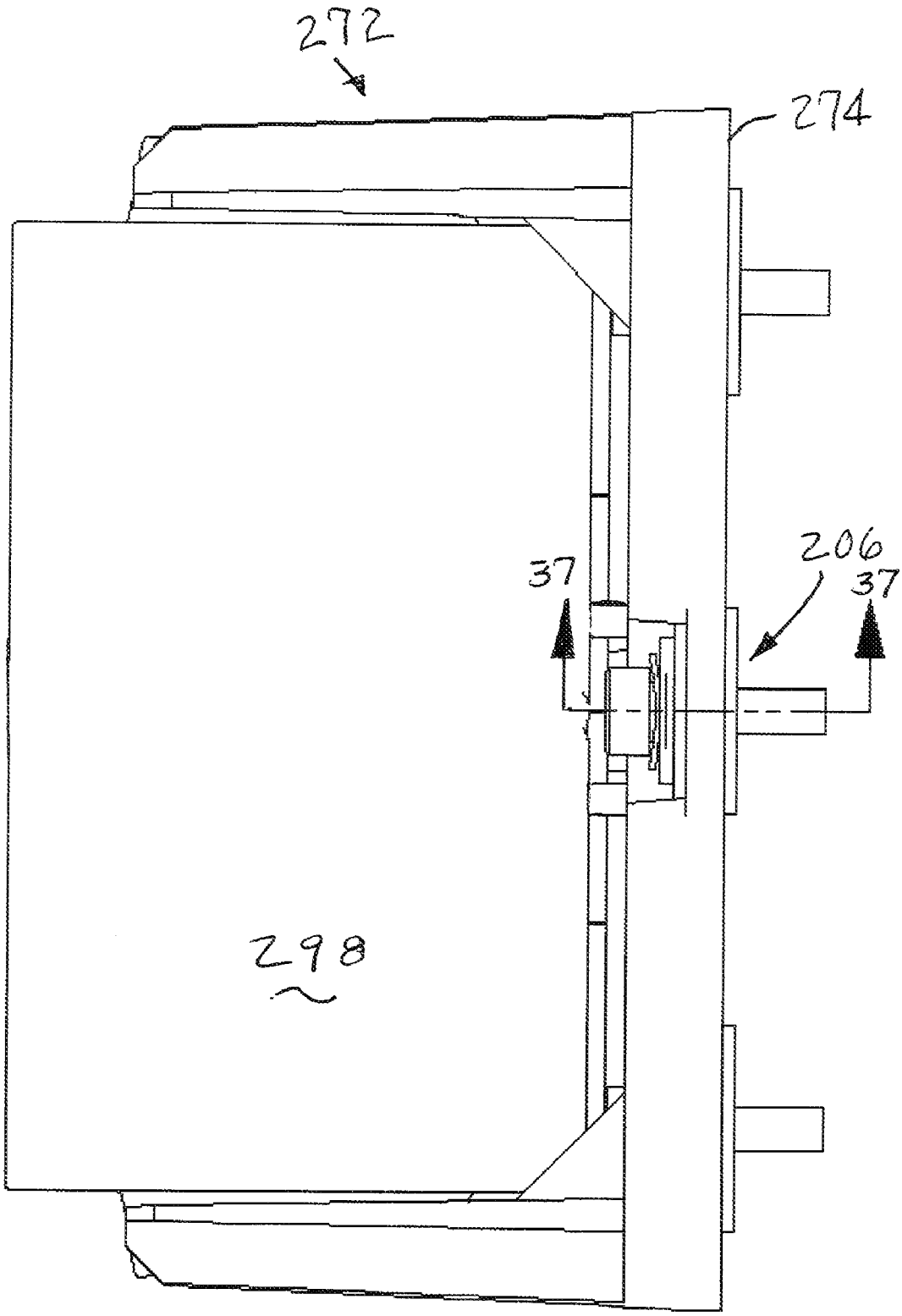
FIG. 36 is a simplified side elevation view of the clamp assembly shown in FIG. 35.
Figure 37:
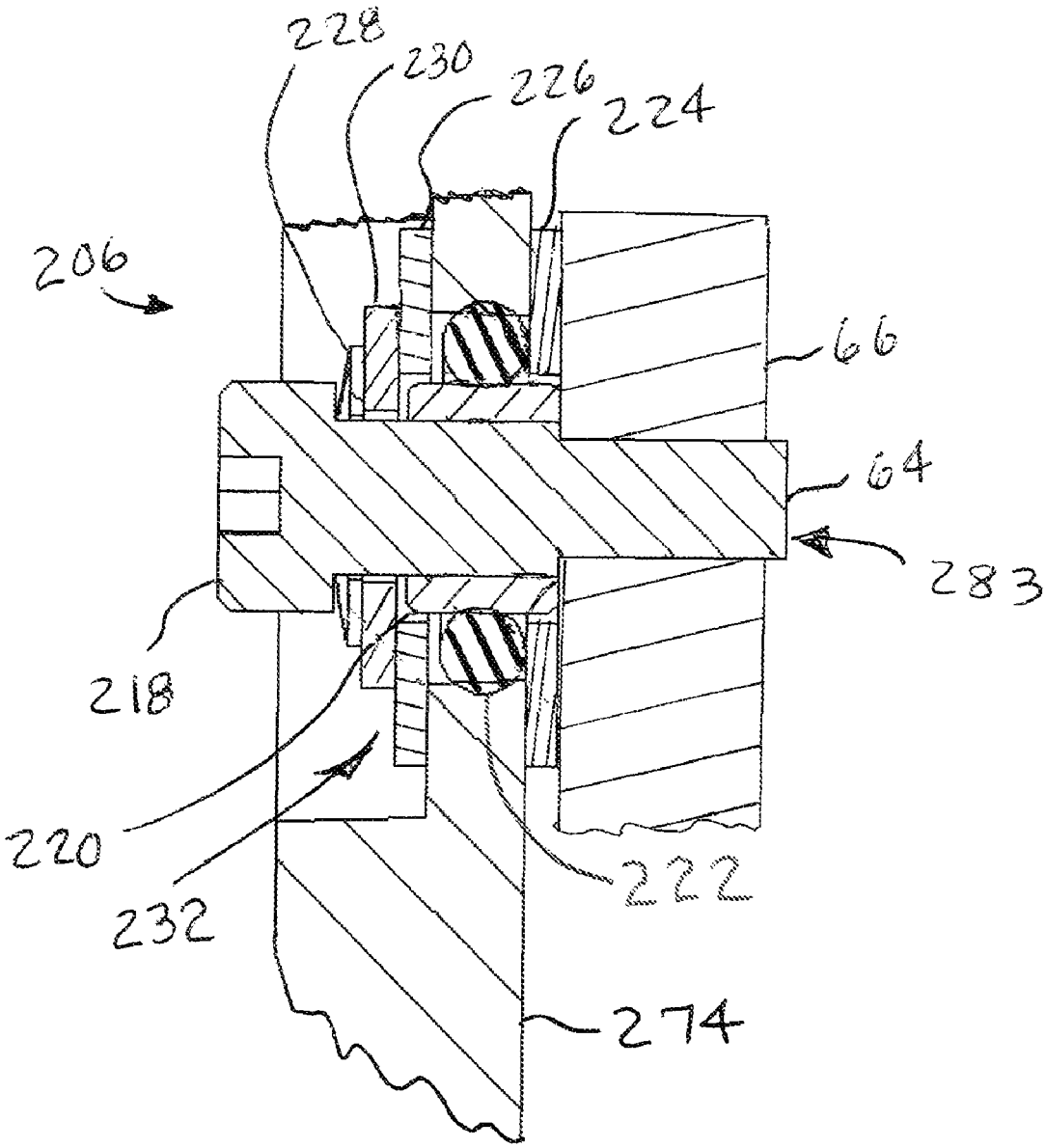
FIG. 37 is a section view taken along line 37-37 of FIG. 36.
Figure 38:
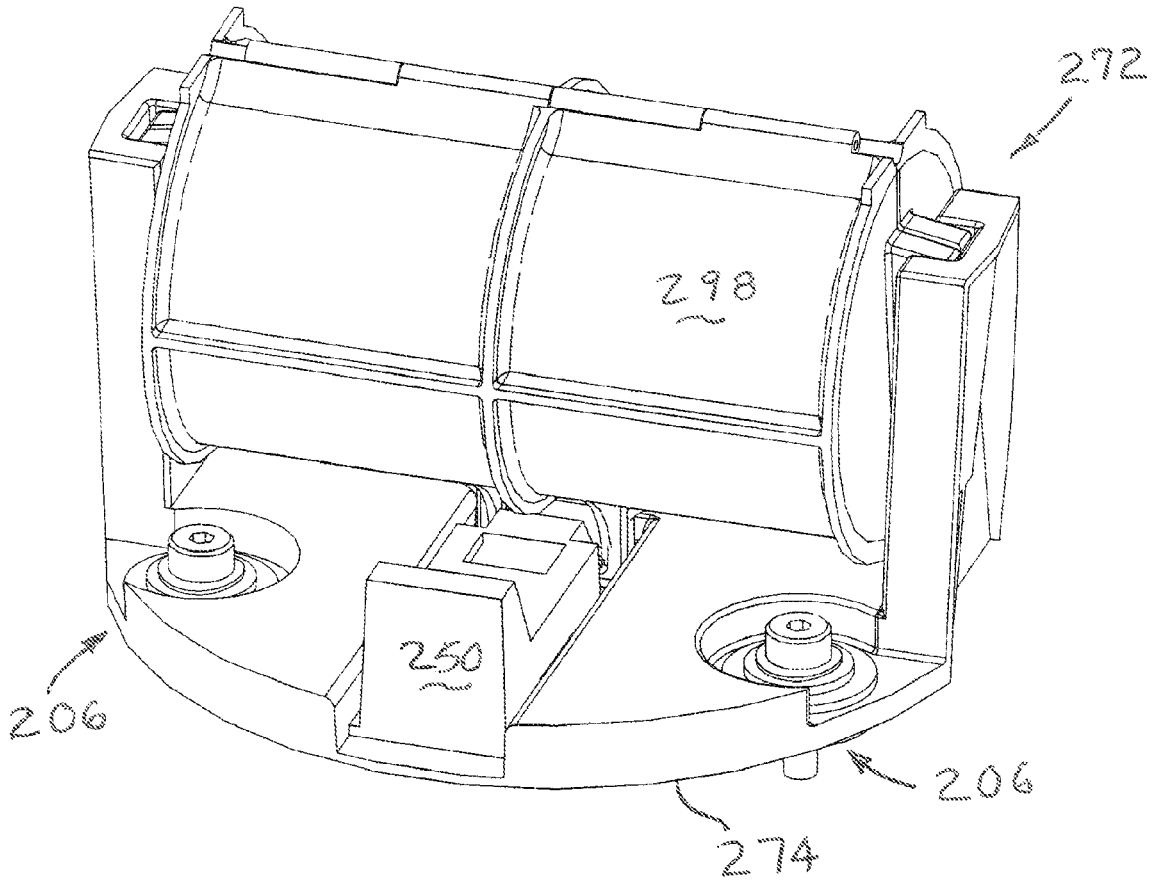
FIG. 38 is a second perspective view of the clamp assembly of FIG. 35.
Figure 39:
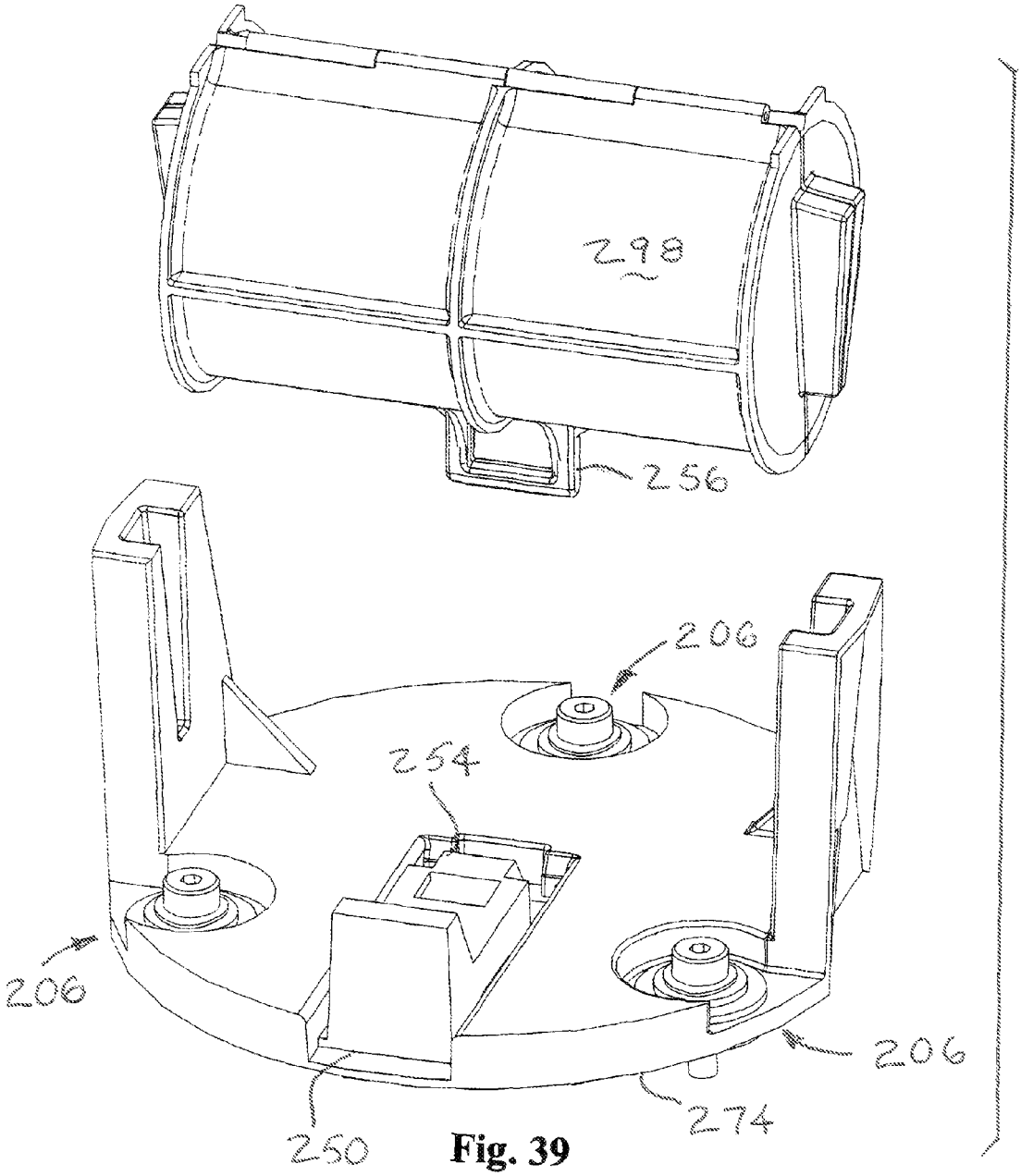
FIG. 39 is a view of the clamp assembly of FIG. 38 with the container holder separated from the carrier plate.
Figure 40:
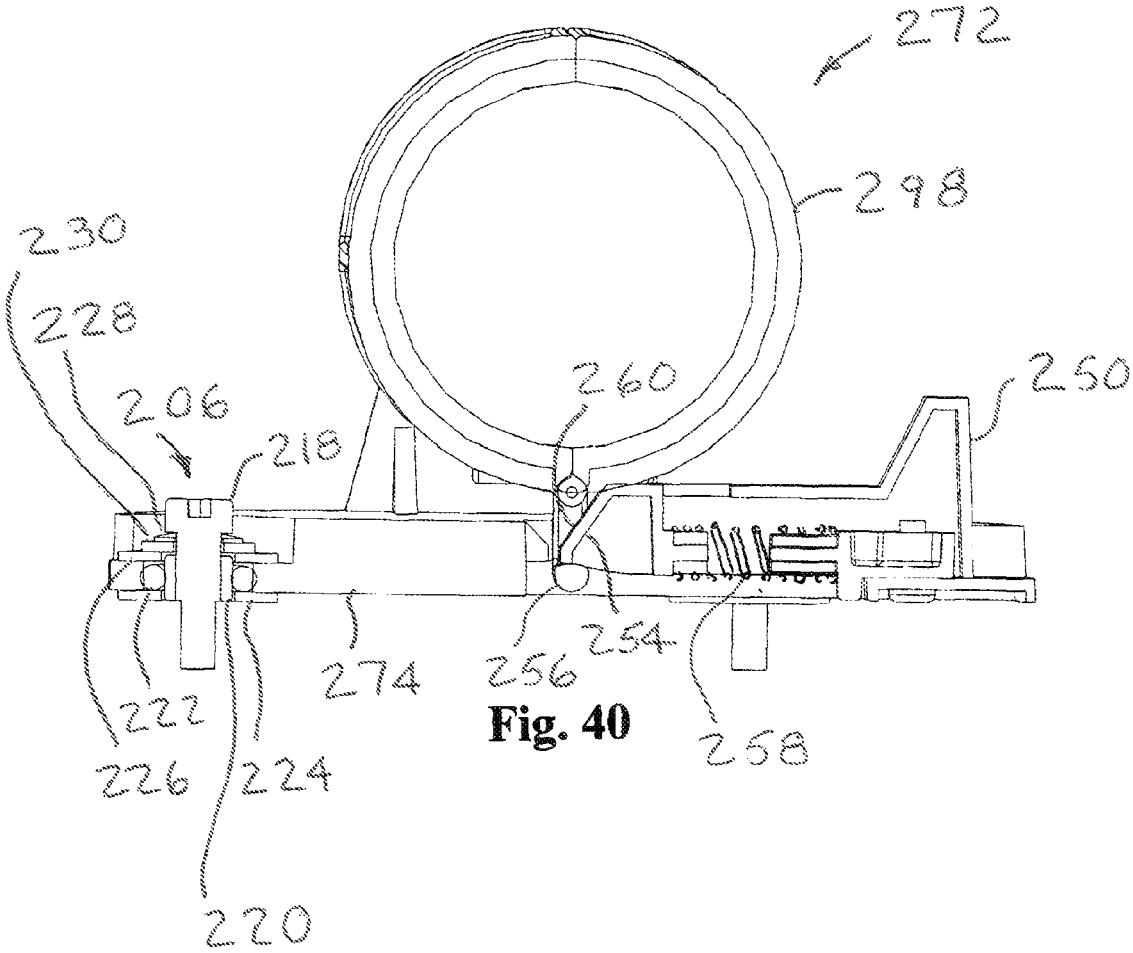
FIG. 40 is a section view along line 40-40 of FIG. 38.

Referring now to FIGS. 35-37, the resilient mounting arrangement 206 may be seen in more detail, particularly in FIG. 37. The resilient mounting arrangement 206 provides for attachment of the container carrier assembly 272 having the carrier support plate 274 secured to at least one and preferably three crank arms 66 by pivots 283 in a manner similar to that described supra for assembly 72 and plate 74. FIG. 35 shows a simplified view of a container holder 298 which may be similar or identical to container holder 98, described supra. FIG. 36 shows a side view of the assembly 272 with an even more simplified schematic view of the container holder 298, and FIG. 37 shows a section view of the mounting arrangement 206 with a distal portion of the crank arm 66 (of the drive member) added.

In FIG. 37 it may be seen that a cap screw 218 threaded into the crank arm 66 may serve as the crank arm drive shaft 64. A bushing 220 surrounds an intermediate portion of cap screw 218 and an O-ring 222 provides for the resiliency of arrangement 202. O-ring 222 is retained by a pair of washers 224, 226, with a spring or wave washer 228 and a conventional washer 230 acting as a thrust subassembly 232 to bias the plate 274 against washer 224, to take up any clearance existing because of tolerance stack-up in the resilient mounting arrangement 206. The resilient mounting arrangement aspect of the present invention accommodates radial, axial and angular misalignment of plate 274 relative to the axis of rotation of drive shaft or shafts 64.

Figure 41:
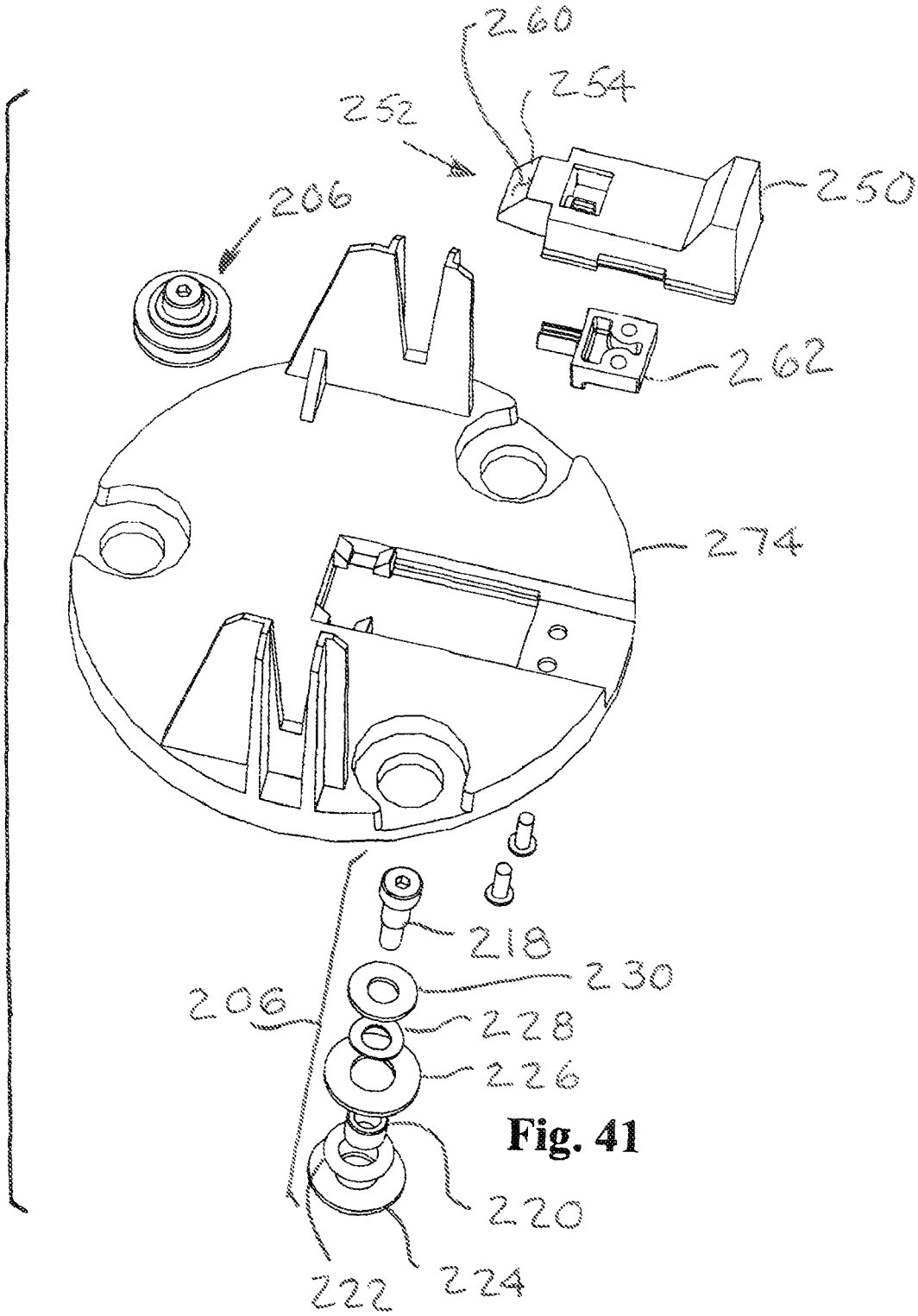
FIG. 41 is an exploded view of the carrier plate of FIG. 39.
Figure 42:
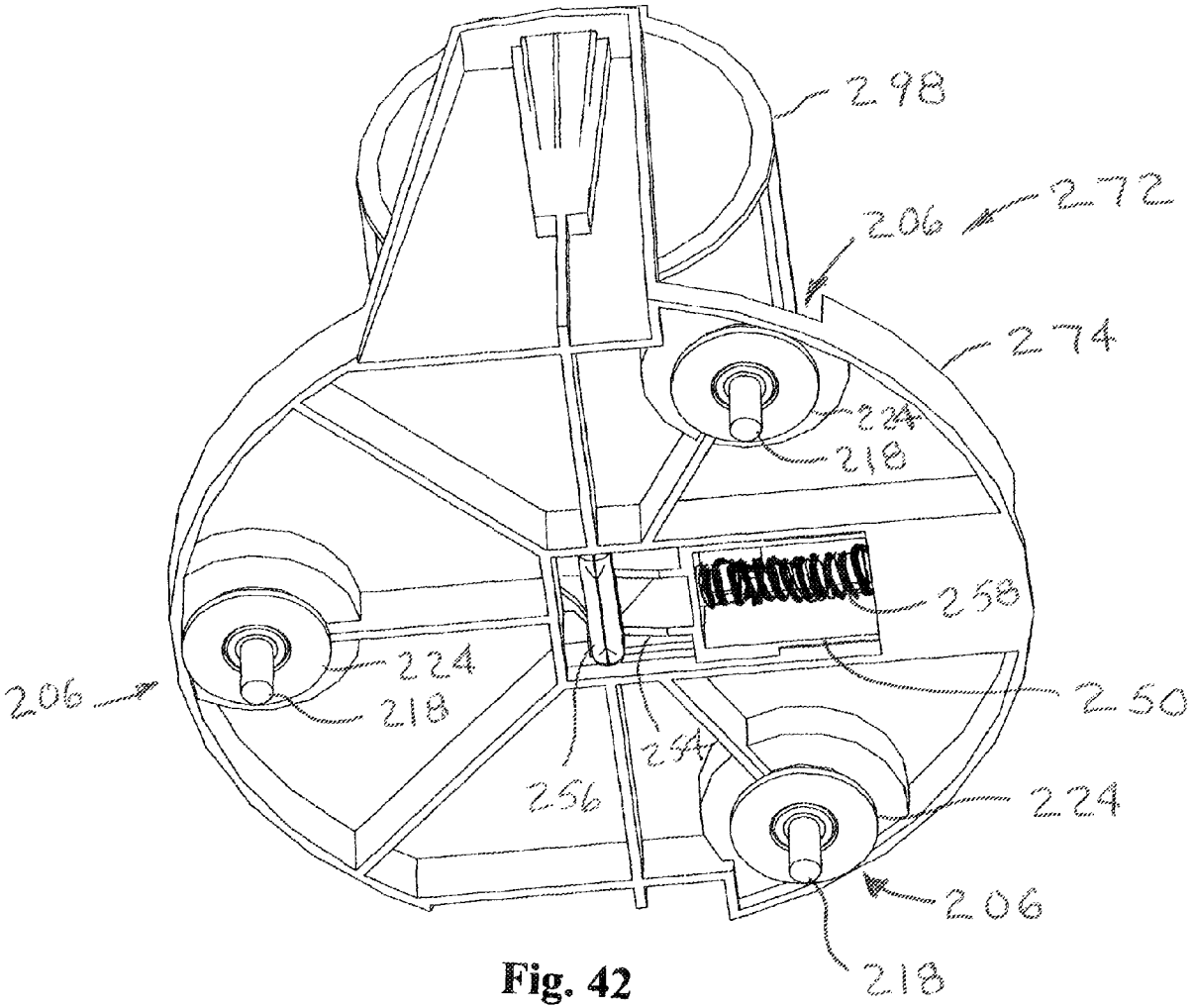
FIG. 42 is a third perspective view of the clamp assembly of FIG. 35.
Figure 43:
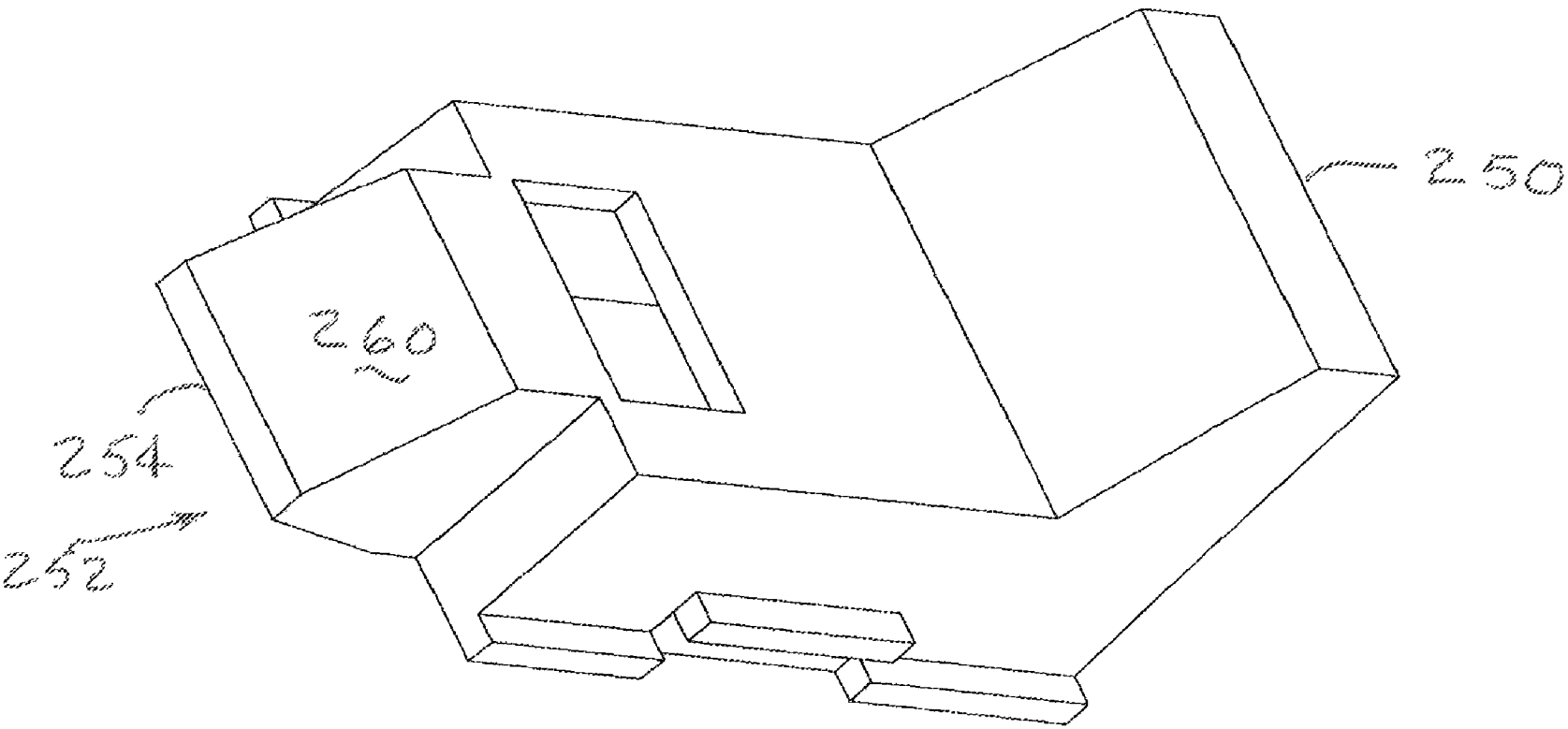
FIG. 43 is a top perspective view of a retainer slider useful with the assembly of FIG. 35.
Figure 44:
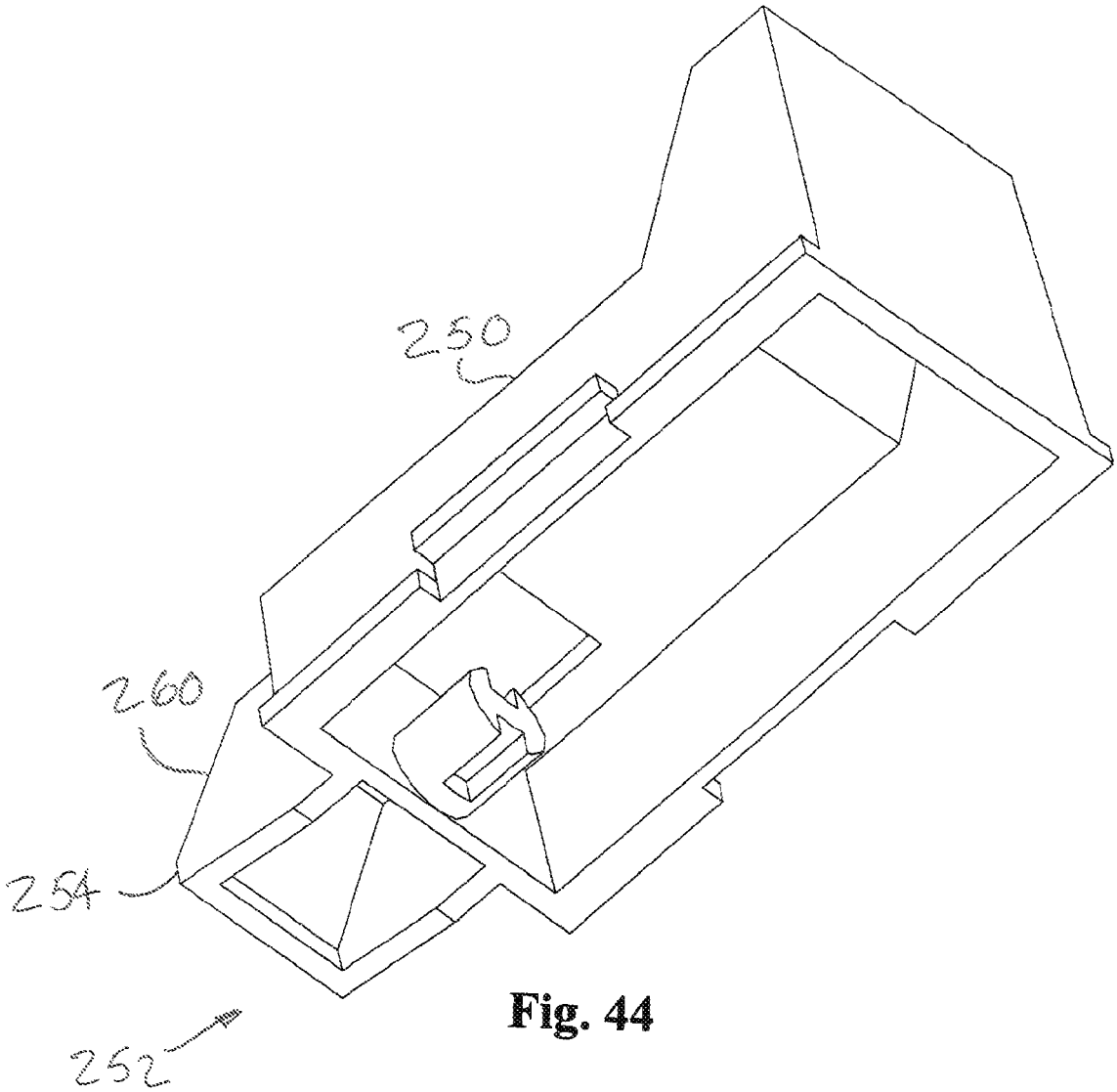
FIG. 44 is a bottom perspective view of the retainer slider of FIG. 43.
Figure 45:
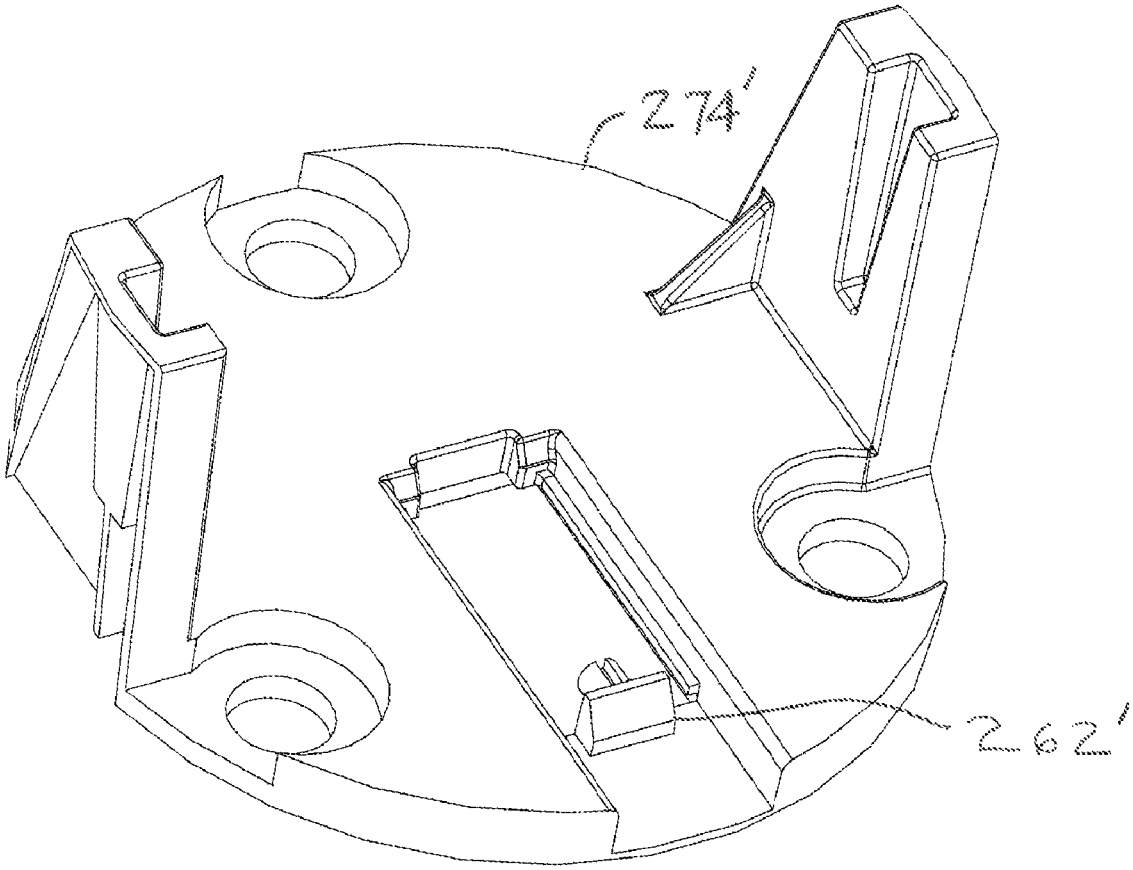
FIG. 45 is a perspective view of an alternative embodiment of the carrier plate of FIG. 39 useful in the practice of the present invention.
Figure 46:
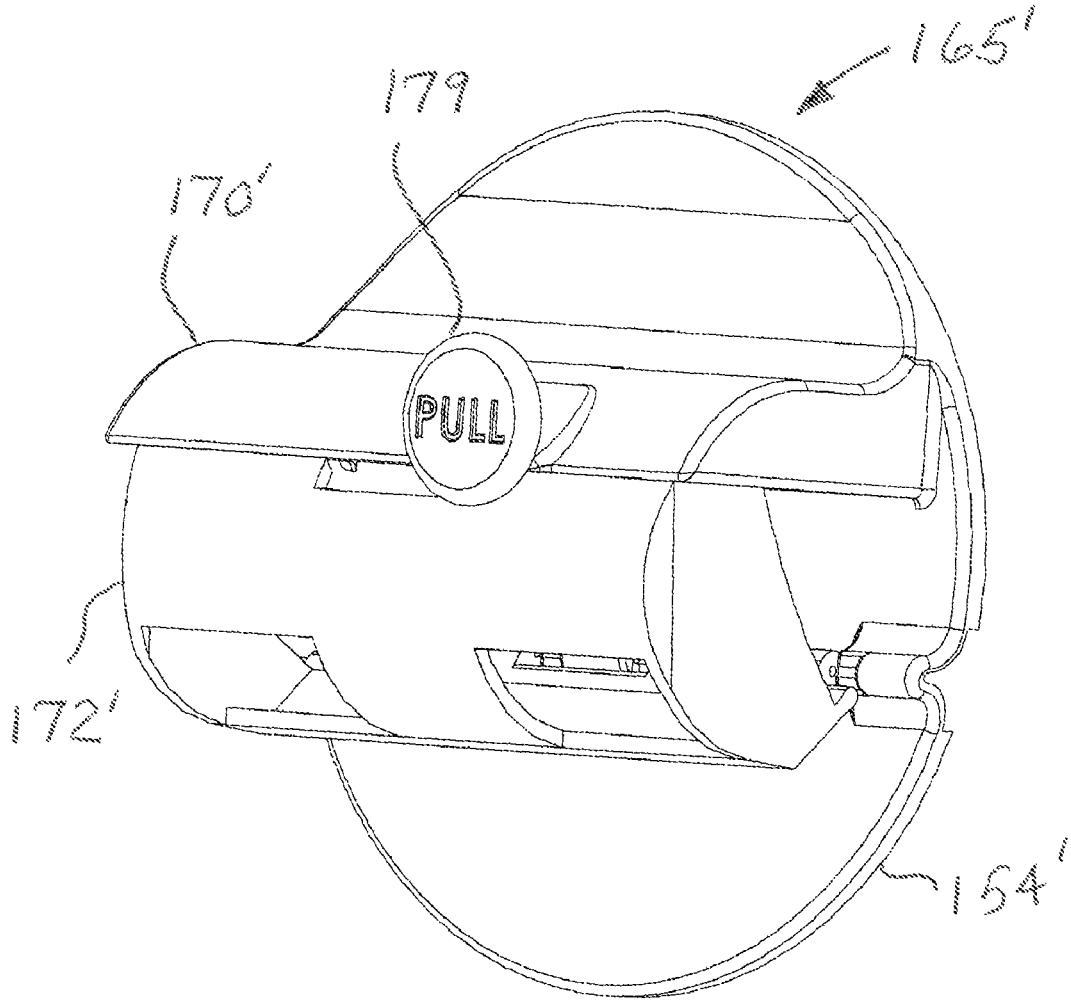
FIG. 46 is a perspective view of a fifth embodiment of the clamp assembly similar to the third embodiment shown in FIG. 26, shown in a closed condition.
Figure 47:
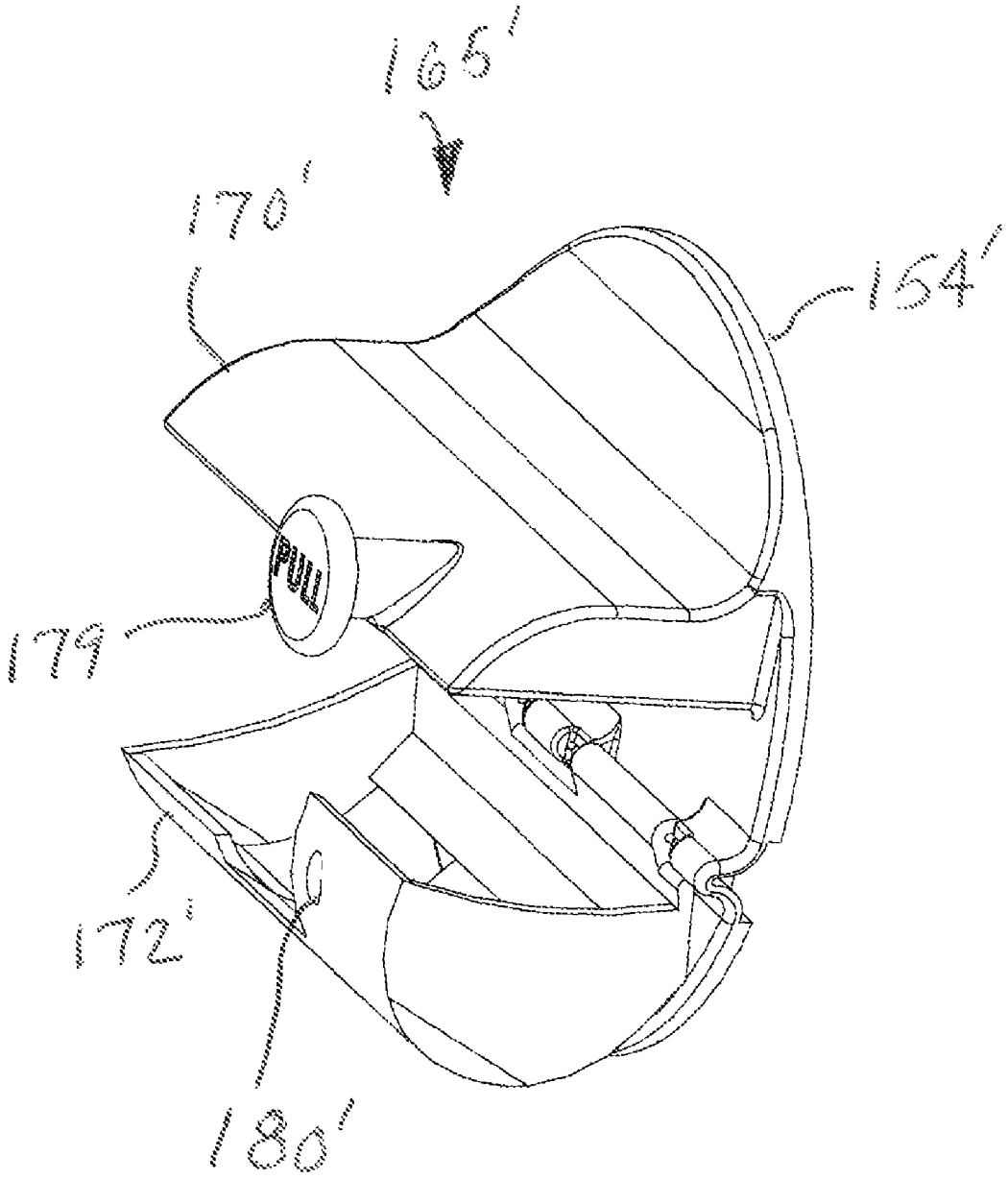
FIG. 47 is a perspective view of the fifth embodiment of the clamp assembly of FIG. 46, shown in an open condition.
Figure 48:
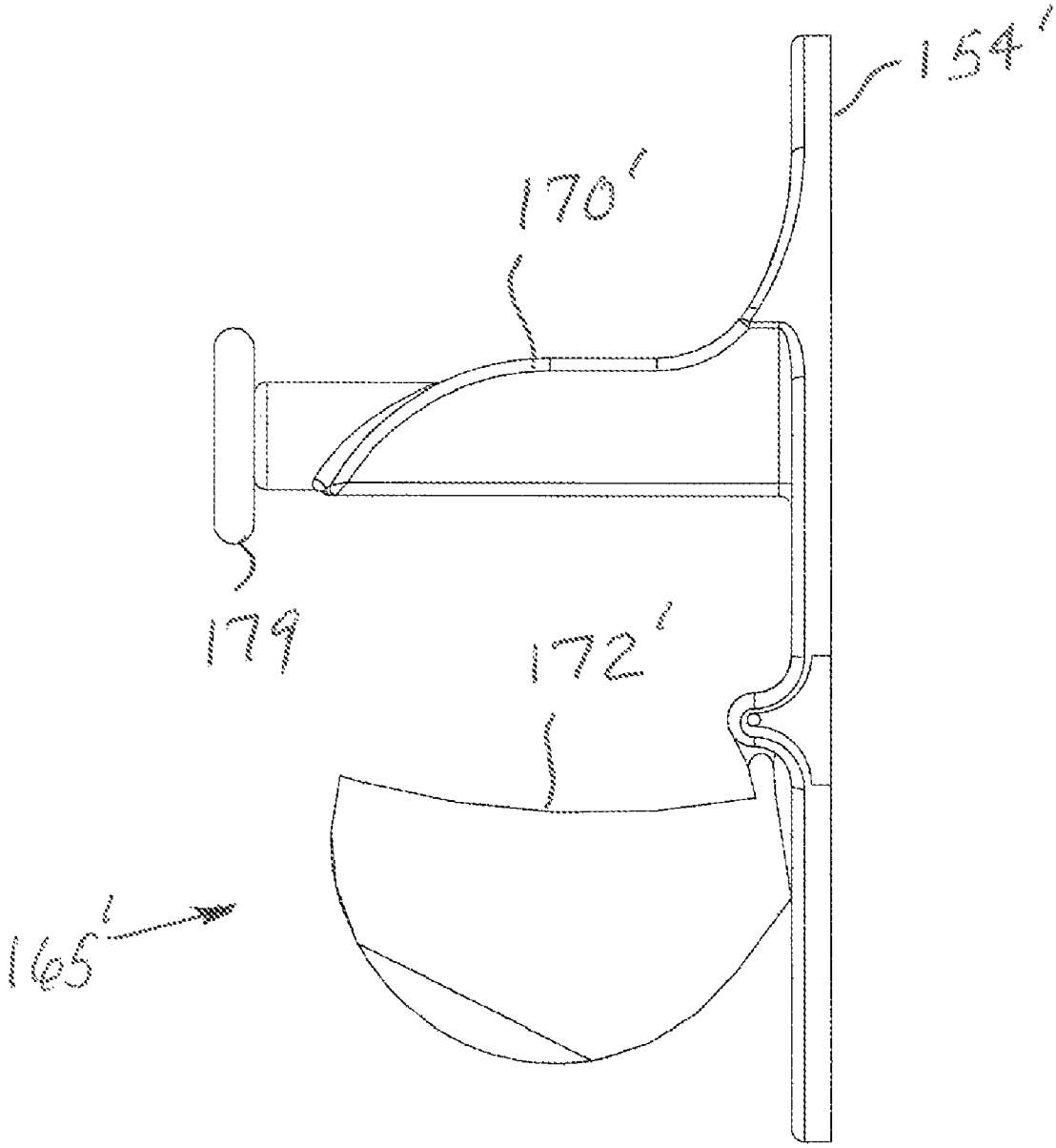
FIG. 48 is side elevation view of the fifth embodiment of the clamp assembly of FIG. 47.
Figure 49:
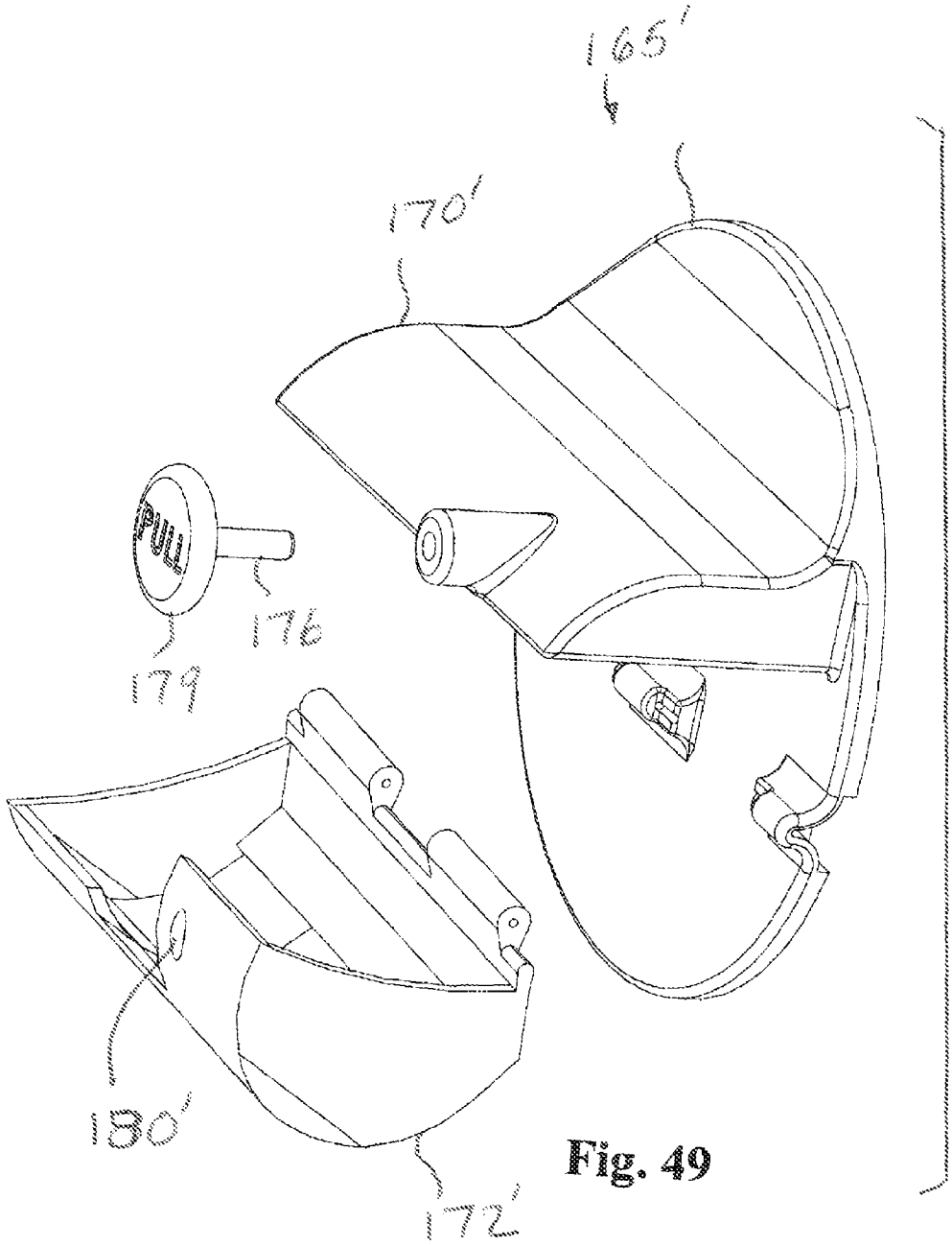
FIG. 49 is an exploded view of the fifth embodiment of the clamp assembly of FIG. 47.

Referring now most particularly to FIGS. 38-44, various aspects of the container carrier assembly 272 and the resilient mounting arrangement 206 shown in FIGS. 35-37 may be seen in more detail. This embodiment has a retainer slider 250 to releasably retain the container holder 298 to the carrier plate 274. The retainer slider has a distal end 252 with a projection 254 that engages a stirrup 256 formed on the container holder 298 when the container holder is received on the carrier plate 274. Slider 250 is preferably resiliently biased towards the center of the carrier plate 274 by a spring 258 to retain holder 298 when the holder 298 is pressed towards plate 274. The projection 254 of slider 250 preferably has a first ramp 260 angled to allow stirrup 256 to urge slider 250 out of the way when the holder 298 is moved towards plate 274, until the holder 298 is fully seated on carrier plate 274, at which time the projection 254 will engage a recess 262 in stirrup 256, as urged by spring 258 acting against a stop 262. Stop 262 may be a separate piece, as shown in FIG. 41, or stop 262' may be formed integrally with carrier plate 274', as shown in FIG. 45.

Referring now to FIGS. 46-49, a fifth embodiment of the clamp assembly 165' may be seen. In clamp assembly 165' a fixed portion 170' is rigidly secured to and may be formed integral with plate 154' and a hinged portion 172' is pivotably secured to plate 154'. A pin 176' is urged by a spring (not shown) to retain hinged portion 172' in the closed condition when the pin 176' is received in aperture 180'. Pulling on the enlarged head 179 of the pin 176' will retract the pin 176' from the recess or aperture 180' and allow the hinged portion 172' to move to the open condition.

Figure 50:
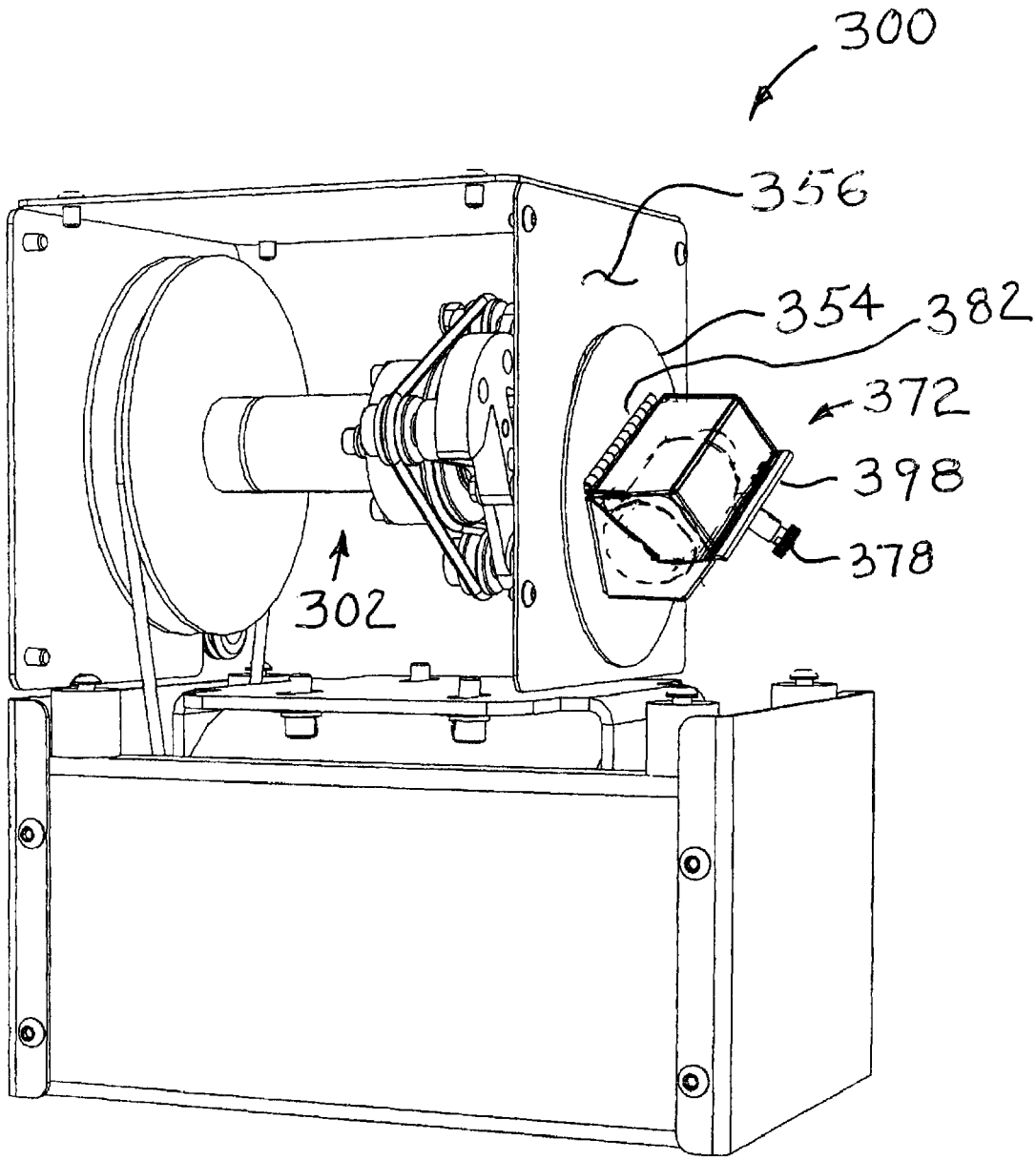
FIG. 50 is a perspective view of a still further alternative embodiment of the mixer of the present invention.

Referring now to FIG. 50, a further embodiment of the present invention may be seen. FIG. 50 is a perspective view of a mixer 300 useful in the practice of the present invention, similar, but not identical to the mixers shown and described infra. In this embodiment, mixer 300 is similar in many respects to the embodiments of mixer 30 described above. For example, drive connection 302 between the drive shaft and a driven assembly 304 for mixer 300 may be identical to drive connection 202 for mixer 200. (The supporting wall for the drive connection in FIG. 50 is omitted for clarity). One difference, however, is (referring also to FIG. 51) that mixer 300 has a pair of triangular spiders 308, 374 replacing plates 208 and 274 (see FIG. 31). Spider 308 serves as the base carrier 52 in this embodiment. Mixer 300 also differs from mixer 30 by having a somewhat different resilient mounting arrangement 306 (shown in FIG. 53) for the follower spider 308 (corresponding to follower plate 208). Also, it may be seen in FIGS. 50 and 54-60, that a container carrier assembly 372 includes an alternative embodiment of a container holder 398, which may be mounted on a plate 354, which, in this embodiment provides protection against user contact with rotating parts on the other side of wall 356.

Figure 31:
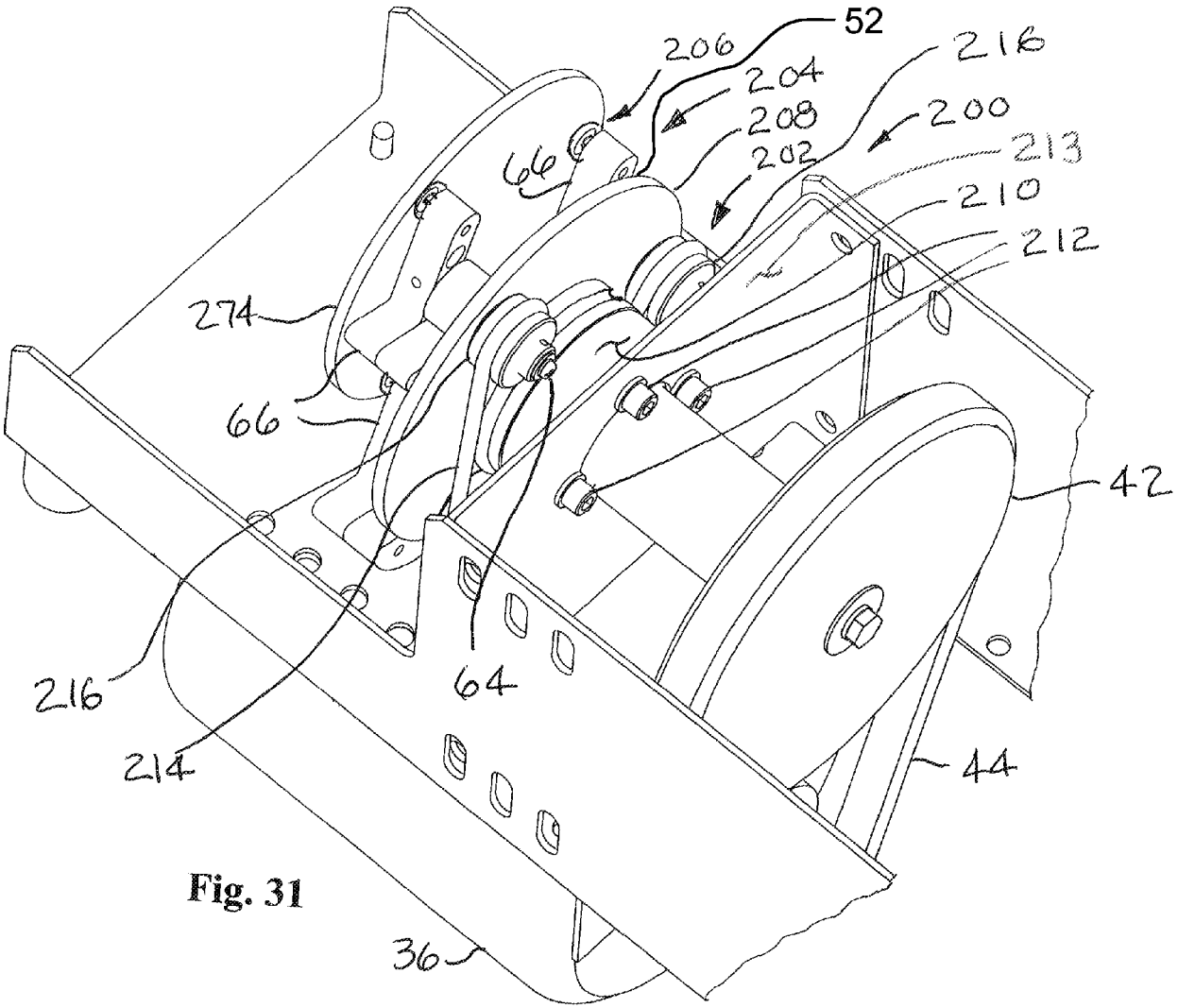
FIG. 31 is a simplified fragmentary perspective view of an alternative embodiment of the mixer useful in the practice of the present invention.
Figure 32:
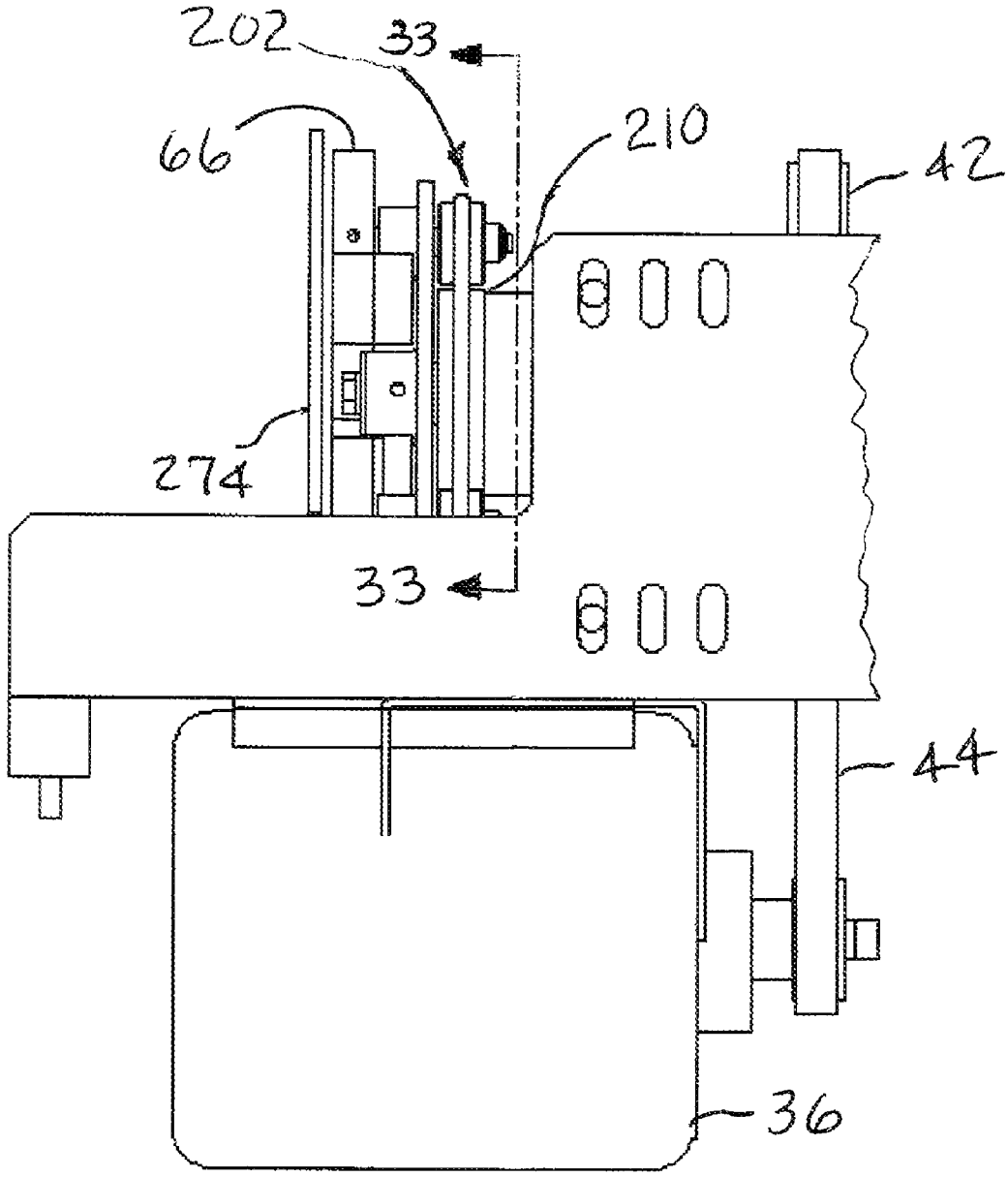
FIG. 32 is a simplified fragmentary side view of the mixer of FIG. 31.
Figure 33:
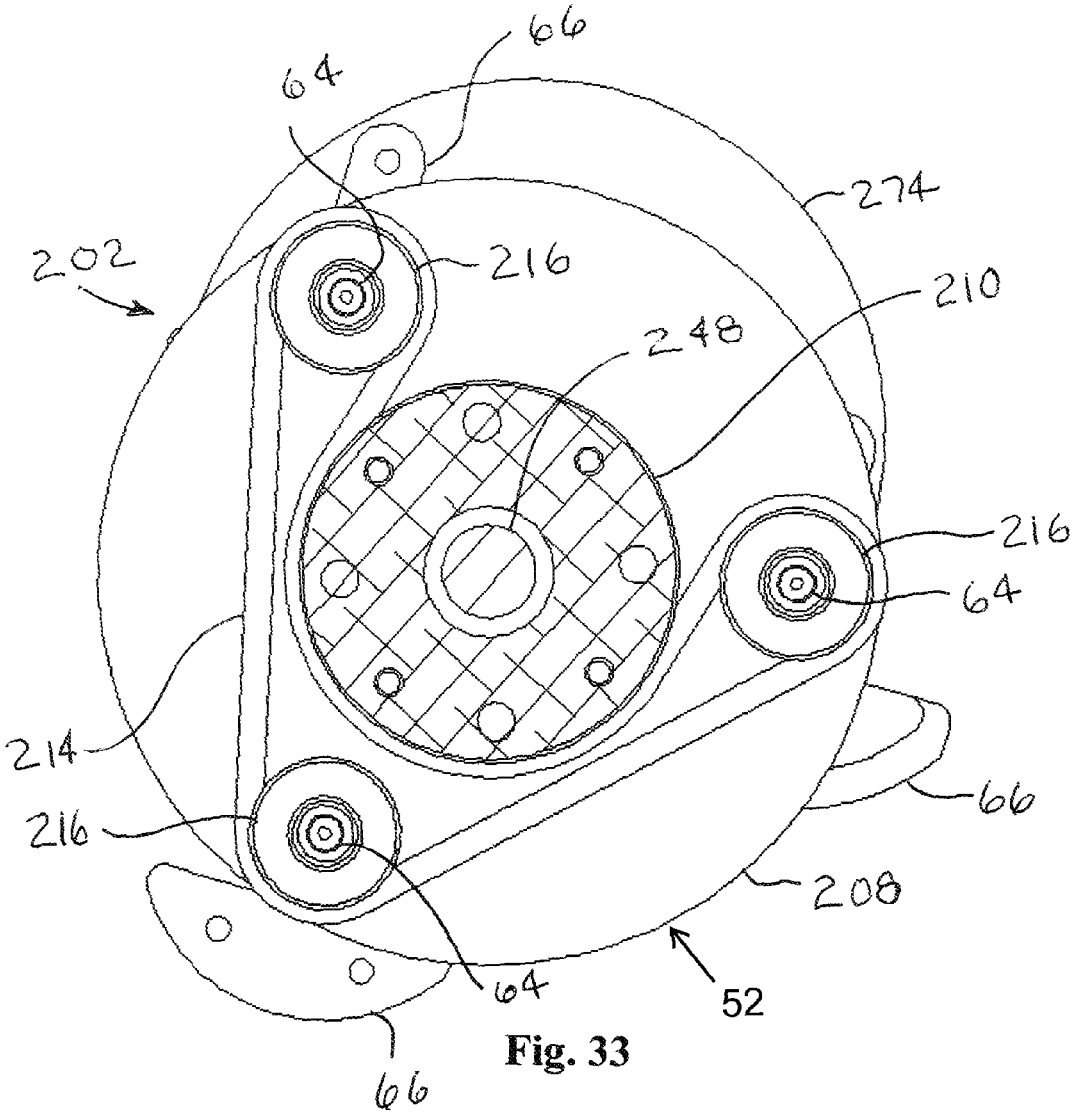
FIG. 33 is an end elevation view of rotating parts of the mixer of FIG. 31, taken along line 33-33 in FIG. 32.
Figure 34:
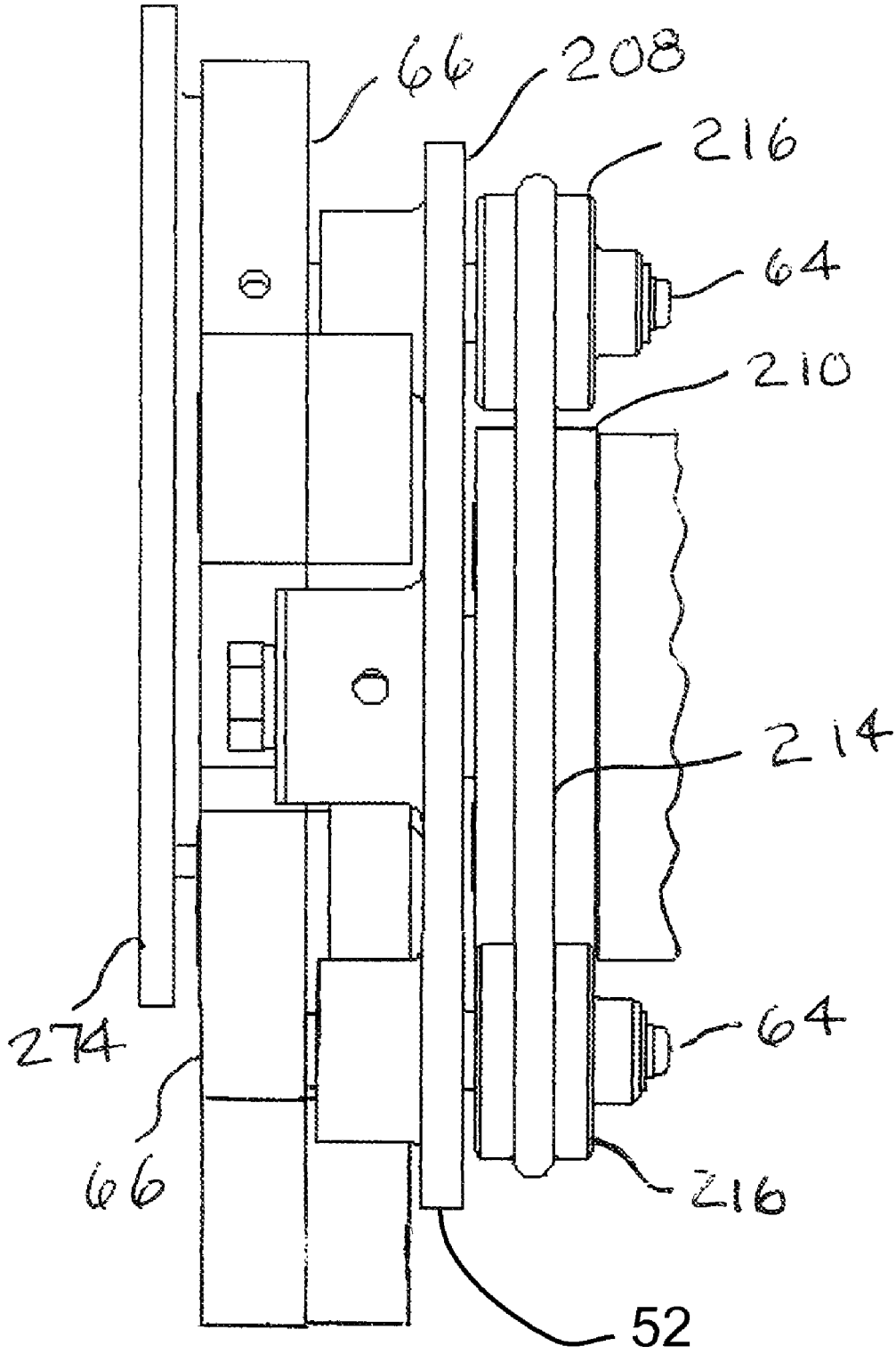
FIG. 34 is a side elevation view of the parts shown in FIG. 33.
Figure 51:
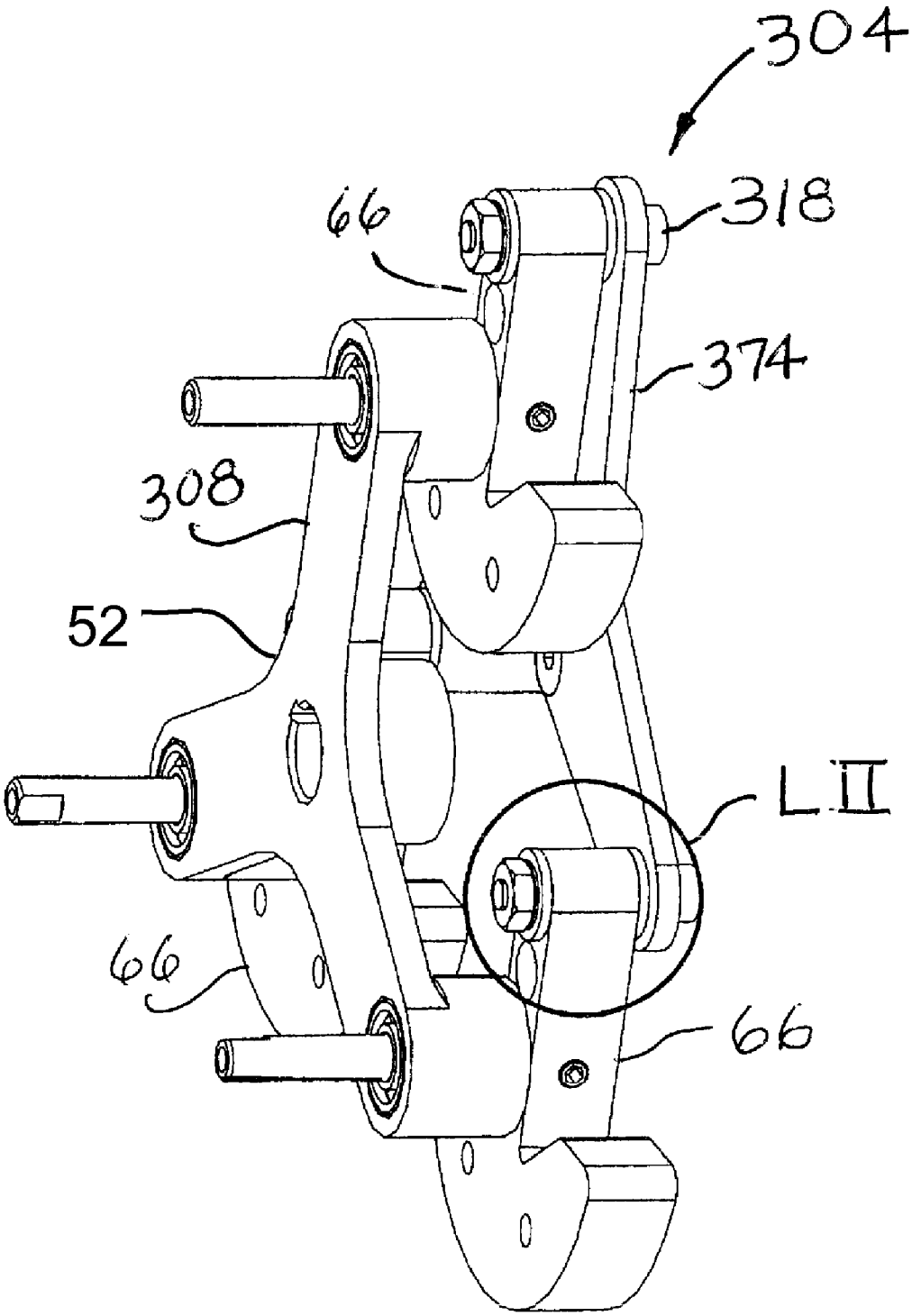
FIG. 51 is a perspective enlarged view of a rotating assembly from FIG. 50 useful in the practice of the present invention.

Referring now most particularly to FIG. 51, the assembly 304 operates the same as assembly 204, shown in FIG. 31, it being understood that the planet or satellite rollers 216 are omitted in FIG. 51.

Figure 52:
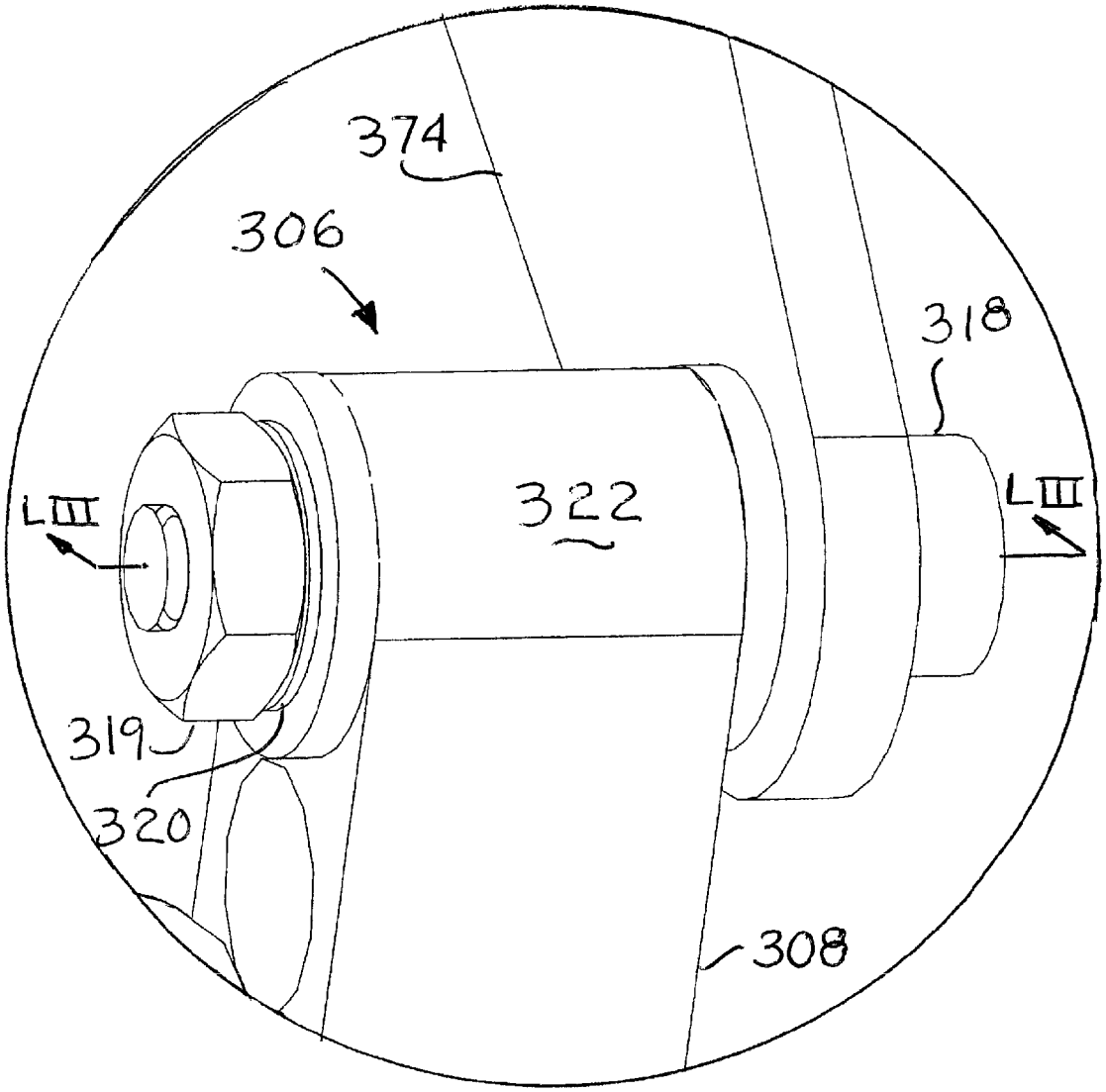
FIG. 52 is an enlarged detail view LII from FIG. 51.
Figure 53:
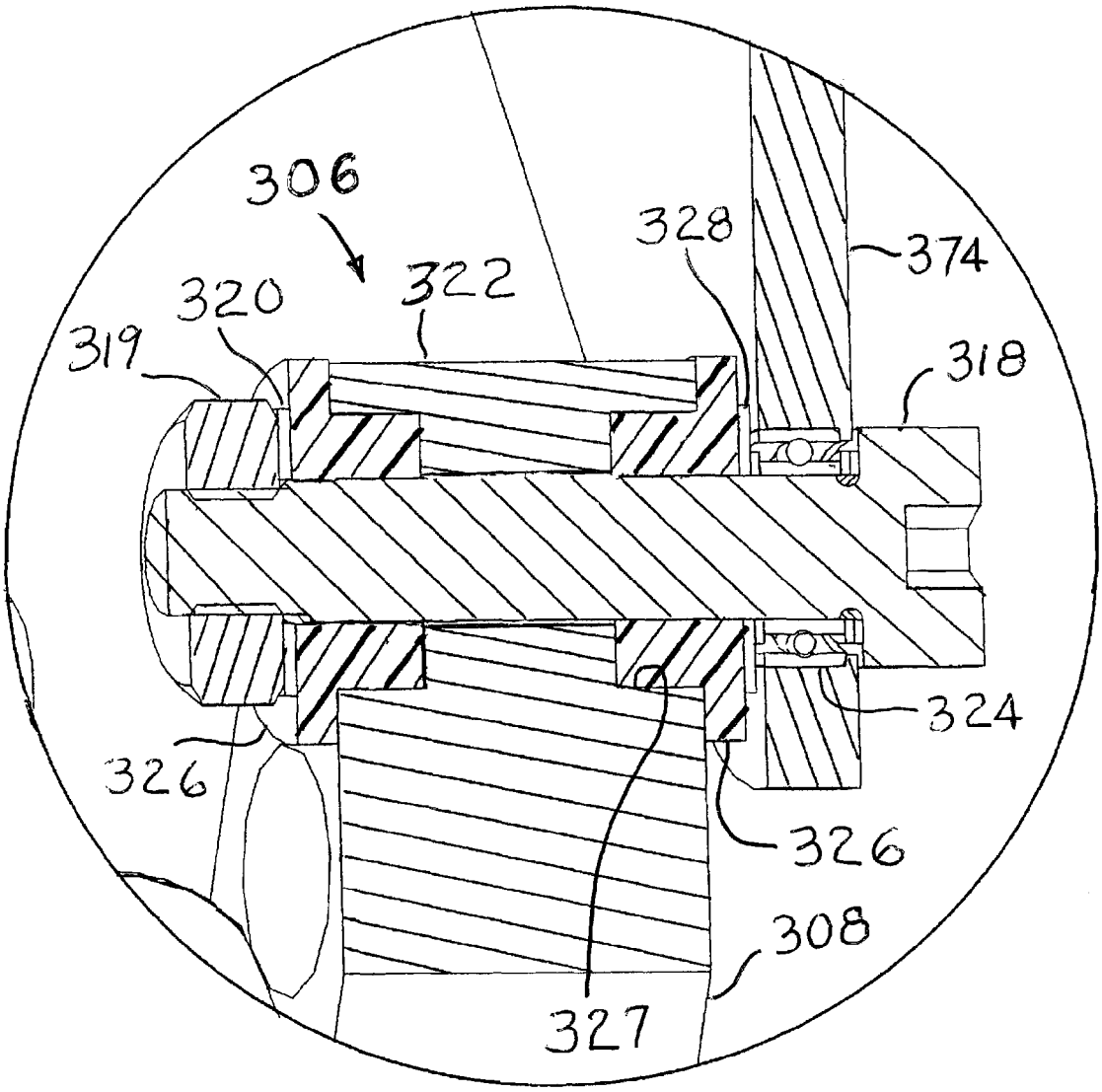
FIG. 53 is a an enlarged detail view corresponding to that of FIG. 52, except showing a section view along line LIII-LIII of FIG. 52.
Figure 54:
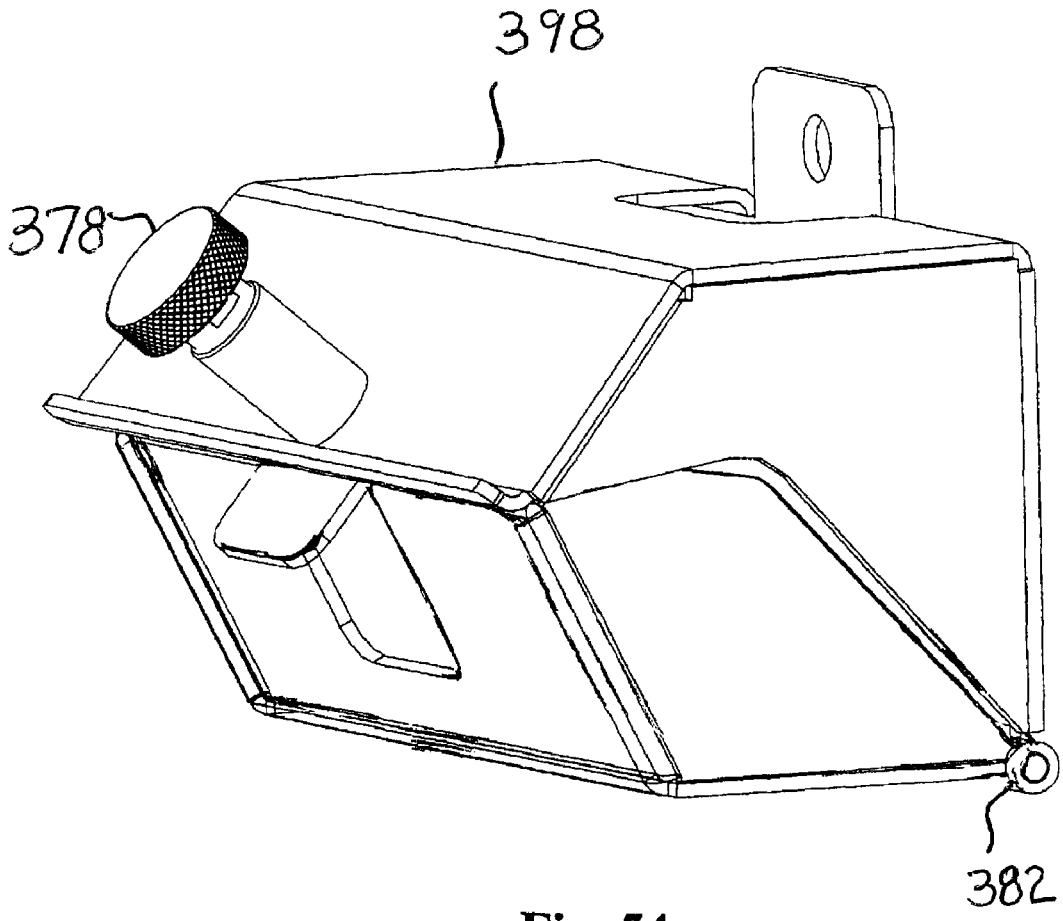
FIG. 54 is a perspective view of a sixth alternative embodiment of the clamp assembly from FIG. 50 useful in the practice of the present invention.
Figure 55:
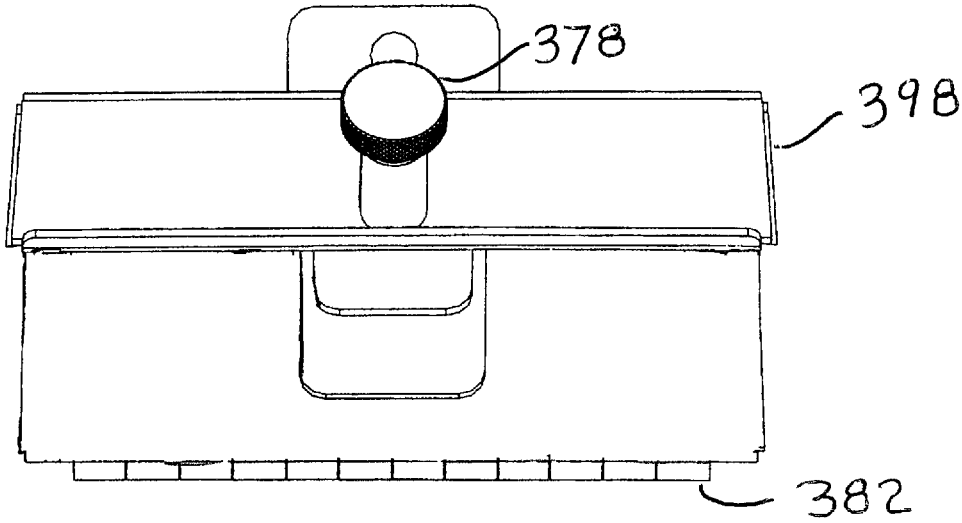
FIG. 55 is a front elevation view of the clamp assembly of FIG. 54.

Referring now also to FIGS. 52 and 53, details of the resilient mounting arrangement 306 may be seen. Although there are three arrangements 306, one at each radial end of the spider 308, only one will be described here, since all three are preferably identical. A cap screw or shoulder bolt 318, together with a nut 319 and washer 320 secures one leg of spider 318 to an end 322 of crank arm 66 of the drive member connecting the base carrier to the container carrier assembly. A conventional antifriction bearing 324 is located between bolt 318 and carrier spider 374. A pair of resilient bushings 326 are located between bolt 318 and a stepped bore 327 through the end 322 of the follower spider 308. A washer 328 may be located between the spider 308 and the spider 374. The resilient mounting arrangement 306 accommodates radial or angular misalignment, or both, (if any) between the follower spider 308 and the carrier spider 374 (that is, between the base carrier 52 and the container carrier assembly 72 which may be part of or mounted to spider 374).

Figure 56:
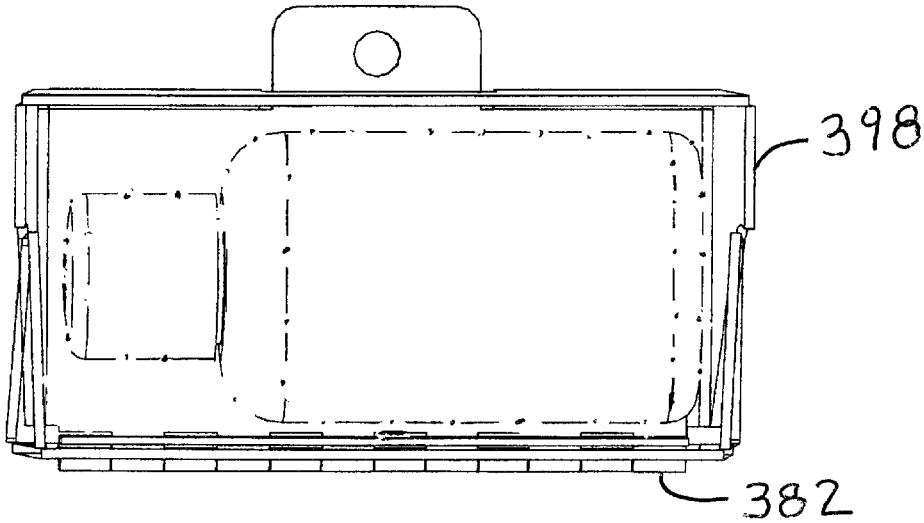
FIG. 56 is a simplified front elevation view of the clamp assembly corresponding to FIG. 55, except showing a container with ingredients to be mixed in phantom within the clamp assembly.
Figure 57:
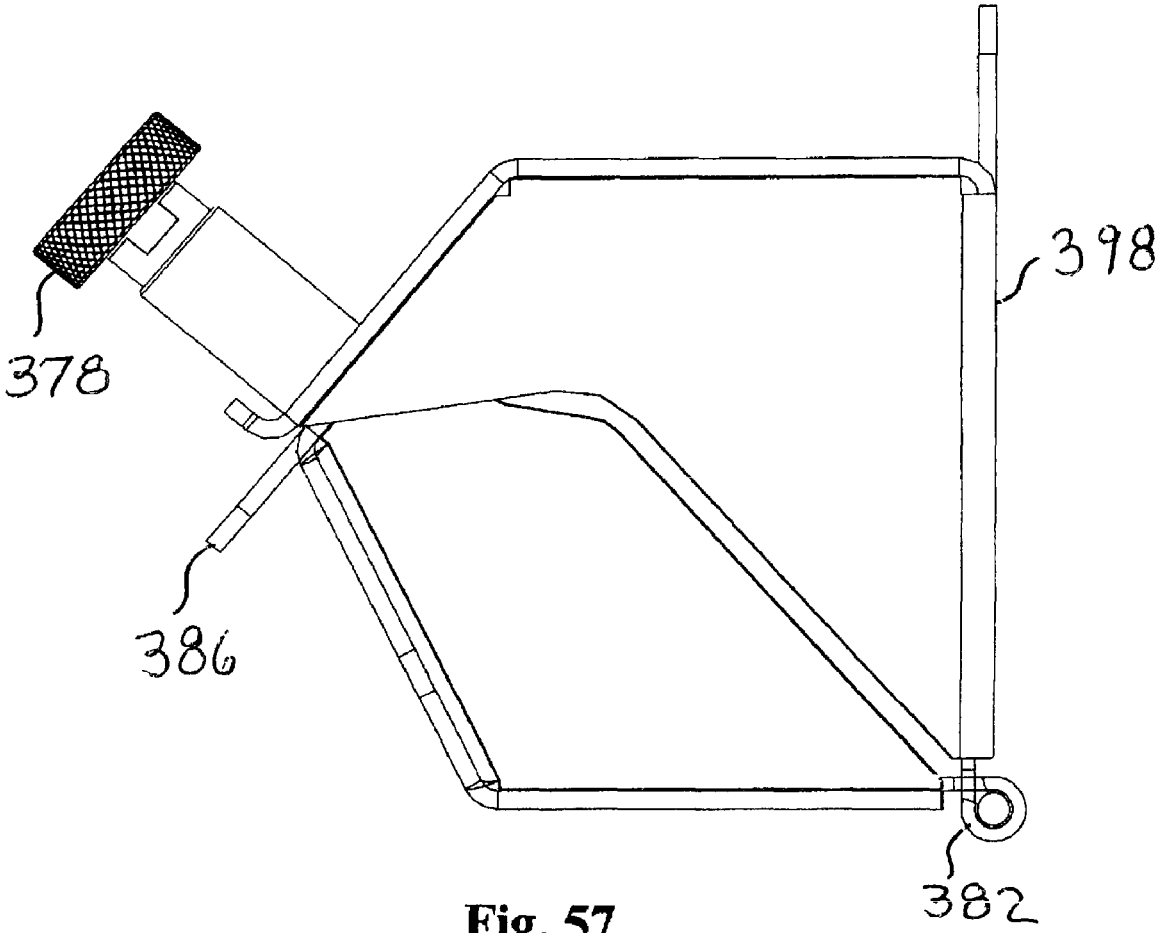
FIG. 57 is a side elevation view of the clamp assembly of FIG. 54, shown in a closed condition.
Figure 58:
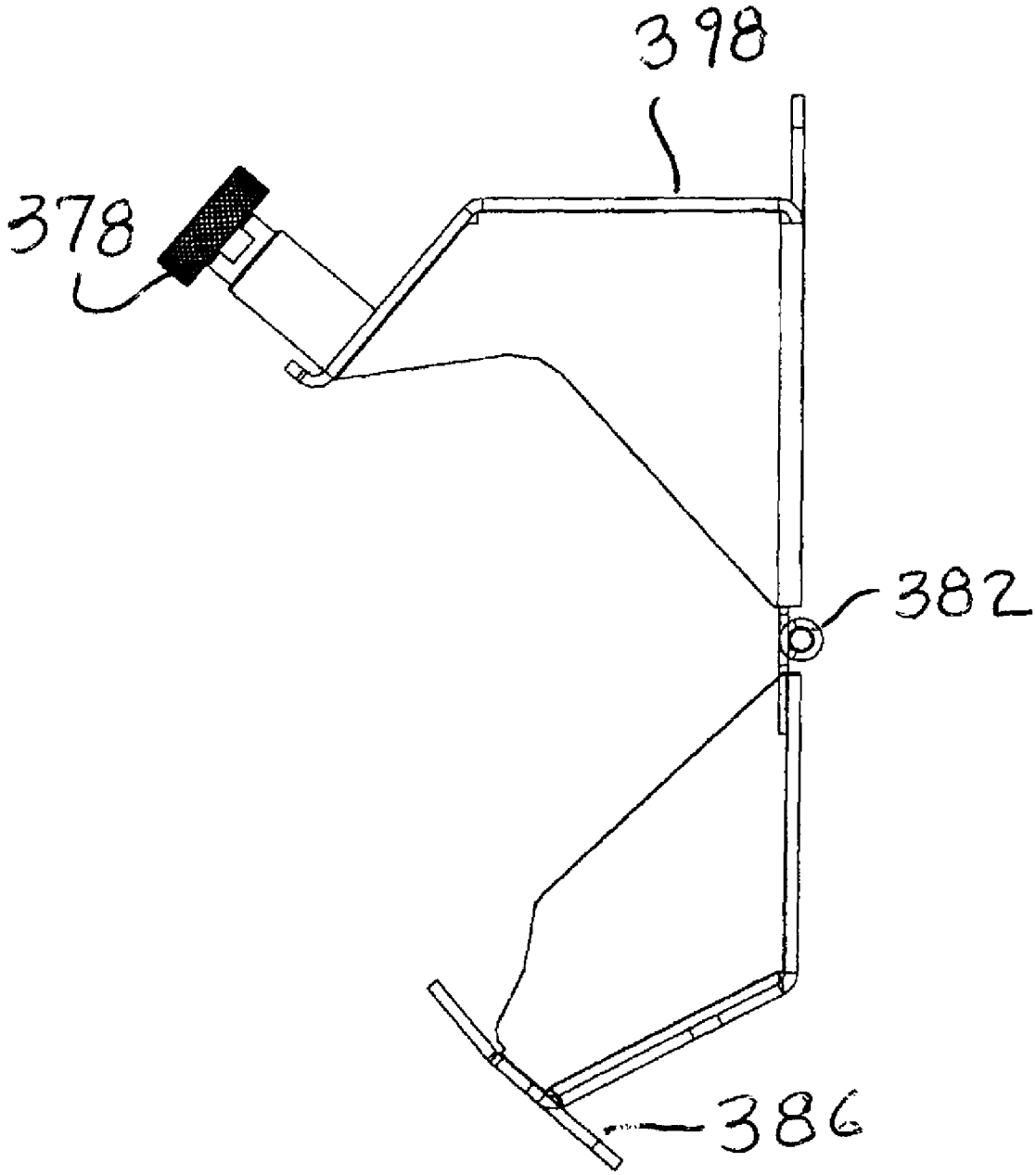
FIG. 58 is a side elevation view corresponding to FIG. 57, except with the clamp assembly shown in an open condition.
Figure 59:
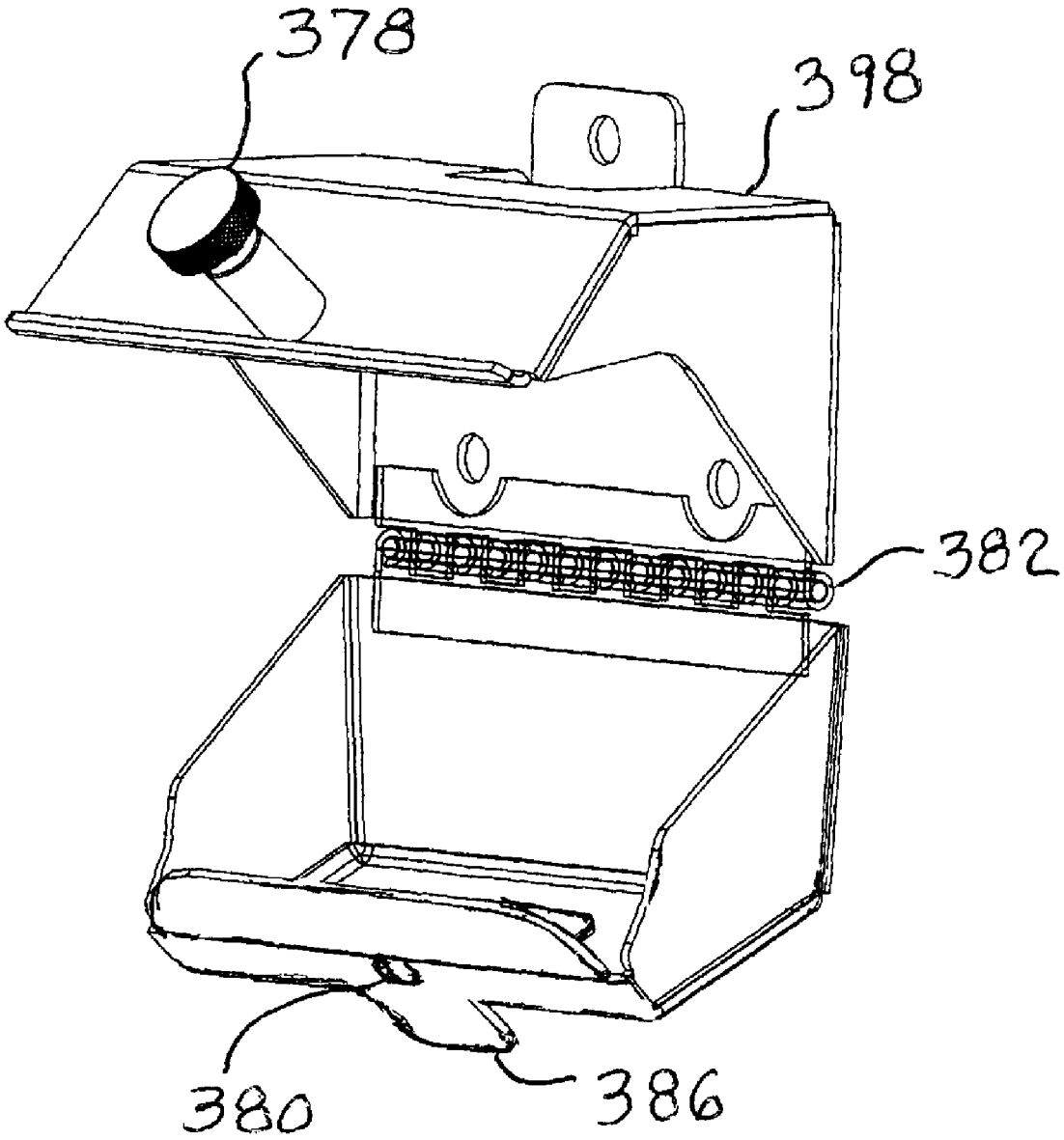
FIG. 59 is a first perspective view of the clamp assembly of FIG. 54 shown in an open condition.
Figure 60:
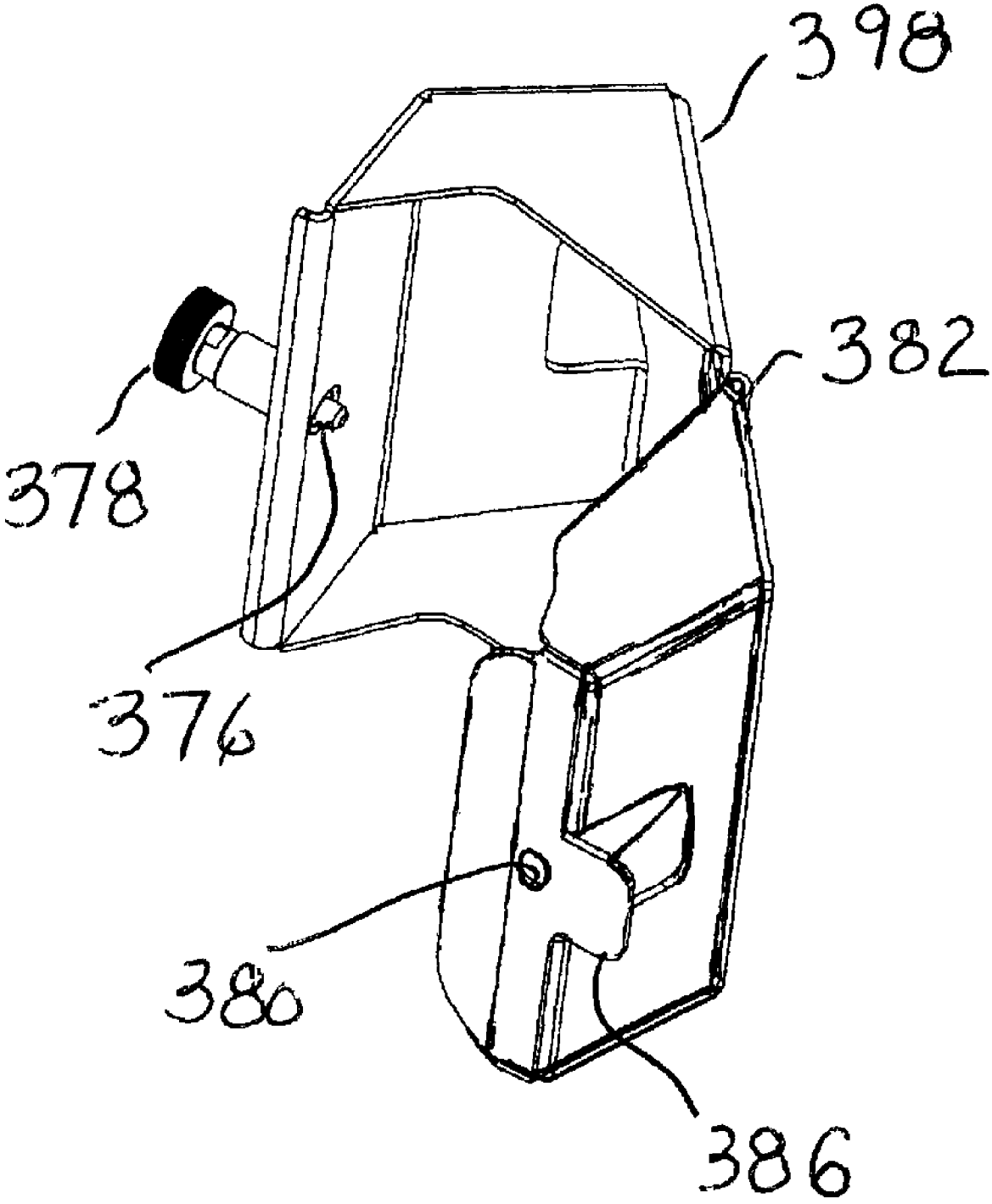
FIG. 60 is a second perspective view of the clamp assembly of FIG. 54 shown in the open condition, to illustrate further details thereof.

Turning now to FIGS. 54 through 60 in addition to FIG. 50, a sheet metal embodiment of a portion of container carrier assembly 374 made up of a container holder 398 and plate 354 corresponds generally to the clamp assembly 165' shown in FIGS. 46-49. In FIGS. 50 and 56, a container is shown in phantom to illustrate one example of how the assembly 374 would hold a container for mixing. Although not shown in FIGS. 54-60, assembly 374 may contain a foam or other type of resilient or cushioning insert similar to that shown in FIG. 26 to cradle the container therein during mixing. A pin 376 (visible in FIG. 60) is connected to a knob 378 and is biased to the position shown in FIG. 60, but movable by an operator to retract pin 376 from an aperture or recess 380 in a movable part of the container holder, to allow the container holder to move between the open and closed conditions, as shown in these Figures. Hinge 382 permits such movement to allow access by a user to the interior of container holder 398 to insert a container for mixing, and to allow retrieval of the container after mixing. A projection or tab 386 allows a user to easily move the lower part of the container holder 398 when released by pin 376.

It is to be understood that the resilient mounting arrangement of the present invention may be embodied in other forms, such as a rubber grommet to house a bearing. Some examples of such a resilient mounting arrangement include, but are not limited to, a molded rubber "center bushing mount" with, e.g., a bronze insert, or a molded rubber "center bushing mount" with a molded in bearing (either of the sleeve or antifriction type), or a rubber form molded directly to the follower plate and carrying a bearing or bushing, none of which are shown, but which are to be understood to be within the scope of the resilient mounting arrangement hereof. Another alternative is to place the rubber or other resilient member radially inward of the bearing.

Figure 61:
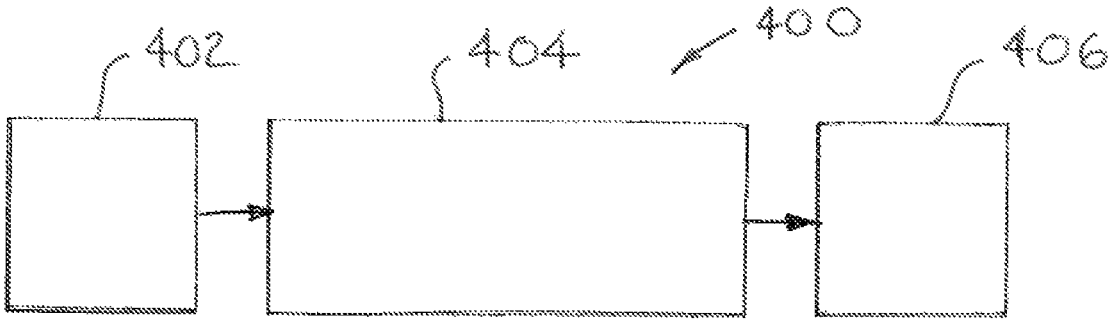
FIG. 61 is a first block diagram showing an arrangement according to one embodiment of the present invention.

Referring now to FIG. 61, a first block diagram 400 may be seen showing one arrangement for practicing the present invention. This arrangement corresponds to the above described embodiments in each of which a single motor 402 drives a transmission section 404 carrying a container holder 406 for the material to be mixed.

Figure 62:
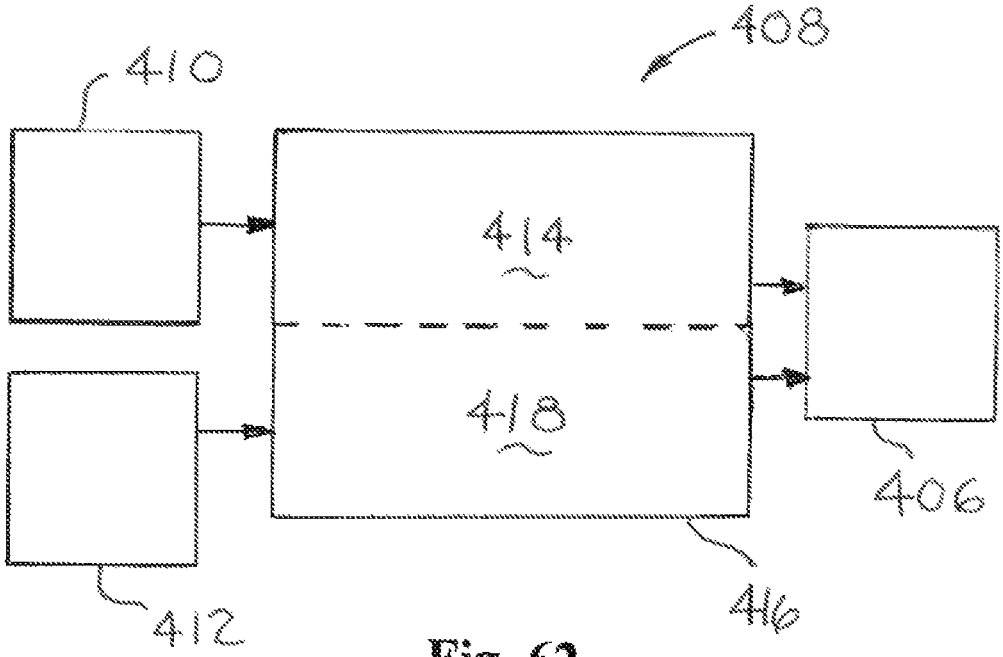
FIG. 62 is a second block diagram showing an arrangement of an alternative embodiment of the present invention.

FIG. 62 shows a second block diagram 408 showing another arrangement for an alternative embodiment of the present invention in which separate motors 410 and 412 may be used. Motor 410 provides tumbling motion through a tumble portion 414 of a transmission section 416, and motor 412 provides shaking motion through a shake portion 418 of the transmission section 416. Having separate motors allows independent speed control of the motors to selectively alter the relationship between the tumbling and shaking motion. In addition, reversing the direction of rotation of one of the motors can easily be accomplished, further altering the tumbling and shaking motion of the container holder 406. With the embodiment of FIG. 62, it is within the scope of the present invention (in one mode) to predetermine the relationship of the speeds of the two motors 408 and 410, and to operate the motors at the predetermined relationship for the duration of mixing, but to alter the relationship to mix different materials or different containers. Also with the embodiment of FIG. 62, it is within the scope of the present invention (in another mode) to alter the relationship of the speeds of the motors during a particular mixing operation, thus varying the tumbling and shaking motion for a particular material in a given container while a mixing cycle is taking place. In this mode, one motor may be stopped for part of a mixing cycle, or reversed for part of a mixing cycle, to vary the tumbling and shaking motion. It may thus be seen that the position, speed, and acceleration of the container holder 406 may be varied as desired during mixing using either of the arrangements shown in block diagrams 400 or 408.

Figure 63:
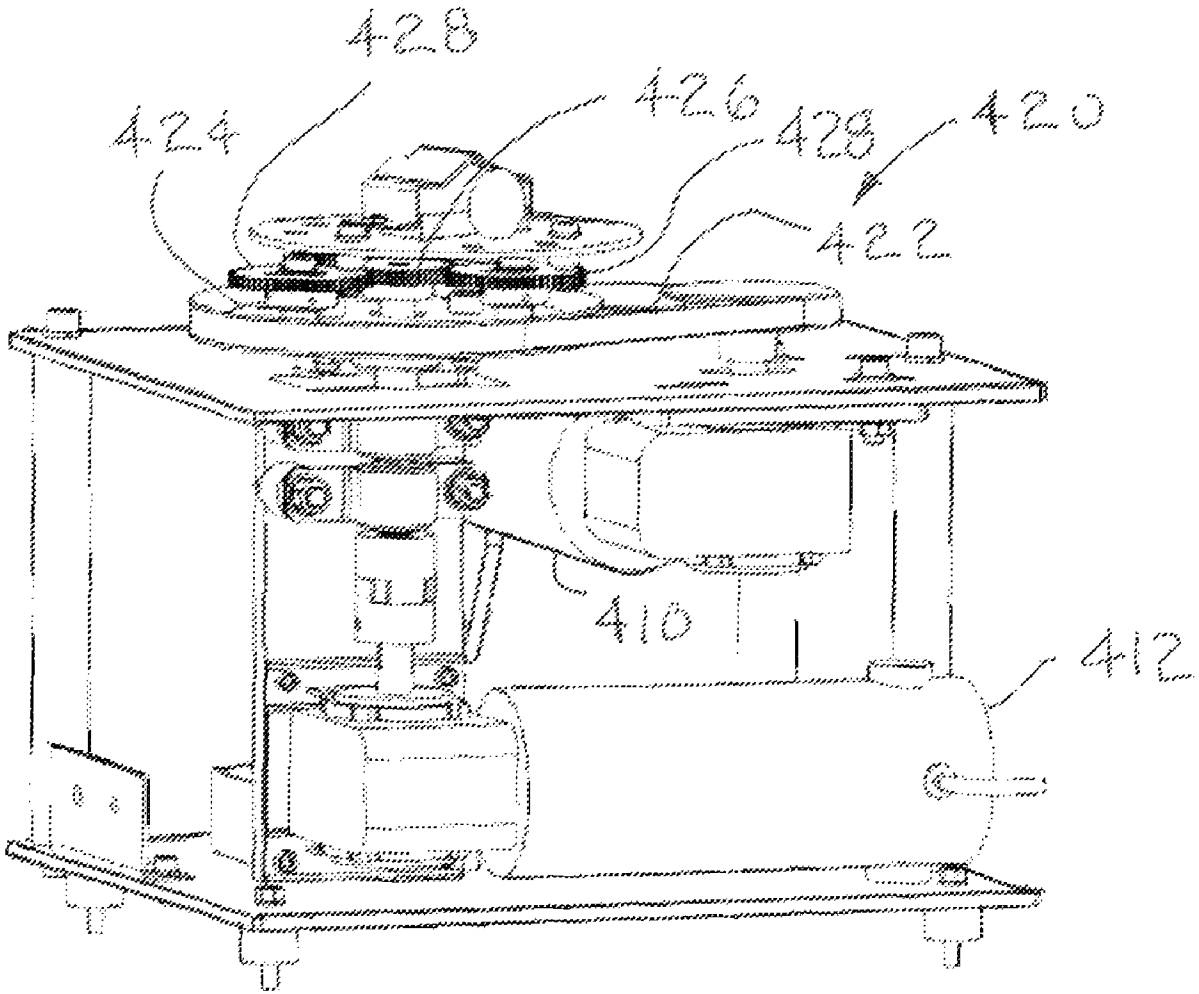
FIG. 63 is a perspective view of an embodiment according to the block diagram of FIG. 62.

FIG. 63 shows an embodiment 420 corresponding to block diagram 408 and includes motor 410 to provide independent control of the "tumble" motion, and motor 412 to provide independent control for the "shake" motion. It is to be understood that embodiment 420 has separate conventional speed controls (not shown) to independently adjust the speeds of motors 410 and 412. Motor 410 drives a belt 422 which causes rotation of the base carrier (in the form of a carrier plate 424) to provide the "tumble" motion. Motor 412 drives a sun gear 426 which, in turn, drives three planet gears 428 to provide the "shake" motion.

Figure 64:
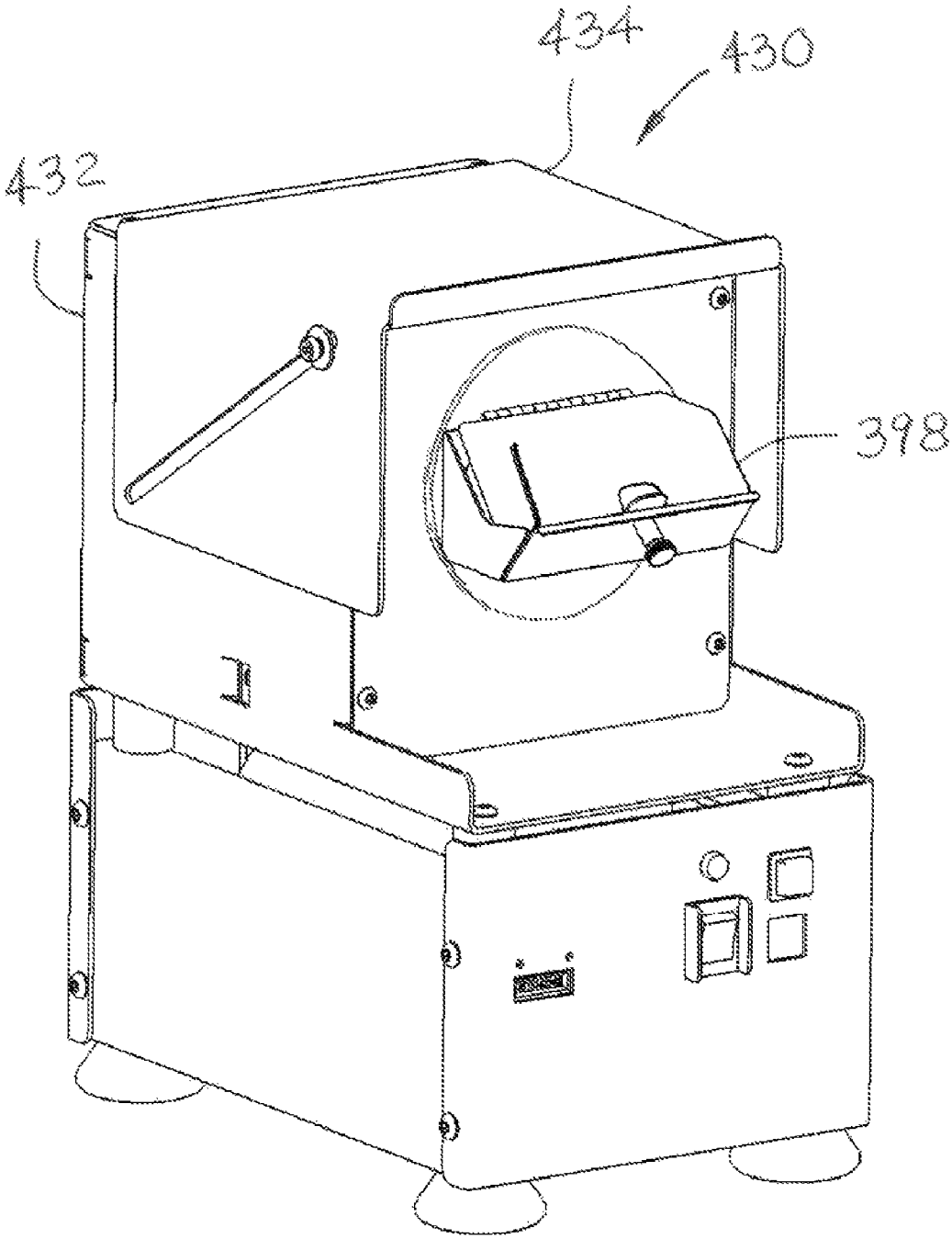
FIG. 64 is a perspective view of a still further embodiment of the mixer of the present invention.

Referring now to FIG. 64, a perspective view of a further embodiment 430 of the mixer of the present invention may be seen. Embodiment 430 corresponds to the block diagram of FIG. 61 in that only one motor is used to provide both tumble and shake motions. This embodiment shows the container holder 398 shown in FIG. 54 et seq., although it is to be understood that another, alternative, container holder may be used. In this view, a housing 432 is provided for the mixer 430, and a movable cover 434 is shown in an OPEN condition, giving access to the container holder 398.

Figure 65:
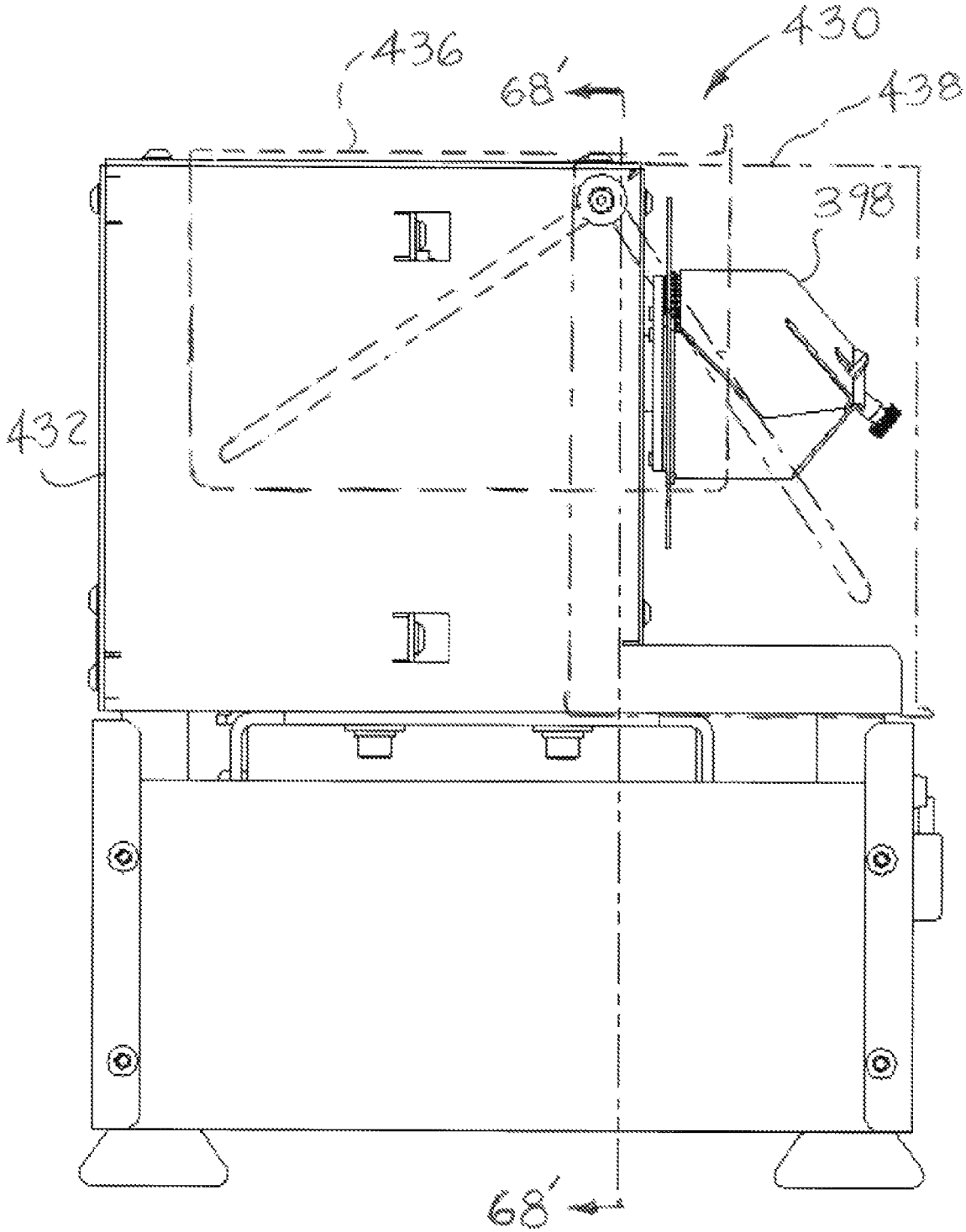
FIG. 65 is a side elevation view of the mixer of FIG. 64.

Referring now also to FIG. 65, a side view of mixer 430 is shown, with the OPEN position of cover 434 shown by dashed line 436 and a CLOSED position for cover 434 shown by chain line 438.

Figure 66:
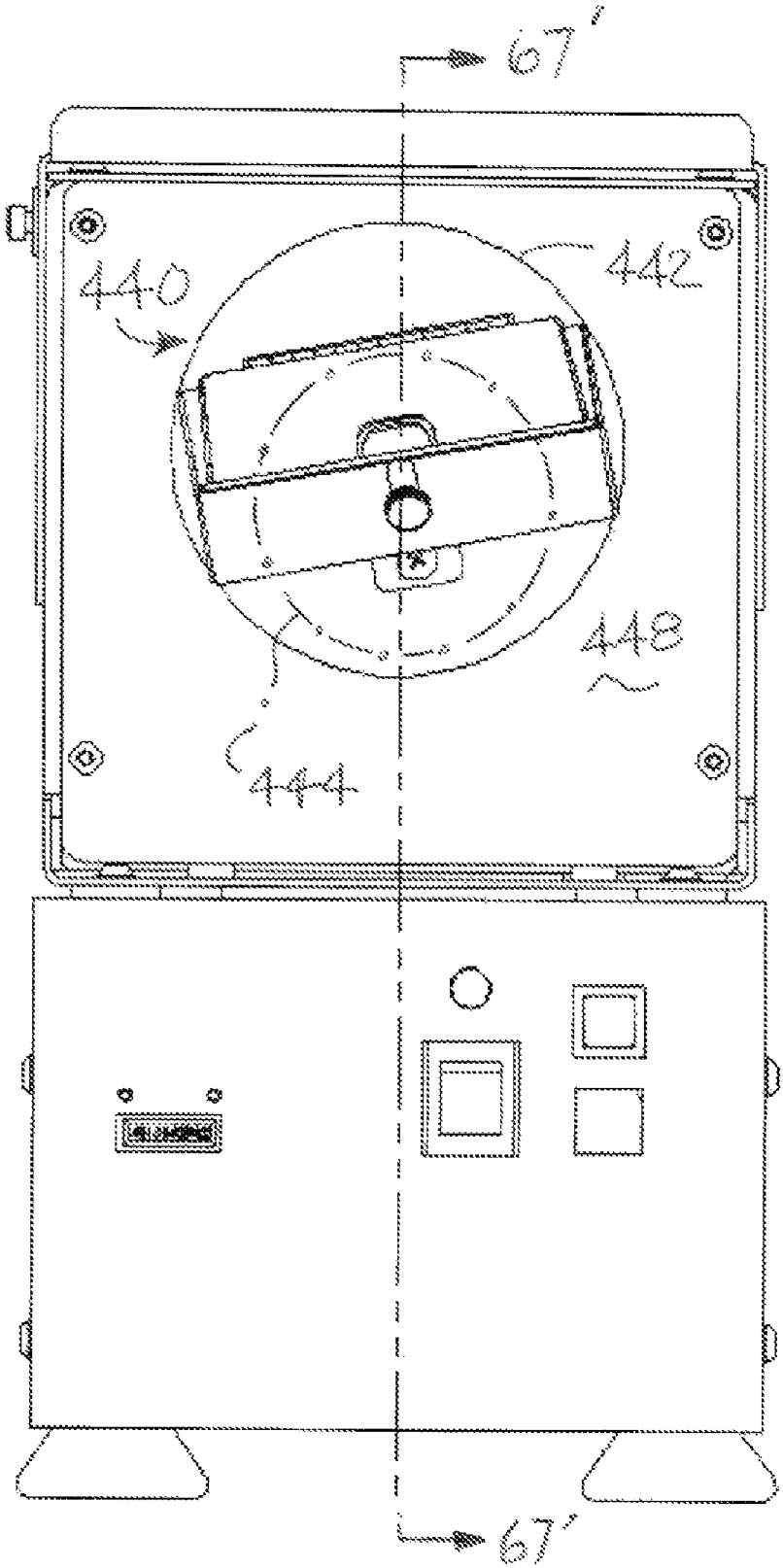
FIG. 66 is a front elevation view of the mixer of FIG. 64.
Figure 67:
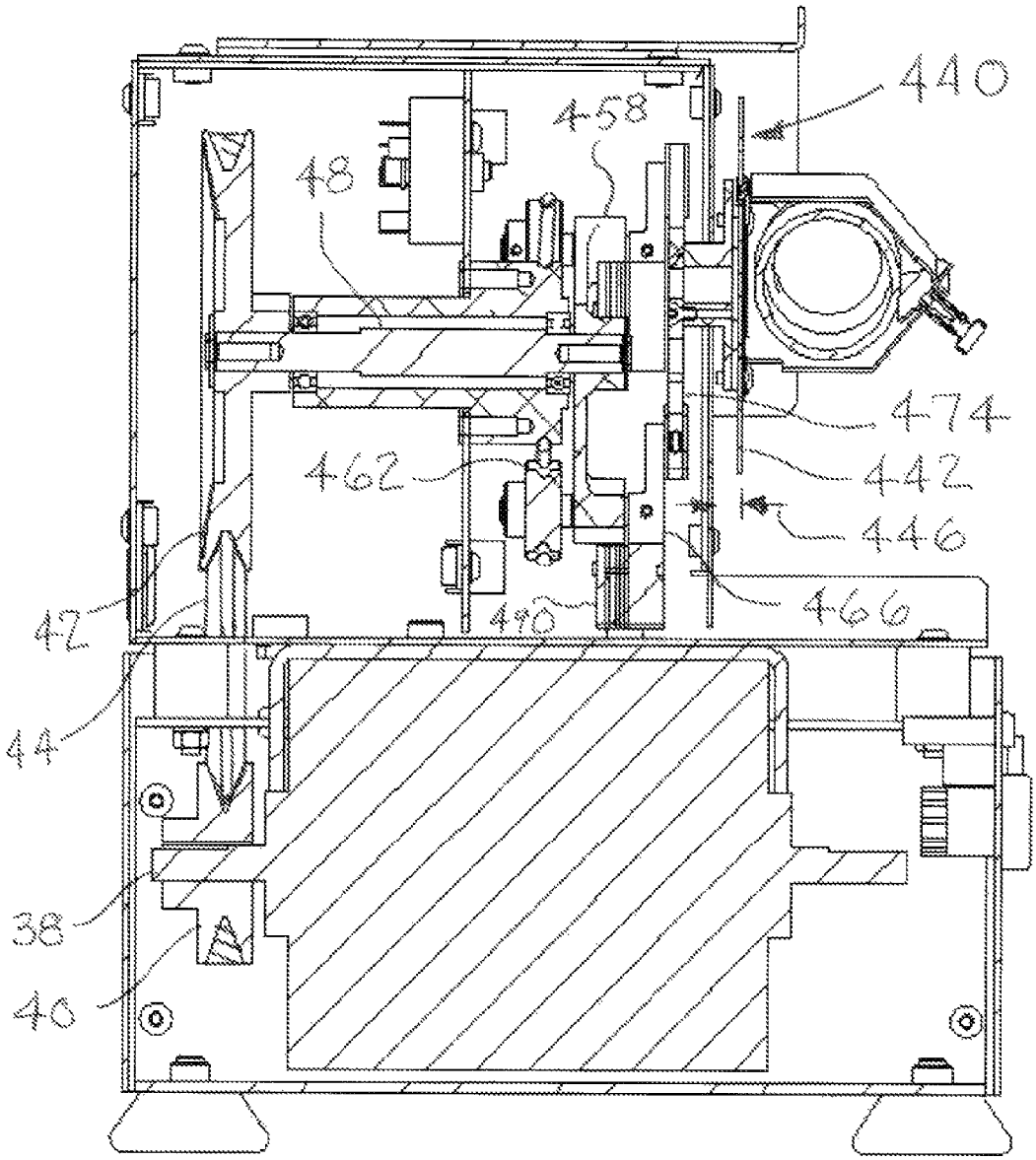
FIG. 67 is a side elevation section view of the mixer of FIG. 64, taken along line 67'-67' of FIG. 66.

FIG. 66 shows a front elevation view of the mixer 430. FIG. 67 shows a simplified section view of this embodiment 430. Referring to FIGS. 64-67, a shield 440 is provided in the form of a disk 442 to cover an opening 444 in the housing 432. Disk 442 of shield 440 is spaced a predetermined distance 446 away from a front panel 448 of housing 432 to both cover the opening and to block entry of a user's fingers into the interior of housing 432 through the opening 444. It is to be understood that the distance 446 is selected to be small enough to prevent finger entry between the disk 442 and the front panel 448, and large enough to provide sufficient clearance to avoid contact between the moving parts (including disk 442) and the front panel 448.

Figure 68:
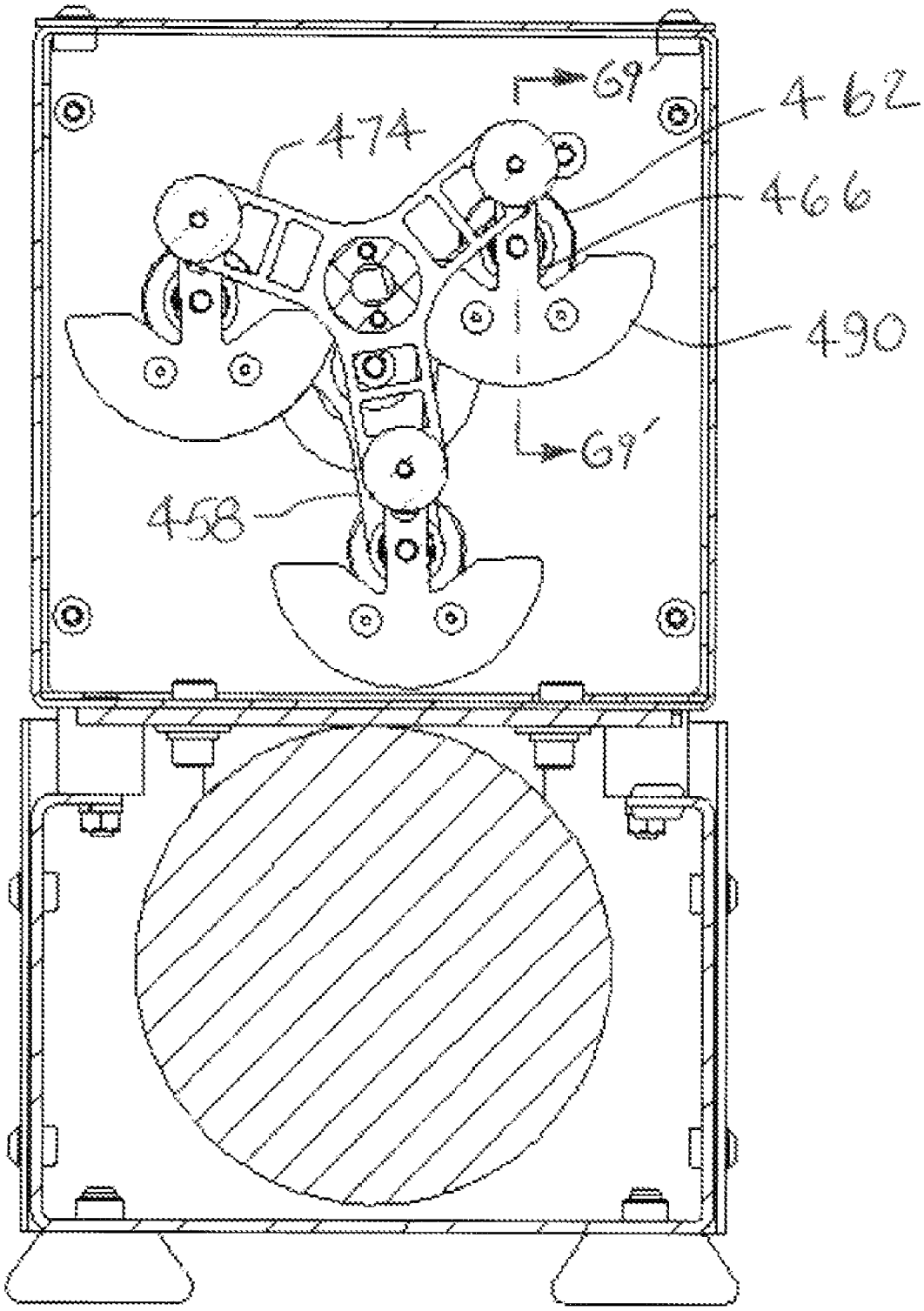
FIG. 68 is a front elevation section view of the mixer of FIG. 64 taken along line 68'-68' of FIG. 65.
Figure 69:
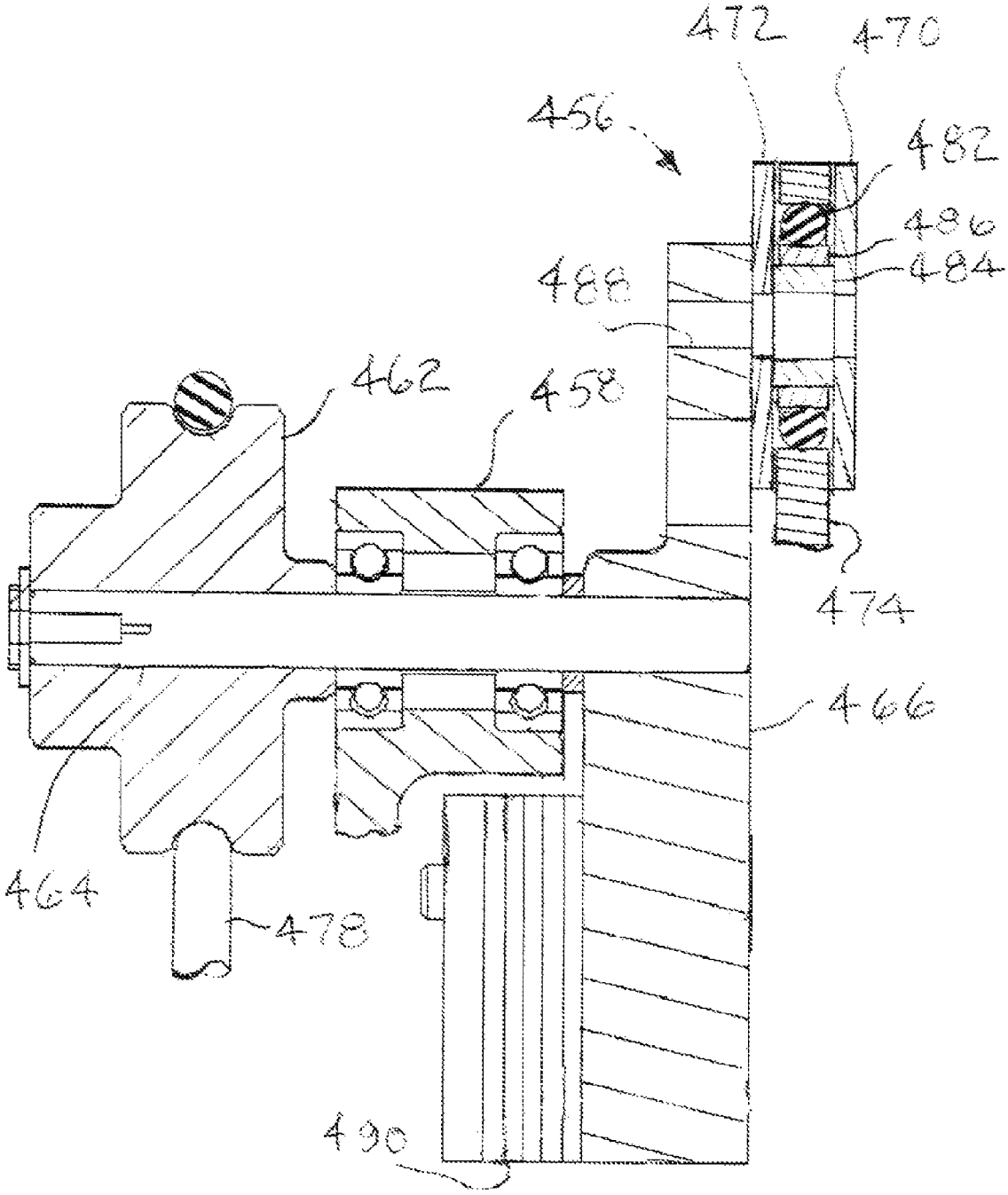
FIG. 69 is an enlarged section view of a planet subassembly of the mixer of FIG. 64, taken along line 69'-69' of FIG. 68.

Referring now to FIGS. 68 and 69, various details of the crank arms 466 (of the drive members of this embodiment), carrier spider 474, planet pulleys 462 and resilient mounting arrangement 456 for the embodiment 430 may be seen.

Figure 70:
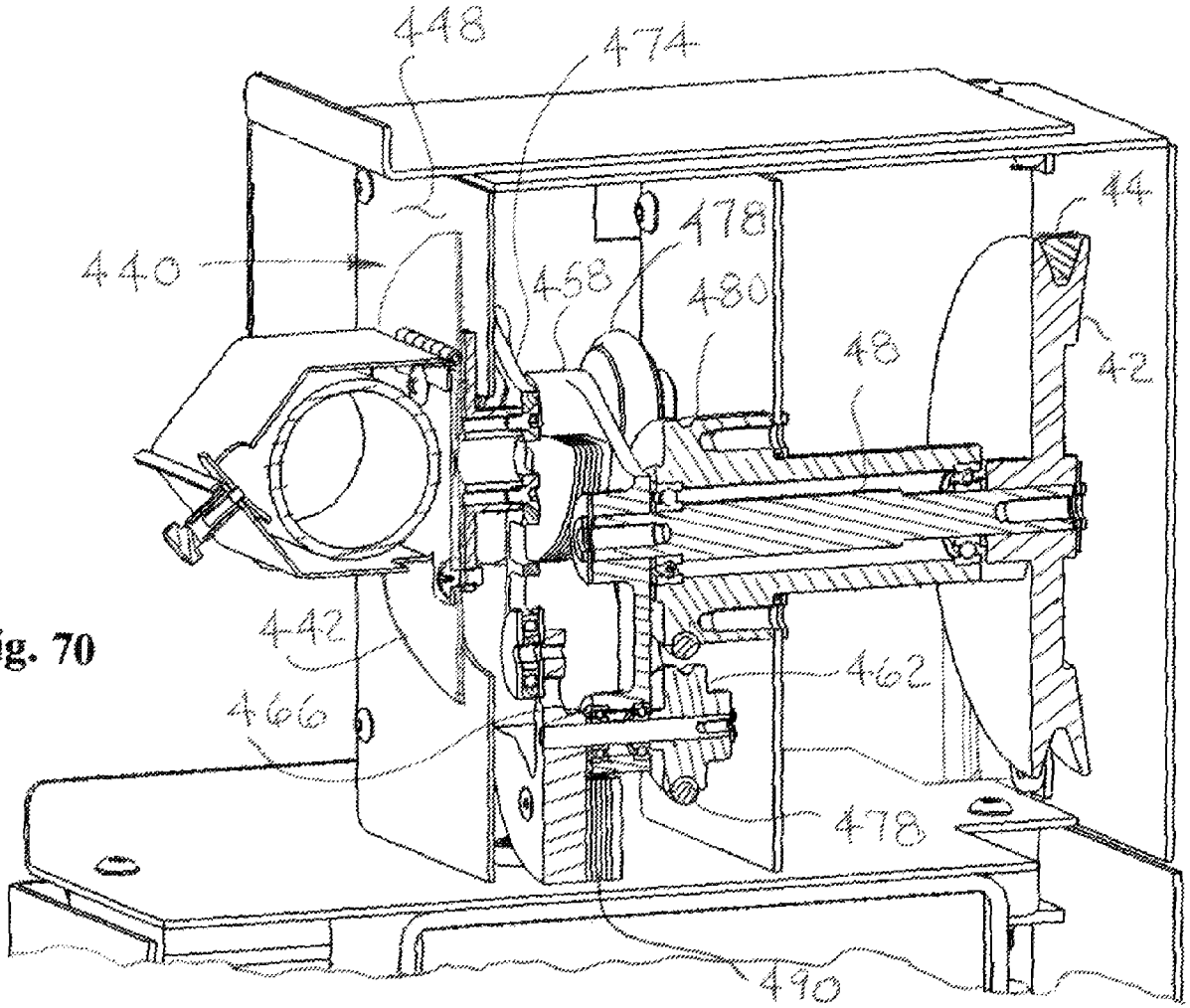
FIG. 70 is a perspective view in section of a portion of the mixer of FIG. 64 to illustrate further aspects of the present invention.

FIG. 70 shows a perspective view of a portion of mixer 430 to better illustrate certain features of this embodiment of the present invention.

As described above with respect to the previous embodiments, the motion for mixer 430 may be provided by the motor shaft 38 transferring the power from drive pulley 40 to driven pulley 42 and through the primary drive shaft 48 that is mounted via bearings. This provides the "tumble motion" On the "front" side of this shaft is the follower spider 458 that is rigidly mounted to the shaft 48 by a keyway and setscrew. This follower spider 458 has three lobes evenly spaced about this shaft at a given radius. Each lobe has at least one and preferably two bearings pressed into it that contain a crank arm drive shaft 464 and small planetary member or pulley 462 facing toward the back of the machine. These pulleys 462 are connected to a large stationary "sun" member or pulley 480 via a round cross section belt 478. This results in the small pulleys (or planetary members) and their respective shafts turning relative to the tumble motion. This secondary action is what provides the "shake" component. A crank arm 466 is located on the other end of each of shafts 464. One side of the crank arm has a threaded hole 488 that receives a conventional fastener (such as a cap screw, not shown) to support a "resilient" or "compliant" mount 456 to retain the follower plate or spider 474 that has the container holder and ultimately the container for the product to be mixed mounted to it. It is to be understood that the follower spider 458 serves as the base carrier. (The distance on the crank arm from the compliant mount to the secondary drive shaft determines the "shake stroke.") This mount 456 has two washers 470 and 472 (preferably of bronze) and a standoff 484 (preferably of steel) fixed to the crank arm by the cap screw or other standard fastener. The standoff 484 is sized so that the follower spider 474 is not rigidly restrained. Further, the standoff 484 has a bushing 486 (preferably of bronze) located around it. The bushing 486 has an axial length less than an axial length of the standoff 484, such that the bushing 486 is free to rotate with respect to the standoff 484. The plate or spider 474 has a thickness less than the axial length of the standoff 484 to provide clearance for the plate or spider 474 to rotate with respect to the standoff 484.

An elastomeric member such as an O-ring 482 makes the final connection from the bushing 486 to the follower plate 474. The elastomeric member 482 is radially resilient, to allow radial or angular runout (misalignment) or both at the attachment of the container carrier assembly formed by the resilient mounting arrangement 456. In this embodiment, the spider 474 and disk 442 form part of the container carrier assembly. Each of the crank arms also have a ballast or counterweight 490 to create a "moment" that offsets the moment caused by the follower plate, container holder, container and other hardware, to balance the system during operation.

The invention is thus understood to include a mixer for mixing ingredients using shaking and tumbling motion, the mixer including a base carrier rotating about a primary axis; and a container carrier assembly eccentrically mounted on the base carrier with respect to the primary axis using at least one eccentric drive element which is coupled to the base carrier for rotation about a secondary axis parallel to and displaced from the primary axis and wherein the eccentric drive element rotationally drives the container carrier assembly about the secondary axis when the base carrier is rotated about the primary axis.

The invention may also be characterized as a method of mixing using a composite motion to shake and tumble a container having ingredients to be mixed comprising the steps of rotating a base carrier about a primary axis, and mounting a container carrier assembly on the base carrier in a position eccentric to the primary axis and simultaneously rotating the container carrier assembly about a secondary axis parallel to and offset from the primary axis such that when a container having ingredients to be mixed is carried by the container carrier assembly, the ingredients are shaken and tumbled by a composite oscillating and rotating motion.

In one aspect, the invention may be characterized as a method of mixing ingredients by moving a container holding the ingredients in an epitrochoidal path. The path may be arranged to remain in a plane. To carry out this method, the container may be secured off center in a carrier assembly that rotates about an axis of a crank arm, while the axis of the crank arm moves along a locus of a circle centered on a primary axis. The drive member connected to the container carrier assembly serves as a means for moving the container carrier assembly in the epitrochoidal path. In one embodiment, the means for moving the container carrier assembly includes a plurality of gears. In other embodiments, the means for moving the container carrier assembly includes a belt drive. The base carrier may be seen to be a driving member acting through at least one planetary member to move the container carrier assembly in the manner described. At least one crank arm is secured to the at least one planetary member to both rotate and oscillate the container carrier assembly to mix the ingredients in a container held by the container carrier assembly. As may be seen in the various views, the container carrier assembly is preferably secured off center in the container carrier assembly.

In another aspect, the invention may be seen to include a clamp assembly for the container having first and second portions, the first portion sized and shaped to receive the container, and the second portion sized and shaped and positioned to positively retain the container received in the first portion and wherein the clamp assembly further has a latch mechanism for releasably retaining the first and second portions together. The container may be a conventional container appropriate for the material to be mixed, and the clamp assembly may be sized and shaped to receive any one of a predetermined set of containers of various sizes and shapes.

In a certain aspect, the invention may include various means for achieving shaking and tumbling motion to mix the contents of the container. Such means may include gearing or belts in various arrangements, which may include a central member and at least one and preferably three planetary members both orbiting about the central member and rotating about their own axes. A crank arm may be secured to the one or more planetary members to both rotate and oscillate a container carrier assembly holding the container of the contents to be mixed.

In another aspect, the invention may be seen to include a resilient mounting arrangement for the container carrier assembly.

In its most detailed form, the invention includes what is shown in the drawings. In another aspect, the invention is substantially as shown and described herein.

The invention is not to be taken as limited to all of the details thereof as modifications and variations thereof may be made without departing from the spirit or scope of the invention.

The invention claimed is:

1. A mixer comprising:

a rotatable drive shaft;

a stationary sun pulley carried by a stationary shaft extending through an interior of the rotatable drive shaft;

a base carrier rotating about a primary axis driven by the rotatable drive shaft, the base carrier including a plurality of planetary pulleys;

an endless belt connecting the stationary sun pulley and the plurality of planetary pulleys such that rotation of the base carrier relative to the stationary sun pulley causes the planetary pulleys to rotate;

a plurality of crank arms, each crank arm rotatably attached to a corresponding planetary pulley, each of the plurality of crank arms having a rotation point at which they are attached to the planetary pulley and a plate securement aperture spaced apart from the rotation point; and a plate rotatably secured to each of the crank arms via pivot pins extending through the plate securement apertures such that as each of the crank arms pivot about a secondary axis spaced apart from the primary axis, each of the pivot pins orbit the rotation point of the corresponding crank arm, the plate configured to accommodate a material container wherein the pivot pins travel through an epitrochoidal path defined by the following parametric equations:

$$x(t)=(a+b)\cos t-h\cos[(a+b)/b]t \text{ and}$$

$$y(t)=(a+b)\sin t-h\sin[(a+b)/b]t$$

in which a+b is equal to a spacing of the secondary axis to the primary axis, b is equal to a length of each of the crank arms between the rotation point and the plate securement aperture and t varies between 0 and $2\pi$ radians.

2. The mixer of claim 1, wherein the plurality of planetary pulleys comprises a total of three planetary pulleys.

3. The mixer of claim 2, wherein the plurality of crank arms comprises a total of three crank arms.

4. The mixer of claim 3, wherein the plate includes three corners, and each of the three corners is secured via one of the pivot pins to one of the three crank arms.

5. The mixer of claim 1, further comprising a material container attached to the plate, the container configured to secure material for mixing.

6. The mixer of claim 5, wherein the plate has a center, and the material container is attached to the plate at a point that is offset from the plate center.

7. The mixer of claim 1, further comprising a housing.

8. The mixer of claim 1, further comprising a motor configured to engage the rotatable drive shaft.

* * * * *